US005837436A

United States Patent [19]

Mihayashi et al.

[11] Patent Number: 5,837,436

[45] Date of Patent: Nov. 17, 1998

[54] SILVER HALIDE COLOR PHOTOGRAPHIC MATERIAL AND PACKAGE THEREOF

[75] Inventors: Keiji Mihayashi; Mamoru Sakurazawa, both of Kanagawa, Japan

[73] Assignee: Fuji Photo Film Co., Ltd., Kanagawa, Japan

[21] Appl. No.: 686,541

[22] Filed: Jul. 26, 1996

[30] Foreign Application Priority Data

Jul. 28, 1995 [JP] Japan ..... 7-211304

[51] Int. Cl.[6] ..... G03C 1/46

[52] U.S. Cl. ..... 430/503; 430/600; 430/613; 430/614; 430/615; 430/599; 430/623; 430/626; 430/554; 430/555; 430/496

[58] Field of Search ..... 430/503, 680, 430/613, 614, 615, 599, 623, 626, 554, 555, 496

[56] References Cited

U.S. PATENT DOCUMENTS

| | | | |
|---|---|---|---|
| 5,296,887 | 3/1994 | Zander | 354/275 |
| 5,453,349 | 9/1995 | Takada et al. | 430/496 |
| 5,563,025 | 10/1996 | Ishii et al. | 430/600 |

*Primary Examiner*—Geraldine Letscher
*Attorney, Agent, or Firm*—Sughrue, Mion, Zinn, Macpeak & Seas, PLLC

[57] ABSTRACT

A silver halide color photographic light-sensitive material comprising a support having on one surface thereof at least one light-sensitive silver halide emulsion layer and at least one light-insensitive layer, wherein the silver halide color photographic light-sensitive material contains at least one compound selected from the compounds represented by formulae (A-I), (A-II) and (A-III) and a coupler represented by formula (m).

9 Claims, 7 Drawing Sheets

SILVER HALIDE COLOR PHOTOGRAPHIC MATERIAL AND PACKAGE THEREOF

FIELD OF THE INVENTION

The present invention relates to a silver halide color photographic light-sensitive material and a package of the light-sensitive material. In particular, the present invention relates to a silver halide color photographic light-sensitive material (hereinafter, sometimes referred to as a "light-sensitive material") capable of preventing reduction in the color density and pressure fogging to be caused when a light-sensitive material is lengthily wound up and stored at high temperature, and a package of the light-sensitive material.

BACKGROUND OF THE INVENTION

A silver halide color photographic light-sensitive material, particularly, a color light-sensitive material for photographing, is allowed to stand for a long period of time under various conditions after the preparation until the color development and accordingly, the light-sensitive material is being demanded to be stable and able to always provide a constant image quality after development.

As a means to cope with this demand, use of a hydroxylamine-base compound in a photographic light-sensitive material is known. For example, U.S. Pat. Nos. 4,339,515 and 4,330,606 disclose that storage property of a color image produced by the coupling reaction between a coupler and an oxidation product of a developing agent is improved by using the above-described compound. However, according to these techniques, when a light-sensitive material is lengthily wound up and stored at high temperature, color density may be reduced or pressure fogging may be generated.

Further, a compound having an S-triazine ring is reported to improve storage property of the above-described light-sensitive material. For example, JP-A-59-162546 (the term "JP-A" as used herein means an "unexamined published Japanese patent publication") discloses that storage property of a latent image can be improved by the combination use with a compound having an active vinyl group and JP-A-59-97134 discloses that fogging is reduced by the combination use with an emulsion comprising tabular silver halide grains. However, even in the techniques using a compound having an S-triazine (1,3,5-triazine) ring, when a light-sensitive material is lengthily wound up and stored at high temperature, color density may be reduced or pressure fogging may be generated.

On the other hand, JP-A-57-35858 and JP-A-51-20826 disclose specific 5-pyrazolone type couplers capable of showing excellent coloring. However, the 5-pyrazolone type coupler described in these patent publications is still insufficient in the coloring property and when a light-sensitive material is lengthily wound up (i.e., a light-sensitive material with a large length is wound up) and stored at high temperature, color density may be reduced or pressure fogging may be generated.

SUMMARY OF THE INVENTION

An object of the present invention is, accordingly to provide a silver halide color photographic material capable of preventing reduction in the color density and pressure fogging to be caused when a light-sensitive material is lengthily wound up and stored at high temperature, and a package thereof.

Other objects and effects of the present invention will be apparent from the following description.

As a result of extensive investigations, the present inventors have found that the prevention of reduction in the color density and of pressure fogging, which are caused when a light-sensitive material is lengthily wound up and stored at high temperature, can be improved by a silver halide color photographic light-sensitive material using a specific hydroxylamine-base compound or a hydroxamic acid-base compound in at least one of light-sensitive layers constituting the light-sensitive material on a support and using a specific 5-pyrazolone type two-equivalent coupler, and that the prevention can also be improved by a package produced by housing the above-described light-sensitive material in a specific cartridge. The present invention has been accomplished based on these findings.

More specifically, the present invention relates to:

(1) A silver halide color photographic light-sensitive material comprising a support having on one surface thereof at least one light-sensitive silver halide emulsion layer and at least one light-insensitive layer, wherein said silver halide color photographic light-sensitive material contains at least one compound selected from the group consisting of compounds represented by formulae (A-I), (A-II) and (A-III) and a coupler represented by formula (m):

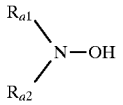

(A-I)

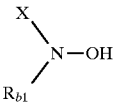

(A-II)

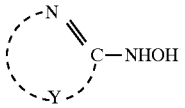

(A-III)

wherein in formula (A-I), $R_{a1}$ represents an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, $R_{a2}$ represents a hydrogen atom, an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, provided that when $R_{a1}$ is an alkyl group, an alkenyl group or an aryl group, $R_{a2}$ is an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, and $R_{a1}$ and $R_{a2}$ may be combined with each other to form a 5-, 6- or 7-membered ring, provided that an S-triazine ring is not formed;

in formula (A-II), X represents a heterocyclic group exclusive of an S-triazine ring, $R_{b1}$ represents an alkyl group, an alkenyl group or an aryl group and X and $R_{b1}$ may be combined with each other to form a 5-, 6- or 7-membered ring, provided that an S-triazine ring is not formed; and in formula (A-III), Y represents a nonmetallic atom group necessary for forming a 5-membered ring together with an —N=C— group or Y represents a nonmetallic atom group necessary for forming a 6-membered ring together with an —N=C— group with the terminal of Y to be bonded to the carbon atom of the —N=C— group being a group selected from —N($R_{c1}$)—, —C($R_{c2}$)($R_{c3}$)—, —C($R_{c4}$)=, —O— and —S— (the carbon atom of —N=C— is bonded to the left site of each group), provided that an S-triazine ring is not formed, and $R_{c1}$, $R_{c2}$, $R_{c3}$ and $R_{c4}$ each represents a hydrogen atom or a substituent;

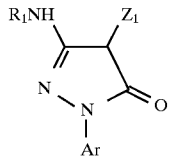

(m)

wherein $R_1$ represents an alkyl group, an aryl group, an acyl group or a carbamoyl group, Ar represents a phenyl group or a phenyl group substituted by one or more of a halogen atom, an alkyl group, a cyano group, an alkoxy group, an alkoxy-carbonyl group, an acylamino group, a sulfonamido group, a sulfonyl group and a sulfamoyl group, and $Z_1$ represents a group capable of releasing off upon reaction with an oxidation product of an aromatic primary amine developing agent.

(2) a silver halide color photographic light-sensitive material as described in item (1), wherein a magnetic recording layer containing magnetic particles is provided on the side opposite to the side having said emulsion layer through the support.

(3) a package of a photographic light-sensitive material comprising a cartridge body having rotatably housed in the inside thereof a spool wound around with a photographic light-sensitive material comprising a support having provided thereon an emulsion layer, a leading end of said photographic light-sensitive material capable of being fed outside said cartridge body along the rotation of said spool, said cartridge body having a passage having a light-shielding mechanism for feeding out said photographic light-sensitive material, a spool shaft of said spool having a pair of flanges with a lip in the inside at both edges thereof, and said photographic light-sensitive material being a silver halide color photographic light-sensitive material described in item (1) or (2).

The present invention is a silver halide color photographic light-sensitive material comprising a support having on one surface thereof at least one light-sensitive silver halide emulsion layer and at least one light-insensitive layer, wherein at least one layer contains a compound selected from the compounds represented by formulae (A-I) to (A-III) and a coupler represented by formula (m).

By using a specific compound represented by formula (A-I), (A-II) or (A-III) in combination with a specific two-equivalent pyrazolone type coupler represented by formula (m), reduction in the color density and pressure fogging, which are caused when a light-sensitive material is lengthily wound up and stored at high temperature, can be satisfactorily prevented and thereby the object of the present invention can be achieved.

In the present invention, a light-sensitive material having a magnetic layer containing magnetic particles in a back layer on the side opposite to the above-described emulsion layer through the support is preferred. Usually, when a light-sensitive material having a magnetic layer is lengthily wound up and stored at high temperature, deterioration due to reduction in the color density and pressure fogging is liable to be further intensified. The present invention is very effective against this problem and can satisfactorily overcome this problem.

In the specific cartridge for use in the present invention, deterioration due to reduction in the color density and pressure fogging, which are caused when a light-sensitive material is lengthily wound up and stored at high temperature, is liable to be further intensified. The package produced by housing the light-sensitive material of present invention in the specific cartridge can satisfactorily overcome this problem, thereby achieving the object of the present invention.

DETAILED DESCRIPTION OF THE INVENTION

Figure 1:
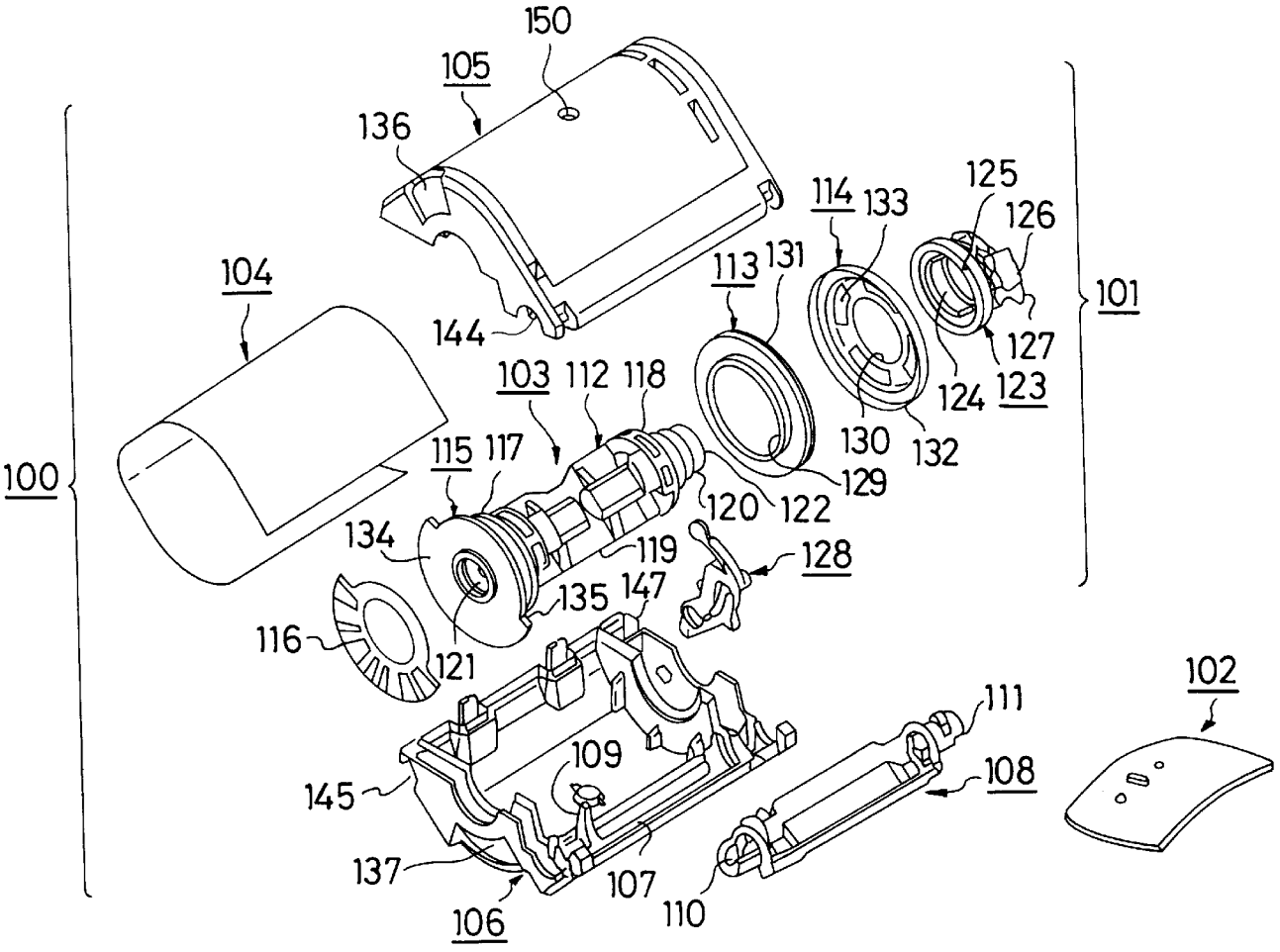
FIG. 1 is an exploded perspective view of a package of a photographic light-sensitive material (photographic film patrone) according to one embodiment of the present invention.

The compounds represented by formulae (A-I) to (A-III) are described in detail below.

The alkyl group as used in the present invention includes linear, branched and cyclic alkyl groups and the alkyl group may have a substituent.

In formula (A-I), $R_{a1}$ represents an alkyl group (preferably an alkyl group having from 1 to 36 carbon atoms, e.g., methyl, ethyl, i-propyl, cyclopropyl, butyl, isobutyl, cyclohexyl, t-octyl, decyl, dodecyl, hexadecyl, benzyl), an alkenyl group (preferably an alkenyl group having from 2 to 36 carbon atoms, e.g., allyl, 2-butenyl, isopropenyl, oleyl, vinyl), an aryl group (preferably an aryl group having from 6 to 40 carbon atoms, e.g., phenyl, naphthyl), an acyl group (preferably an acyl group having from 2 to 36 carbon atoms, e.g., acetyl, benzoyl, pivaloyl, α-(2,4-di-tert-amylphenoxy)butyryl, (3-cyclohexen-1-yl) carbonyl, myristoyl, stearoyl, naphthoyl, m-pentadecylbenzoyl, (5-norbornen-2-yl)carbonyl, isonicotinoyl), an alkyl- or arylsulfonyl group (preferably an alkyl- or arylsulfonyl group having from 1 to 36 carbon atoms, e.g., methanesulfonyl, octanesulfonyl, benzenesulfonyl, toluenesulfonyl), an alkyl- or arylsulfinyl group (preferably an alkyl- or arylsulfinyl group having from 1 to 40 carbon atoms, e.g., methanesulfinyl, benzenesulfinyl), a carbamoyl group (including an N-substituted carbamoyl group, preferably a carbamoyl group having from 1 to 40 carbon atoms, e.g., N-ethylcarbamoyl, N-phenylcarbamoyl, N,N-dimethylcarbamoyl, N-butyl-N-phenylcarbamoyl), a sulfamoyl group (including an N-substituted sulfamoyl group, preferably a sulfamoyl group having from 1 to 40 carbon atoms, e.g., N-methylsulfamoyl, N,N-diethylsulfamoyl, N,N-phenylsulfamoyl, N-cyclohexyl-N-phenylsulfamoyl, N-ethyl-N-dodecylsulfamoyl), an alkoxycarbonyl group (preferably an alkoxycarbonyl group having from 2 to 36 carbon atoms, e.g., methoxycarbonyl, cyclohexyloxycarbonyl, benzyloxycarbonyl, isoamyloxycarbonyl, hexadecyloxycarbonyl), or an aryloxycarbonyl group (preferably an aryloxycarbonyl group having from 7 to 40 carbon atoms, e.g., phenoxycarbonyl, naphthoxycarbonyl). $R_{a2}$ represents a hydrogen atom or groups described above for $R_{a1}$.

In formula (A-II), the heterocyclic group represented by X includes 5- to 7-membered heterocyclic rings having at least one of a nitrogen atom, a sulfur atom, an oxygen atom and a phosphorus atom as the ring constituent atom exclusive of an S-triazine ring (1,3,5-triazine ring) and the bonding site of the heterocyclic ring (i.e., the site of the monovalent group) is preferably the carbon atom. Examples thereof include 1,2,4-triazin-3-yl, pyridin-2-yl, pyrazinyl, pyrimidinyl, purinyl, quinolyl, imidazolyl, 1,2,4-triazol-3-yl, benzimidazol-2-yl, thienyl, furyl, imidazolidinyl, pyrrolinyl, tetrahydrofuryl, morpholinyl and phosphinolin-2-yl. $R_{b1}$ represents the same alkyl, alkenyl or aryl group described above for $R_{a1}$, in formula (A-I).

In formula (A-III), Y represents a nonmetallic atom group necessary for forming a 5-membered ring together with —N═C— (examples of the ring group formed include imidazolyl, benzimidazolyl, 1,3-thiazol-2-yl, 2-imidazolin-2-yl, purinyl and 3H-indol-2-yl). Y further represents a nonmetallic atom group necessary for forming a 6-membered ring together with —N═C— with the terminal of Y to be bonded to the carbon atom of the —N═C— group being a group selected from —N($R_{c1}$)—, —C($R_{c2}$)($R_{c3}$)—, —C($R_{c4}$)═, —O— and —S— (the carbon atom of —N═C— is bonded to the left side of each group). However, an S-triazine (1,3,5-triazine) ring is not formed. $R_{c1}$ to $R_{c4}$ may be the same or different and each represents a hydrogen atom or a substituent (for example, an alkyl group, an alkenyl group, an aryl group, an alkoxy group, an aryloxy group, an alkylthio group, an arylthio group, an alkylamino group, an arylamino group, a halogen atom). The alkyl group, the alkenyl group and the aryl group as used herein have the same meaning as the alkyl group, the alkenyl group and the aryl group for $R_{a1}$ in formula (A-1), respectively. Also, the alkyl group in the alkoxy group, the alkylthio group and the alkylamino group and the aryl group in the aryloxy group, the arylthio group and the arylamino group have the same meaning as defined in relation to $R_{a1}$ in formula (A-1). Examples of the halogen atom include a chlorine atom, a bromine atom and a fluorine atom.

Examples of the 6-membered ring group formed by Y include quinolyl, isoquinolyl, phthalazinyl, quinoxalinyl and 6H-1,2,5-thiadiazin-6-yl.

In formula (A-I) or formula (A-II), $R_{a1}$ and $R_{a2}$ or X and $R_{b1}$ may be combined with each other to form a 5- 6- or 7-membered ring and examples of the ring include a succinimido ring, a phthalimido ring, a triazole ring, a urazole, a hydantoin ring and a 2-oxo-4-oxazolidinone ring but an S-triazine ring is excluded.

The groups in the compounds represented by formulae (A-I) to (A-III) each may be further substituted by a substituent.

Examples of the substituent include an alkyl group, an alkenyl group, an aryl group, a heterocyclic group, a hydroxy group, an alkoxy group, an aryloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group and a hydroxyamino group.

In formula (A-I), preferably, $R_{a2}$ is a hydrogen atom, an alkyl group, an alkenyl group or an aryl group and $R_{a1}$ is an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group; more preferably, $R_{a2}$ is an alkyl group or an alkenyl group and $R_{a1}$ is an acyl group, an alkylsulfonyl group, an arylsulfonyl group, a carbamoyl group, a sulfamoyl group, an alkoxycarbonyl group or an aryloxycarbonyl group; most preferably, $Ra_2$ is an alkyl group and $R_{a1}$ is an acyl group.

In formula (A-II), $R_{b1}$ is an alkyl group or an alkenyl group, more preferably an alkyl group.

The compound represented by formula (A-II) is preferably a compound represented by formula (A-II-1).

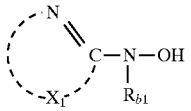

(A-II-1)

wherein $R_{b1}$ has the same meaning as $R_{b1}$ in formula (A-II) and $X_1$ represents a nonmetallic atom group necessary for forming a 5- or 6-membered ring together with —C═N—.

Among the compounds represented by formula (A-II-1), those wherein $X_1$ forms a 5- or 6-membered heteroaromatic ring are preferred, provided that an S-triazine ring is not formed.

Among the compounds represented by formula (A-III), those wherein Y is a nonmetallic atom group necessary for forming a 5-membered ring are preferred, and those where the terminal atom of Y to be bonded to the carbon atom of the —N═C— group is a nitrogen atom are more preferred, provided that an S-triazine ring is not formed.

The compound wherein Y forms an imidazoline ring is most preferred and the imidazoline ring may be condensed with a benzene ring.

Among the compounds represented by formula (A-I) to (A-III), compounds having a total carbon number of 15 or less are preferred in view of their capability to act also on the layer other than the layer where the compound is added. On the other hand, compounds having a total carbon number of 16 or more are preferred for the purpose of restricting the action only on the layer where the compound is added.

Among the compounds represented by formulae (A-I) to (A-III), those represented by formulae (A-I) and (A-II) are preferred and those represented by formula (A-I) are more preferred.

Specific examples of the compounds represented by formulae (A-I) to (A-III) of the present invention are set forth below, but the present invention is by no means limited thereto.

A-1
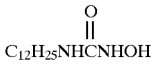
A-2
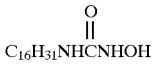
A-3
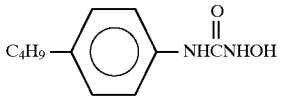
A-4
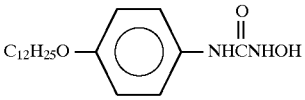
A-5
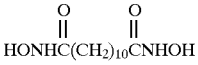
A-6
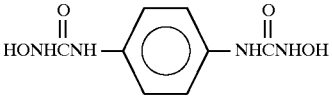
A-7
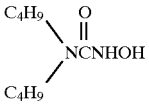
A-8
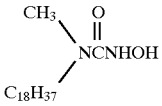
A-9
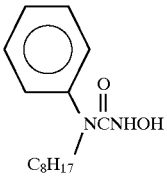
A-10
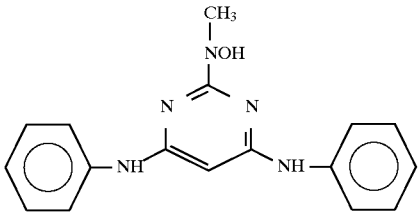
A-11
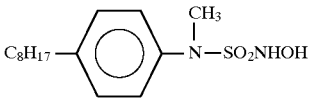
A-12
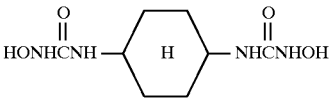
A-13
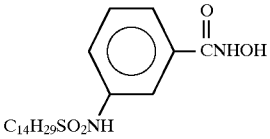
A-14
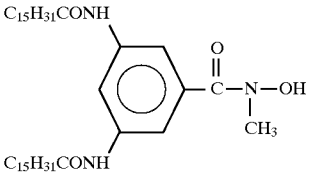
A-15
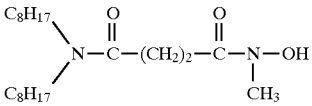
A-16
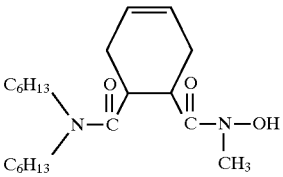
A-17
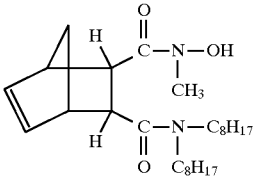
A-18
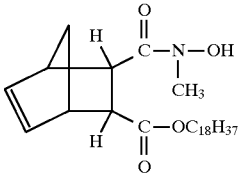

-continued
A-19
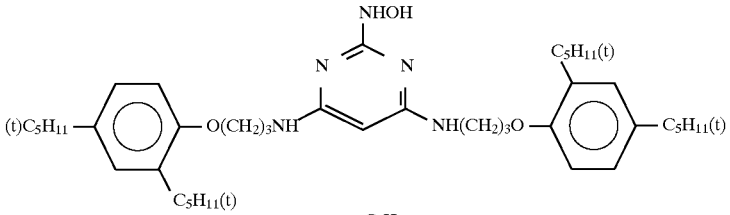
A-20
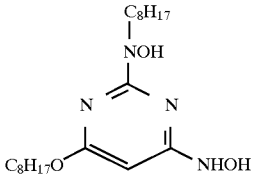
A-21
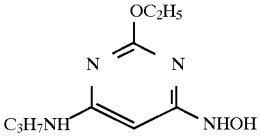
A-22
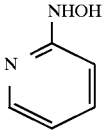
A-23
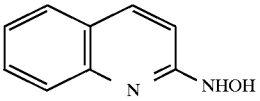
A-24
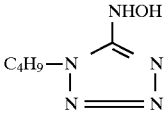
A-25
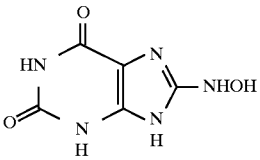
A-26
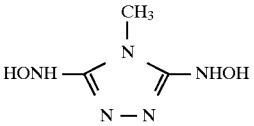
A-27
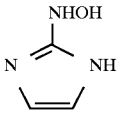
A-28
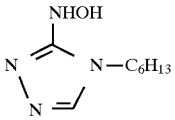
A-29
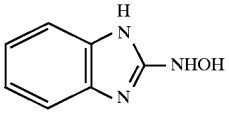
A-30
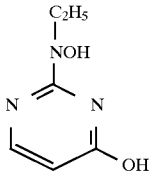
A-31
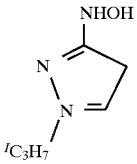
A-32
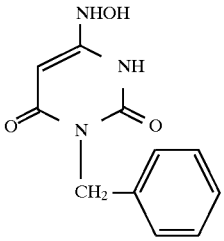
A-33
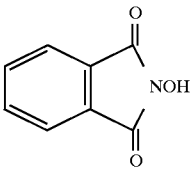
A-34
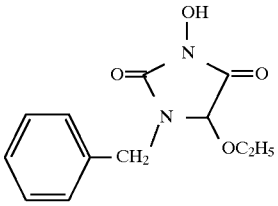

-continued

A-35

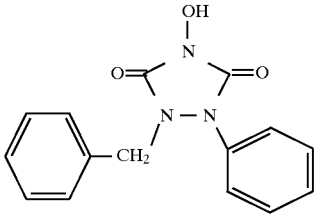

A-36

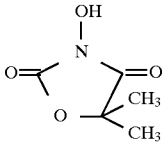

A-37

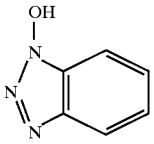

A-38

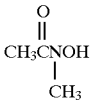

A-39

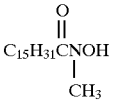

A-40

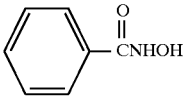

A-41

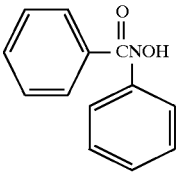

A-42

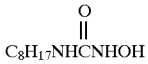

A-43

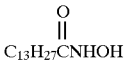

A-44

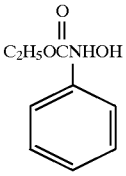

A-45

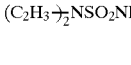

A-46

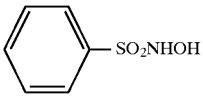

A-47

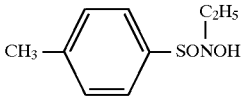

A-48

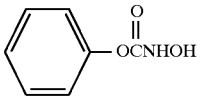

A-49

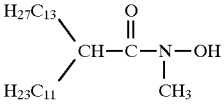

A-50

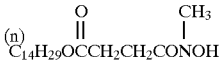

A-51

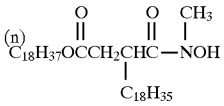

A-52

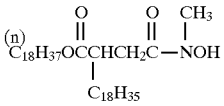

A-53

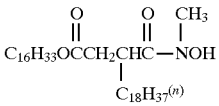

A-54

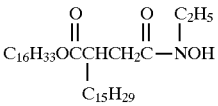

A-55

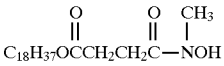

The corresponding relationship between these compounds and formulae (A-I) to (A-III) is shown below.

| | |
|---|---|
| A-1 to A-9, A-11 to A-18, A-33 to A-55 | Formula (A-I): |
| A-10, A-20, A-30 | Formula (A-II): |
| A-19, A-21 to A-29, A-31, A-32 | Formula (A-III): |

The above-described compounds of the present invention can be easily synthesized by the methods described in *J. Org. Chem.*, 27, 4054 (1962), *J. Amer. Chem. Soc.*, 73, 2981 (1951), and JP-B-49-10692 (the term "JP-B" as used herein means an "examined Japanese patent publication") and the methods in accordance therewith.

In the present invention, the compound represented by formula (A-I), (A-II) or (A-III) may be added after dissolving it in water or a water-soluble solvent such as methanol or ethanol or in a mixed solvent thereof, or may be added by emulsion dispersion. Further, the compound may be added previously at the preparation of an emulsion.

In dissolving the compound in water, if the solubility increases by raising or lowering the pH, the pH may be raised or lowered at the dissolution.

In the present invention, compounds represented by formulae (A-I) to (A-III) may be used in combination of two or more thereof.

For example, the combination use of a water-soluble compound with an oil-soluble compound is advantageous in view of photographic capabilities.

The coating amount of the compound represented by formula (A-I), (A-II) or (A-III) is preferably from 0.01 to 100 mg/m$^2$, more preferably from 0.1 to 50 mg/m$^2$, still more preferably from 1 to 20 mg/m $^2$, per one silver halide light-sensitive layer.

The above-described compound is generally used in at least one silver halide light-sensitive layer, however, the same compound may also be used in a plurality of layers. Different compounds may be used in respective light-sensitive layers. Further, the compound may be used in a light-sensitive layer and at the same time in a light-insensitive layer, for example, an interlayer, a colloidal silver-containing yellow filter layer, an anti-halation layer or a protective layer.

In the present invention, the compound represented by formula (A-I), (A-II) or (A-III) is preferably oil-soluble.

It is particularly preferred to use an oil-soluble compound in a layer containing the coupler represented by formula (m) which will be described later. A water-soluble compound represented by formula (A-I), (A-II) or (A-III) may be further added.

By using the compound represented by formula (A-I), (A-II) or (A-III) of the present invention in combination with a coupler represented by formula (m) which will be described later, reduction in the color density of couplers or pressure fogging to be caused when a light-sensitive material is lengthily wound up and stored at high temperature can be prevented and thereby the object of the present invention can be achieved. The pressure fogging is generated in the inner portion rather than the outer portion of the light-sensitive material wound up. The term "be lengthily wound up" as used herein means that the light-sensitive is wound at a turn number of 20 or more, particularly in excess of 30, irrespective of the size of a core on which the material is to be wound.

Further, in the present invention, the high temperature as used in the phrase "when a light-sensitive material is stored at high temperature"means a temperature region higher than usual room temperature, more specifically an approximate temperature value in a car when the car is left under the burning sun in summer. Accordingly, the high temperature means a temperature range of from 35° to 90° C.

The coupler represented by formula (m) is described in detail below.

In formula (m), $R_1$ represents an alkyl group, an aryl group, an acyl group or a carbamoyl group, more specifically, an alkyl group (preferably a linear or branched alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 8 carbon atoms, e.g., cyclopropyl, cyclopentyl, cyclohexyl, 1-norbornyl, 1-adamantyl), an aryl group (preferably an aryl group having from 6 to 32 carbon atoms, e.g., phenyl, 1-naphthyl, 2-naphthyl), an acyl group (preferably an acyl group having from 1 to 32 carbon atoms, e.g., formyl, acetyl, pivaloyl, benzoyl, tetradecanoyl), or a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl). The group represented by $R_1$ may have further a substituent and examples of the substituent include a halogen atom (e.g., fluorine, chlorine, bromine), an alkyl group (preferably a linear or branched alkyl group having from 1 to 32 carbon atoms, e.g., methyl, ethyl, propyl, isopropyl, butyl, t-butyl, 1-octyl, tridecyl), a cycloalkyl group (preferably a cycloalkyl group having from 3 to 8 carbon atoms, e.g., cyclopropyl, cyclopentyl, cyclohexyl, 1-norbornyl, 1-adamantyl), an alkenyl group (preferably an alkenyl group having from 2 to 32 carbon atoms, e.g., vinyl, allyl, 3-buten-1-yl), an aryl group (preferably an aryl group having from 6 to 32 carbon atoms, e.g., phenyl, 1-naphthyl, 2-naphthyl), a heterocyclic group (preferably a 5-, 6-, 7- or 8-membered heterocyclic group having from 1 to 32 carbon atoms, e.g., 2-thienyl, 4-pyridyl, 2-furyl, 2-pyrimidinyl, 1-pyridyl, 2-benzothiazolyl, 1-imidazolyl, 1-pyrazolyl, benzotrizol-2-yl), a cyano group, a silyl group (preferably a silyl group having from 3 to 32 carbon atoms, e.g., trimethylsilyl, triethylsilyl, tributylsilyl, t-butyldimethylsilyl, t-hexyldimethylsilyl), a nitro group, a hydroxyl group, an alkoxy group (preferably an alkoxy group having from 1 to 32 carbon atoms, e.g., methoxy, ethoxy, 1-butoxy, 2-butoxy, isopropoxy, t-butoxy, dodecyloxy), a cycloalkyloxy group (preferably a cycloalkyloxy group having from 3 to 8 carbon atoms, e.g., cyclopentyloxy, cyclohexyloxy), an aryloxy group (preferably an aryloxy group having from 6 to 32 carbon atoms, e.g., phenoxy, 2-naphthoxy), a heterocyclic oxy group (preferably a heterocyclic oxy group having from 1 to 32 carbon atoms, e.g., 1-phenyltetrazol-5-oxy, 2-tetrahydropyranyloxy, 2-furyloxy), a silyloxy group (preferably a silyloxy group having from 1 to 32 carbon atoms, e.g., trimethylsilyloxy, t-butyldimethylsilyloxy, diphenylmethylsilyloxy), an acyloxy group (preferably an acyloxy group having from 2 to 32 carbon atoms, e.g., acetoxy, pivaloyloxy, benzoyloxy, dodecanoyloxy), an alkoxycarbonyloxy group (preferably an alkoxycarbonyloxy group having from 2 to 32 carbon atoms, e.g., ethoxycarbonyloxy, t-butoxycarbonyloxy), a cycloalkyloxycarbonyloxy group (preferably a cycloalkyloxycarbonyloxy group having from 4 to 9 carbon atoms, e.g., cyclohexyloxycarbonyloxy), an aryloxycarbonyloxy group (preferably an aryloxycarbonyloxy group having from 7 to 32 carbon atoms, e.g., phenoxycarbonyloxy), a carbamoyloxy group (preferably a carbamoyloxy group having from 1 to 32 carbon atoms, e.g., N,N-dimethylcarbamoyloxy, N-butylcarbamoyloxy), a sulfamoyloxy group (preferably a sulfamoyloxy group having from 1 to 32 carbon atoms, e.g., N,N-diethylsulfamoyloxy, N-propylsulfamoyloxy), an alkanesulfonyloxy group (preferably an alkanecarbonyloxy group having from 1 to 32 carbon atoms, e.g., methanesulfonyloxy, hexadecanesulfonyloxy), an allenesulfonyloxy (preferably an allenesufonyl group having from 6 to 32 carbon atoms, e.g., benzenesulfonyloxy), an acyl group (preferably an acyl group having from 1 to 32 carbon atoms, e.g., formyl, acetyl, pivaloyl, benzoyl, tetradecanoyl), an alkoxycarbonyl group (preferably an alkoxycarbonyl group having from 2 to 32 carbon atoms, e.g., methoxycarbonyl, ethoxycarbonyl, octadecyloxycarbonyl), a cycloalkyloxycarbonyl group (preferably a cycloalkyloxycarbonyl group having from 2 to 32 carbon atoms, e.g., cyclopentyloxycarbonyl, cyclohexyloxycarbonyl), an aryloxycarbonyl group (preferably an aryloxycarbonyl group having from 7 to 32 carbon atoms, e.g., phenoxycarbonyl), a carbamoyl group (preferably a carbamoyl group having from 1 to 32 carbon atoms, e.g., carbamoyl, N,N-dibutylcarbamoyl, N-ethyl-N-octylcarbamoyl, N-propylcarbamoyl), an amino group (preferably an amino group having 32 or less carbon atoms, e.g., amino, methylamino, N,N-dioctylamino, tetradecylamino, octadecylamino), an anilino group (preferably an anilino group having from 6 to 32 carbon atoms, e.g., anilino, N-methylanilino), a heterocyclic amino group (preferably a heterocyclic amino group having from 1 to 32 carbon atoms, e.g., 4-pyridylamino), a carbonamido group (preferably a carbonamido group having from 2 to 32 carbon atoms, e.g., acetamido, benzamido, tetradecanamido), a ureido group (preferably a ureido group having from 1 to 32 carbon atoms, e.g., ureido, N,N-dimethylureido, N-phenylureido), an imido group (preferably an imido group having 10 or less carbon atoms, e.g., N-succinimido, N-phthalimido), an alkoxycarbonylamino group (preferably an alkoxycarbonylamino group having from 2 to 32 carbon atoms, e.g., methoxycarbonylamino, ethoxycarbonylamino, t-butoxycarbonylamino, octadecyloxycarbonylamino), an aryloxycarbonylamino group (preferably an aryloxycarbonylamino group having from 7 to 32 carbon atoms, e.g., phenoxycarbonylamino), a sulfonamido group (preferably a sulfonamido group having from 1 to 32 carbon atoms, e.g., methanesulfonamido, butanesulfonamido, benzenesulfonamido, hexadecanesulfonamido), a sulfamoylamino group (preferably a sulfamoylamino group having from 1 to 32 carbon atoms, e.g., N,N-dipropylsulfamoylamino, N-ethyl-N-dodecylsulfamoylamino), an azo group (preferably an azo group having from 1 to 32 carbon atoms, e.g., phenylazo, 4-methoxyphenylazo), an alkylthio group (preferably an alkylthio group having from 1 to 32 carbon atoms, e.g., ethylthio, octylthio), an arylthio group (preferably an arylthio group having from 6 to 32 carbon atoms, e.g., phenylthio), a heterocyclic thio group (preferably a heterocyclic thio group having from 1 to 32 carbon atoms, e.g., 2-benzothiazolylthio, 2-pyridylthio, 1-phenyltetrazolylthio), an alkylsulfinyl group (preferably an alkylsulfinyl group having from 1 to 32 carbon atoms, e.g., dodecanesulfinyl), an allenesulfinyl group (preferably an allenesulfinyl group having from 6 to 32 carbon atoms, e.g., benzenesulfinyl), an alkanesulfonyl group (preferably an alkanesulfonyl group having from 1 to 32 carbon atoms, e.g., methanesulfonyl, octanesulfonyl), an allenesulfonyl group (preferably an allenesulfonyl group having from 6 to 32 carbon atoms, e.g., benzenesulfonyl, 1-naphthalenesulfonyl), a sulfamoyl group (preferably a sulfamoyl group having 32 or less carbon atoms, e.g., sulfamoyl, N,N-dipropylsulfamoyl, N-ethyl-N-dodecylsulfamoyl), a sulfo group, a phosphonyl group (preferably a phosphonyl group having from 1 to 32 carbon atoms, e.g., phenoxyphosphonyl, octyloxyphosphonyl, phenylphosphonyl), and a phosphinoylamino group (e.g., diethoxyphosphinoylamino, dioctyloxyphosphinoylamino).

The substituent of the group represented by $R_1$ is preferably a halogen atom, an alkyl group, an alkoxy group, an aryloxy group, an alkoxycarbonyl group, a carbamoyl group, a carbonamido group, an alkoxycarbonylamino group, an aryloxycarbonylamino group, a ureido group, a sulfonamido group, an imido group, an alkanesulfonyl group, an allenesulfonyl group, a phosphonyl group or a phosphinoylamino group.

Ar represents a phenyl group having from 6 to 32 carbon atoms or a phenyl group substituted by one or more of a halogen atom, an alkyl group, a cyano group, an alkoxy group, an alkoxycarbonyl group, an acylamino group, a sulfonamido group, a sulfonyl group and a sulfamoyl group, and examples thereof include phenyl, 2,4,6-trichlorophenyl, 2,5-dichlorophenyl, 2,4-dimethyl-6-methoxyphenyl, 2,6-dichloro-4-methoxyphenyl, 2,6-dichloro-4-ethoxycarbonylphenyl, 2,6-dichloro-4-cyanophenyl and 4-[2-(2,4-di-t-amylphenoxy)butanamido]phenyl. The group represented by Ar may further have a substituent and examples of the substituent include those describe above as the substituent of the group represented by $R_1$.

$R_1$ is preferably an aryl group or an acyl group. Ar is preferably a 2,4,6-trichlorophenyl group or a 2,5-dichlorophenyl group.

$Z_1$ represents a coupling releasing-off group and examples of the coupling releasing-off group include a halogen atom, an alkoxy group, an aryloxy group, an acyloxy group, a sulfonyloxy group, an amido group, an alkoxycarbonyloxy group, an aryloxycarbonyloxy group, an alkyl heterocyclic thio group, an arylheterocyclic thio group, an imido group, a 5- or 6-membered nitrogen-containing heterocyclic group and an arylazo group. These groups each may further be substituted by a group allowable as a substituent of $R_1$. More specifically, the coupling releasing-off group represented by $Z_1$ is a halogen atom (e.g., fluorine, chlorine, bromine), an alkoxy group (e.g., dodecyloxy, dodecyloxycarbonylmethoxy, methoxycarbamoylmethoxy, carboxypropyloxy, methanesulfonyloxy), an aryloxy group (e.g., methylphenoxy, 4-tert-butylphenoxy, 4-methoxyphenoxy, 4-methanesulfonylphenoxy, 4-(4-benzyloxyphenylsulfonyl)phenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, triphenylphosphonamido), an alkoxycarbonyloxy group (e.g., ethoxycarbonyloxy, benzyloxycarbonyloxy), an aryloxycarbonyloxy group (e.g., phenoxycarbonyloxy, 2,4,6-trimethylphenoxycarbonyl), an alkylthio group (preferably an alkylthio group having from 1 to 32 carbon atoms, e.g., dodecylthio, tetradecylthio, hexadecylthio, octadecylthio, tetradecanecarboxylic acid-2-thio), an arylthio group (preferably an arylthio group having from 6 to 32 carbon atoms, e.g., 2-butoxy-5-(1,1,3,3-tetramethyl-1-butyl)phenylthio, 2-pivaloylaminophenylthio, 2-phenoxycarbonylaminophenylthio, 2-(2-octyloxybenzamido)phenylthio, 2-[2-(2,4-di-t-amylphenoxy)butanamido]phenylthio, 4-[2-(2,4-di-t-amylphenoxy)butanamido]phenylthio), a heterocyclic thio group (preferably a heterocyclic thio group having from 1 to 32 carbon atoms, e.g., 2-benzothiazolylthio, 2-pyridylthio, 1-phenyltetrazolylthio), an imido group (e.g., succinimido, hydantoinyl, 2,4-dioxooxazolidin-3-yl, 3-benzyl-4-ethoxyhydantoin-1-yl), a 5- or 6-membered nitrogen-containing heterocyclic group (e.g., 1-pyrazolyl, 1-benzotriazolyl, 5-chloro-1,2,4-triazol-1-yl, 1,2-dihydro-2-oxo-1-pyridyl), or an arylazo group (e.g., phenylazo, 4-methoxyphenylazo, 4-dodecyloxy-3-methoxyphenylazo, 4-hydroxy-3-methylphenylazo, 4-pivaloylaminophenylazo, 4-tetradecyloxy-3-methylphenylazo). In addition, $Z_1$ may have the form of a bis type coupler which is obtained by condensing a four-equivalent coupler with an aldehyde or a ketone as a releasing-off group bonded through a carbon atom. Further, $Z_1$ may contain a photographically useful group such as a development inhibitor or a development accelerator. $Z_1$ is preferably an alkylthio group, an arylthio group, a heterocyclic thio group, or a 5- or 6-membered nitrogen-containing heterocyclic group bonded to the coupling active site through the nitrogen atom.
Examples of the compound as the magenta coupler represented by formula (m) are set forth below, but the present invention is by no means limited thereto.
(m-1)
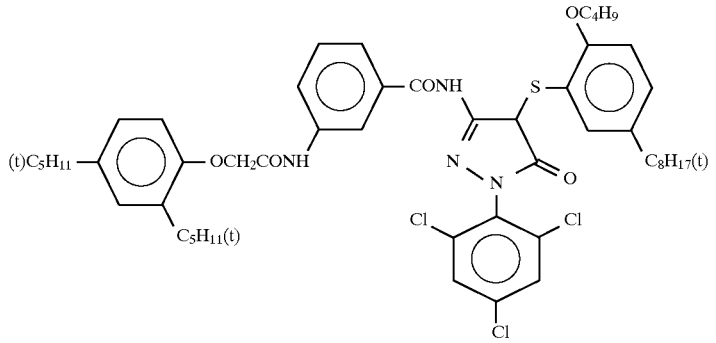
(m-2)
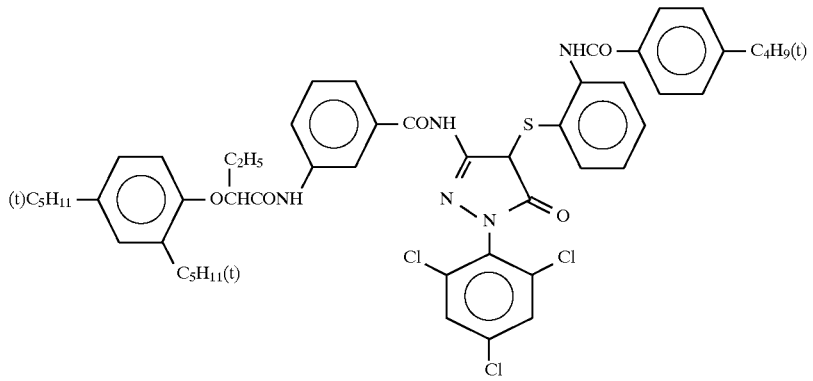
(m-3)
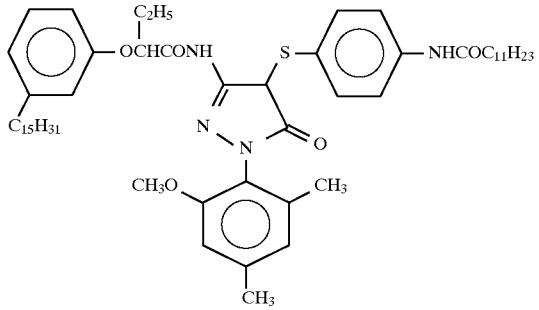
(m-4)
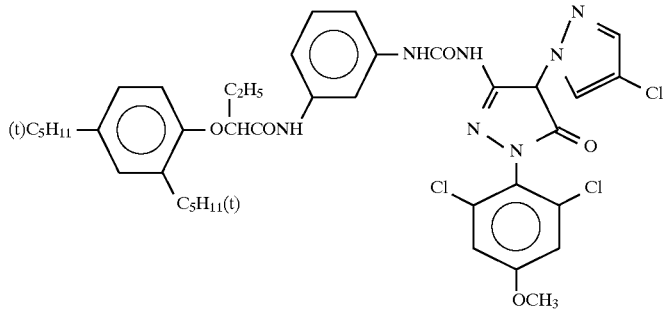

-continued
(m-5)
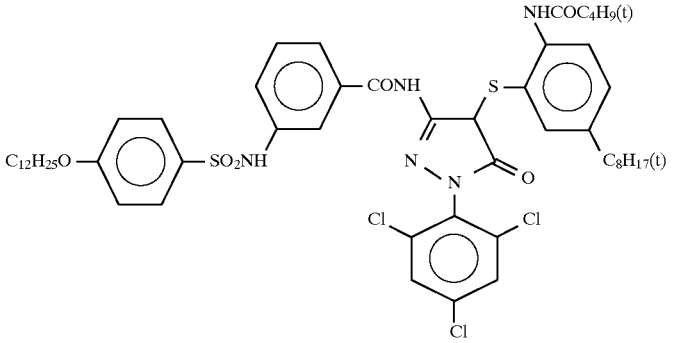
(m-6)
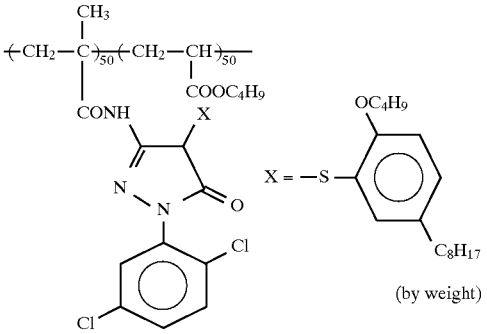
(by weight)
(m-7)
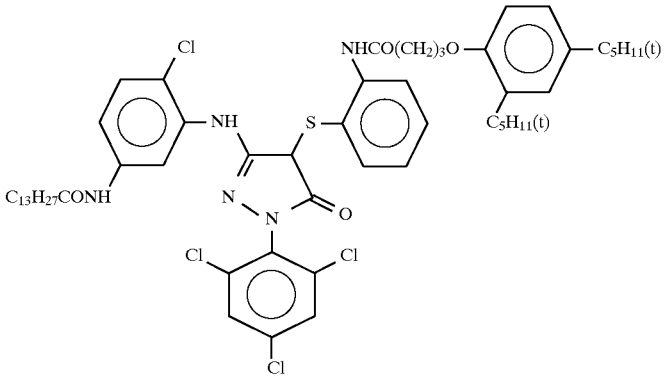
(m-8)
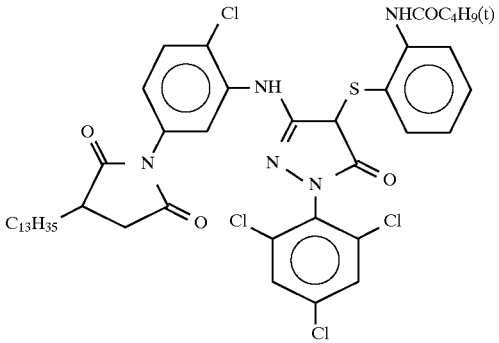

-continued
(m-9)
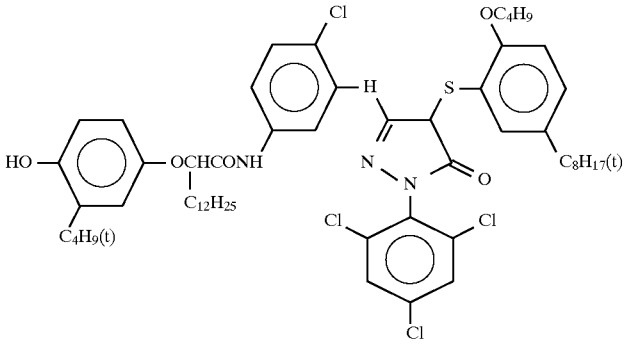
(m-10)
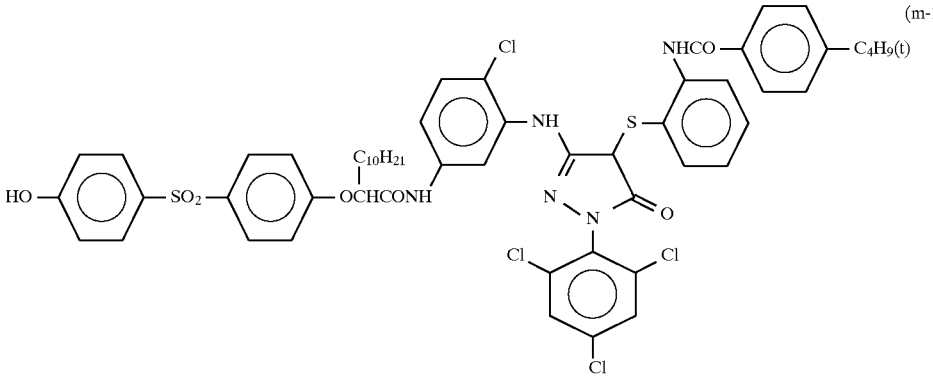
(m-11)
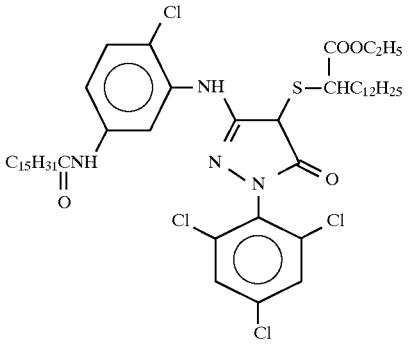
(m-12)
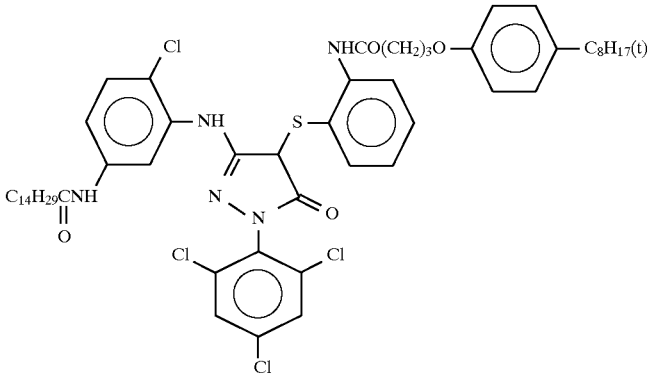

-continued
(m-13)
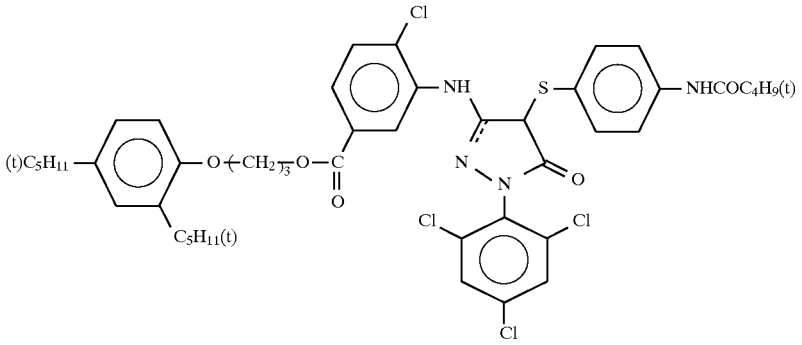
(m-14)
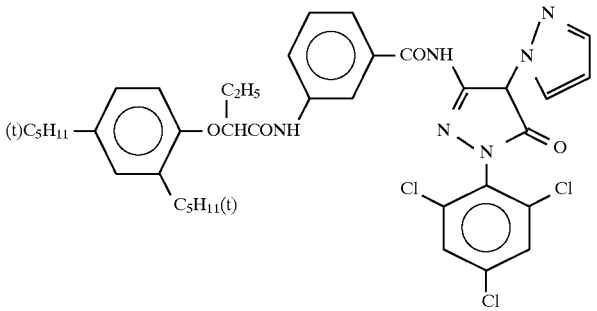
(m-15)
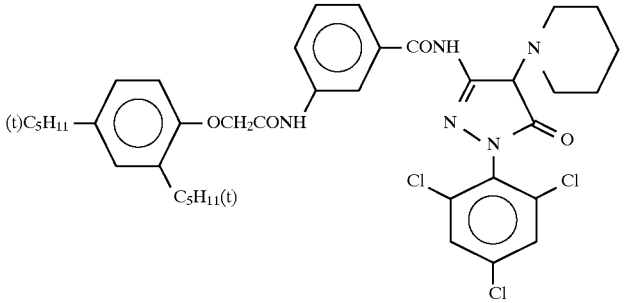
(m-16)
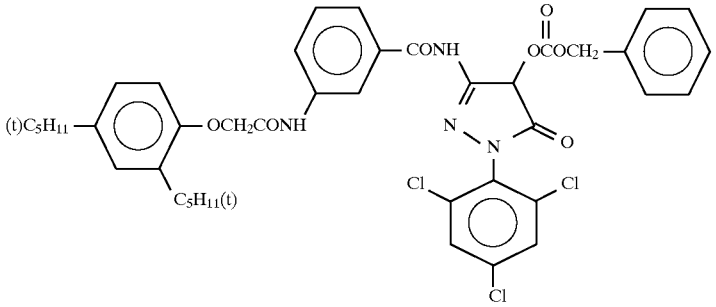
(m-17)
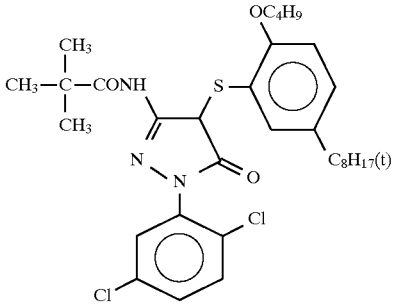

-continued
(m-18)
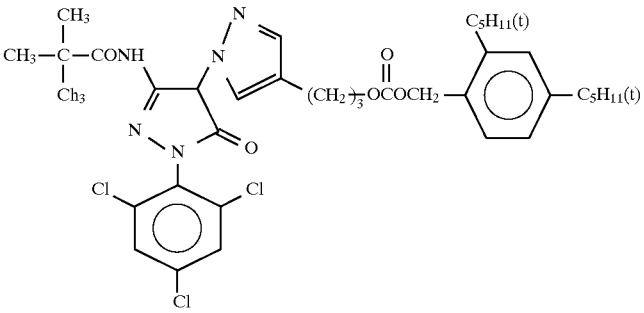
(m-19)
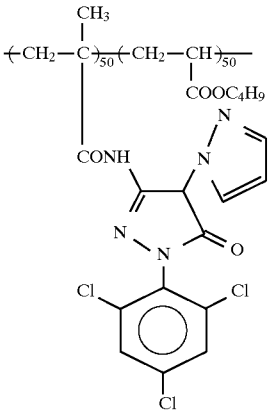
(by weight)
(m-20)
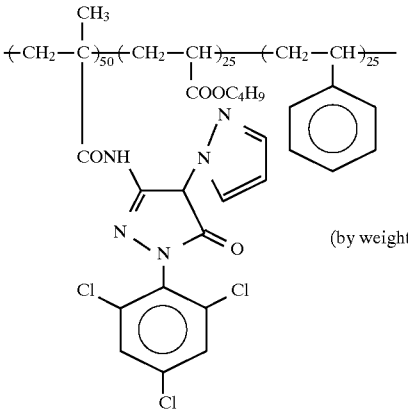
(by weight)
(m-21)
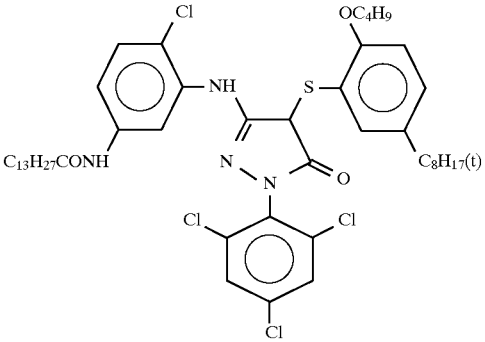

-continued
(m-22)
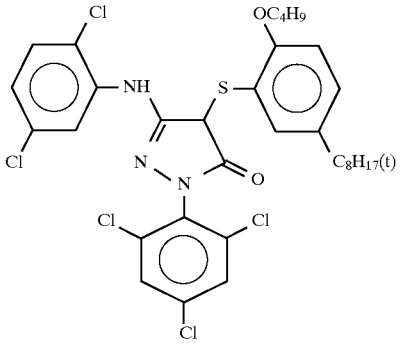
(m-23)
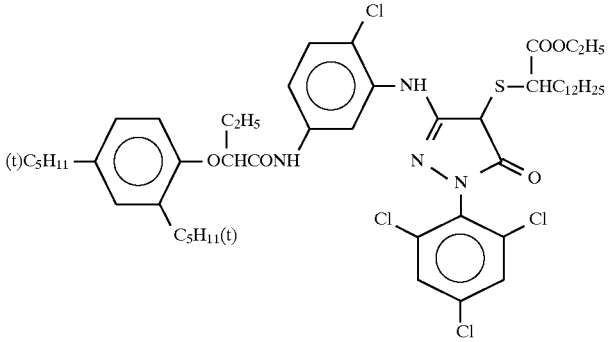
(m-24)
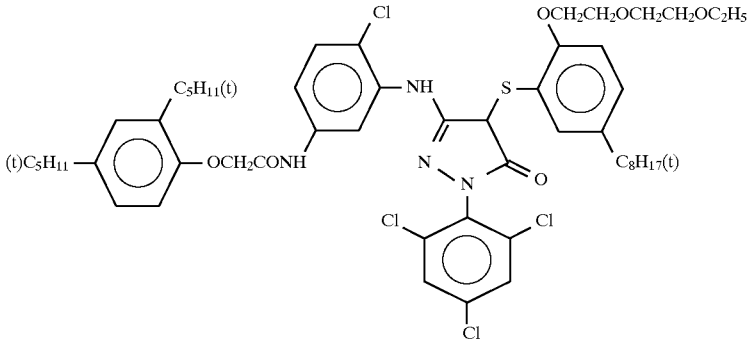
(m-25)
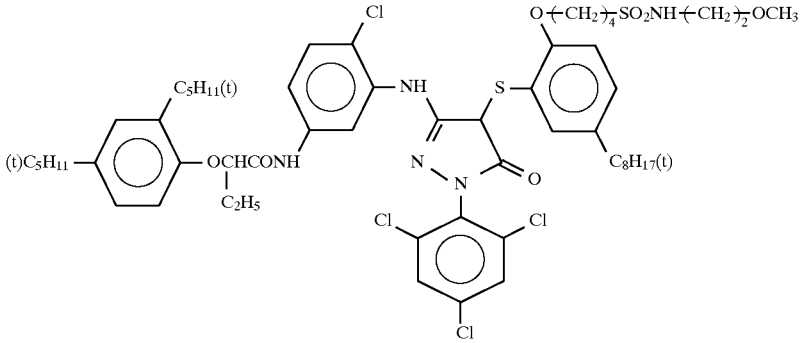

-continued
(m-26)
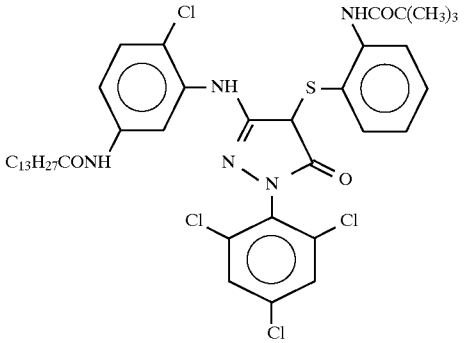
(m-27)
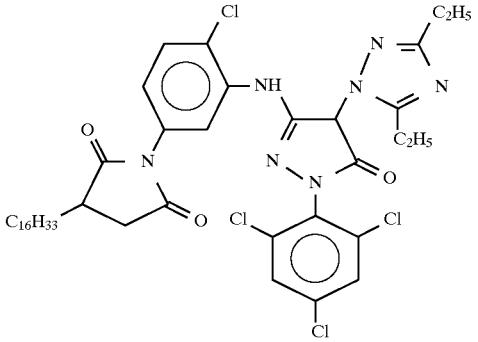
(m-28)
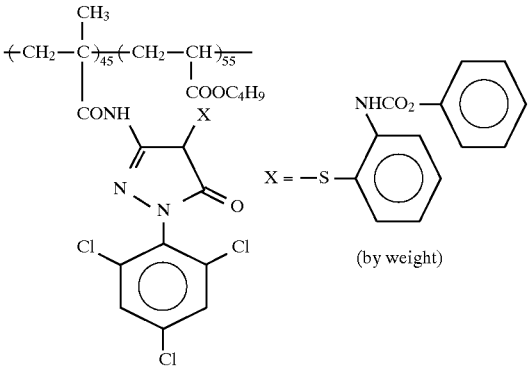
(m-29)
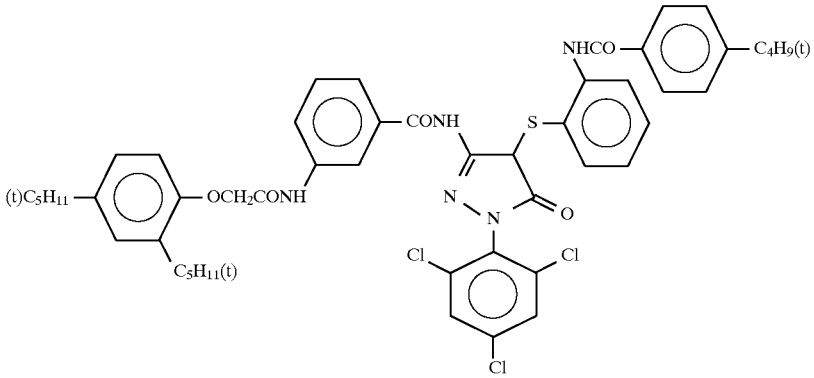

-continued
(m-30)
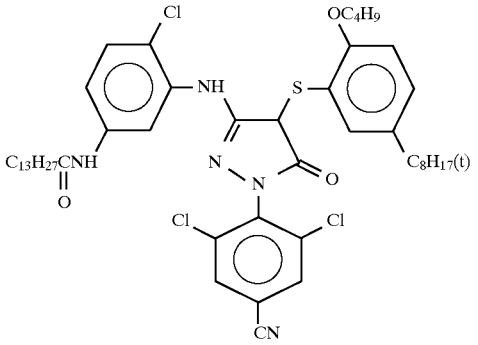
(m-31)
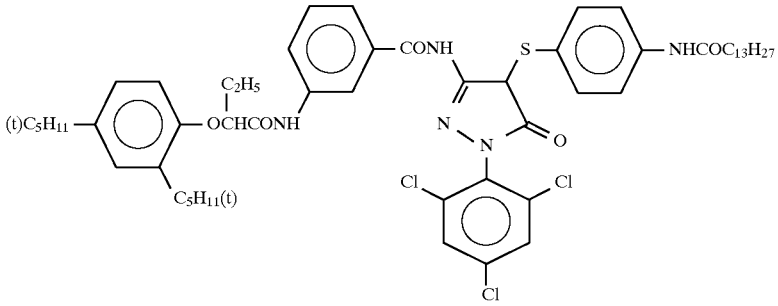
(m-32)
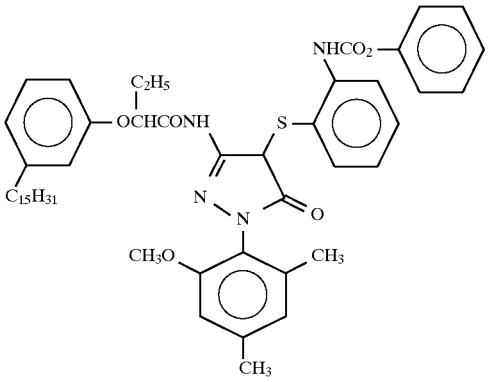
(m-33)
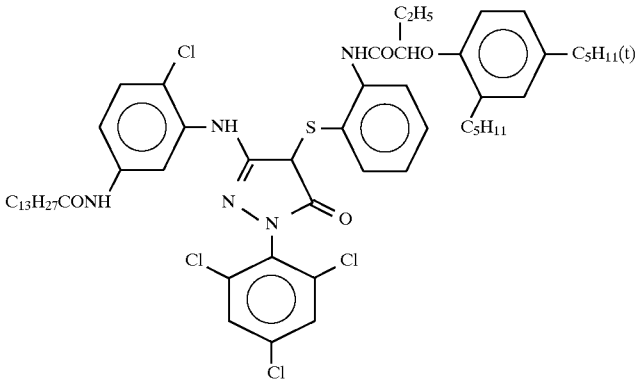

-continued
(m-34)
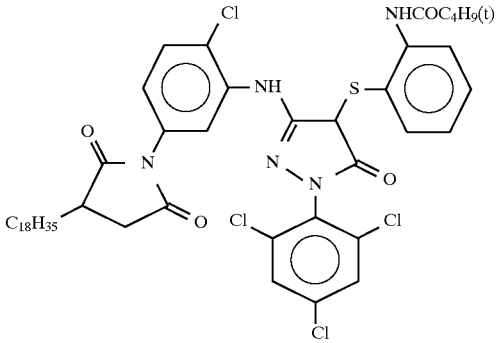
(m-35)
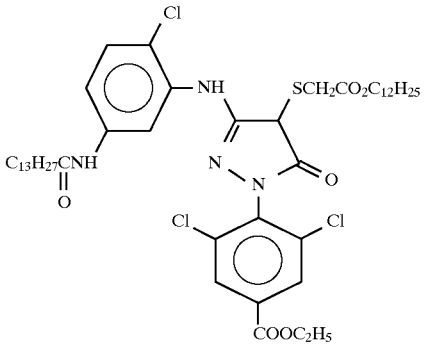
(m-36)
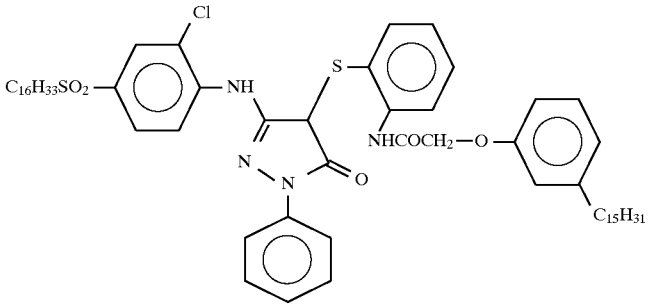
(m-37)
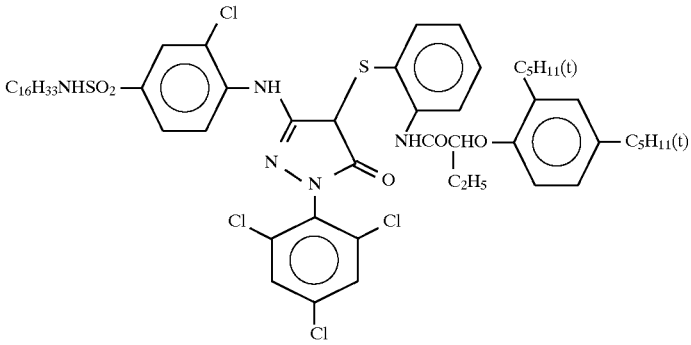

-continued

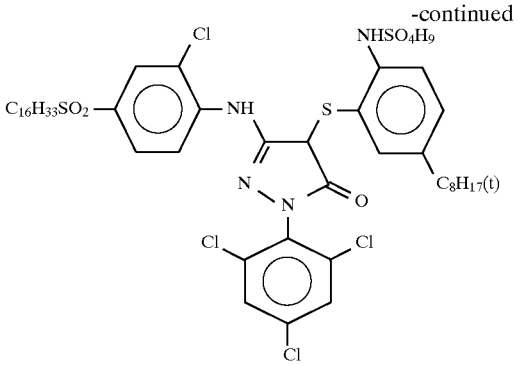

(m-38)

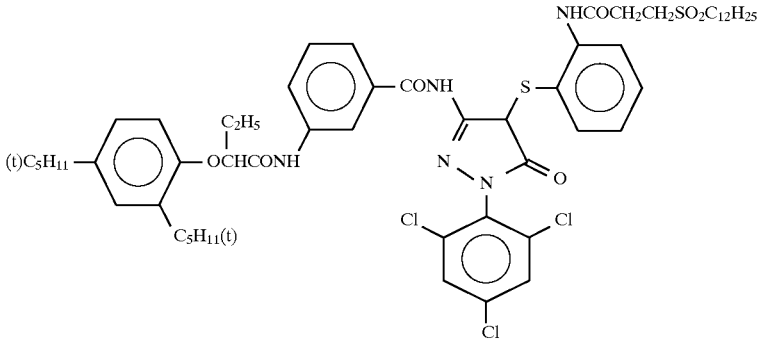

(m-39)

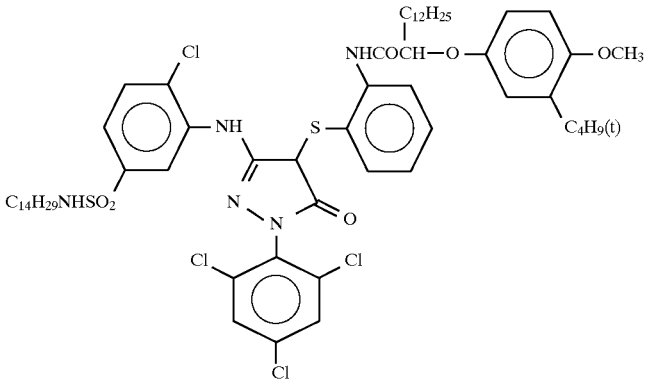

(m-40)

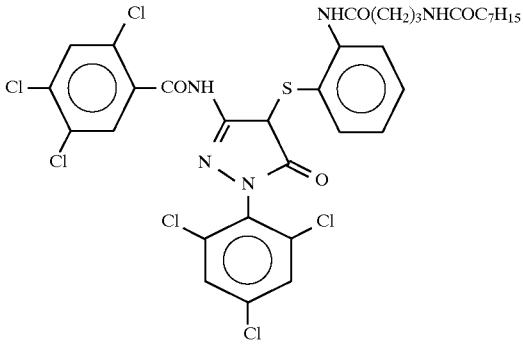

(m-41)

Among magenta couplers represented by formula (m), an arylthio-releasing type coupler and an azole-releasing type coupler as representative examples of the two-equivalent coupler each may be synthesized by the methods described in JP-A-57-35858 and JP-A-51-20826. Other magenta couplers represented by formula (m) may be synthesized according to the methods described in U.S. Pat. No. 3,519,429 and JP-B-53-33846.

The coupler represented by formula (m) of the present invention is added to a silver halide color photographic light-sensitive material in an amount of from $3\times10^{-5}$ to $3\times10^{-3}$ mol/m$^2$, preferably from $3\times10^{-4}$ to $2\times10^{-3}$ mol/m$^2$, more preferably from $5\times10^{-4}$ to $1.5\times10^{-3}$ mol/m$^2$.

When the coupler represented by formula (m) of the present invention is used in a plurality of layers, the same coupler may be used in a plurality of layers or different couplers may be used. Also, a plurality of couplers may be used in the same layer.

The coupler represented by formula (m) of the present invention may be used in combination with a magenta coupler out of the scope of the present invention, such as 1H-pyrazolo[1,5-b][1,2,4]triazole coupler or 1H-pyrazolo[5,1-c][1,2,4]triazole coupler.

By using the coupler represented by formula (m) of the present invention in combination with the compound represented by formula (A-I), (A-II) or (A-III) preferably in the same layer, reduction in the color density or pressure fogging can be prevented and thereby the object of the present invention can be achieved.

The magnetic recording layer for use in the present invention is described below.

The magnetic recording layer for use in the present invention can be provided by coating an aqueous or organic solvent-base coating solution containing a binder having dispersed therein magnetic particles, on a support.

The magnetic particle for use in the present invention includes ferromagnetic iron oxide (e.g., $\gamma Fe_2O_3$), Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-doped ferromagnetic iron oxide such as Co-doped $\gamma Fe_2O_3$ is preferred. The shape of the magnetic particle may be any of acicular, rice grain-like, spherical, cubic and platy forms. The specific surface area as SBET is preferably 20 $m^2/g$ or more, more preferably 30 $m^2/g$ or more. The saturation magnetization ($\sigma s$) of the ferromagnetic material is preferably from $3.0\times10^4$ to $3.0\times10^{-5}$ A/m, more preferably from $4\times10^4$ to $2.5\times10^5$ A/m. The ferromagnetic particle may be subjected to surface treatment with silica and/or alumina or an organic material. Further, the ferromagnetic particle may be subjected to surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture of these described in JP-A-4-219569. The above-described resin has a Tg of from −40° C. to 300° C. and a weight average molecular weight of from 2,000 to 1,000,000. Examples of the resin include a vinyl copolymer, a cellulose derivative such as cellulose diacetate, cellulose triacetate, cellulose acetate propionate, cellulose acetate butyrate and cellulose tripropionate, an acrylic resin and a polyvinyl acetal resin, and gelatin is also preferably used. Among these, cellulose diacetate or cellulose driacetate is preferred. The binder may be cured by adding thereto an epoxy-base, aziridine-base or isocyanate-base crosslinking agent. Examples of the isocyanate-base crosslinking agent include isocyanates such as tolylenediisocyanate, 4,4'-diphenylmethanediisocyanate, hexamethylenediisocyanate and xylylenediisocyanate, a reaction product of these isocyanates with polyalcohol (e.g., a reaction product of 3 mol of tolylenediisocyanate with 1 mol of trimethylolpropane) and a polyisocyanate produced by the condensation of these isocyanates, which are described, for example, in JP-A-6-59357.

The ferromagnetic material is dispersed into the binder by the method preferably using a kneader, a pin-type mill or an annular-type mill as described in JP-A-6-35092 and these may also be preferably used in combination. The dispersant described in JP-A-5-088283 and other known dipersants may be used. The thickness of the magnetic recording layer is from 0.1 to 10 $\mu$m, preferably from 0.2 to 5 $\mu$m, more preferably from 0.3 to 3 $\mu$m. The weight ratio of the magnetic particle to the binder is preferably from 0.5/100 to 60/100, more preferably from 1/100 to 30/100. The coating amount of magnetic particles is from 0.005 to 3 $g/m^2$, preferably from 0.01 to 2 $g/m^2$, more preferably from 0.02 to 0.5 $g/m^2$. The magnetic recording layer has a transmitted yellow density of preferably from 0.01 to 0.50, more preferably from 0.03 to 0.20, still more preferably from 0.04 to 0.15. The magnetic recording layer may be provided throughout the entire surface of or in the form of stripes on the back surface of the photographic support by coating or printing. The magnetic recording layer can be coated by using air doctor, blade, air knife, squeeze, soakage, reverse roller, transfer roller, gravure, kiss, cast, spray, dip, bar or extrusion, and the coating solution described in JP-A-5-341436 is preferred.

The magnetic recording layer may be designed to have additional functions such as improvement of lubricity, control of curl, electrostatic charge prevention, prevention of adhesion or head abrasion, or other functional layers may be provided to undertake these functions. At least one or more of particles is preferably an abrasive as an aspheric inorganic particle having a Mhos' hardness of 5 or more. The composition of the aspheric inorganic particle is preferably an oxide such as aluminum oxide, chromium oxide, silicon dioxide or titanium dioxide, a carbide such as silicon carbide or titanium carbide, or a fine particle of diamond. The abrasive may be subjected to surface treatment with a silane coupling agent or a titanium coupling agent. The particle may be added to a magnetic recording layer or may be overcoated on the magnetic recording layer (for example, as a protective layer or a lubricant layer). The binder used here may be one selected from those described above and it is preferably the same as the binder in the magnetic recording layer. The light-sensitive material having a magnetic recording layer is described in U.S. Pat. Nos. 5,336,589, 5,250,404, 5,229,259 and 5,215,874 and European Patent 466130.

In the light-sensitive material having the above-described recording layer, the degree of deterioration is further increased due to reduction in the color density and pressure fog which are caused when the light-sensitive material is lengthily wound up and stored at high temperature. However, when the compound represented by formula (A-I), (A-II) or (A-III) of the present invention and the coupler represented by formula (m) are used, the light-sensitive material is improved with respect to reduction in the color density and pressure fogging and thereby the object of the present invention can be achieved.

Figure 2:
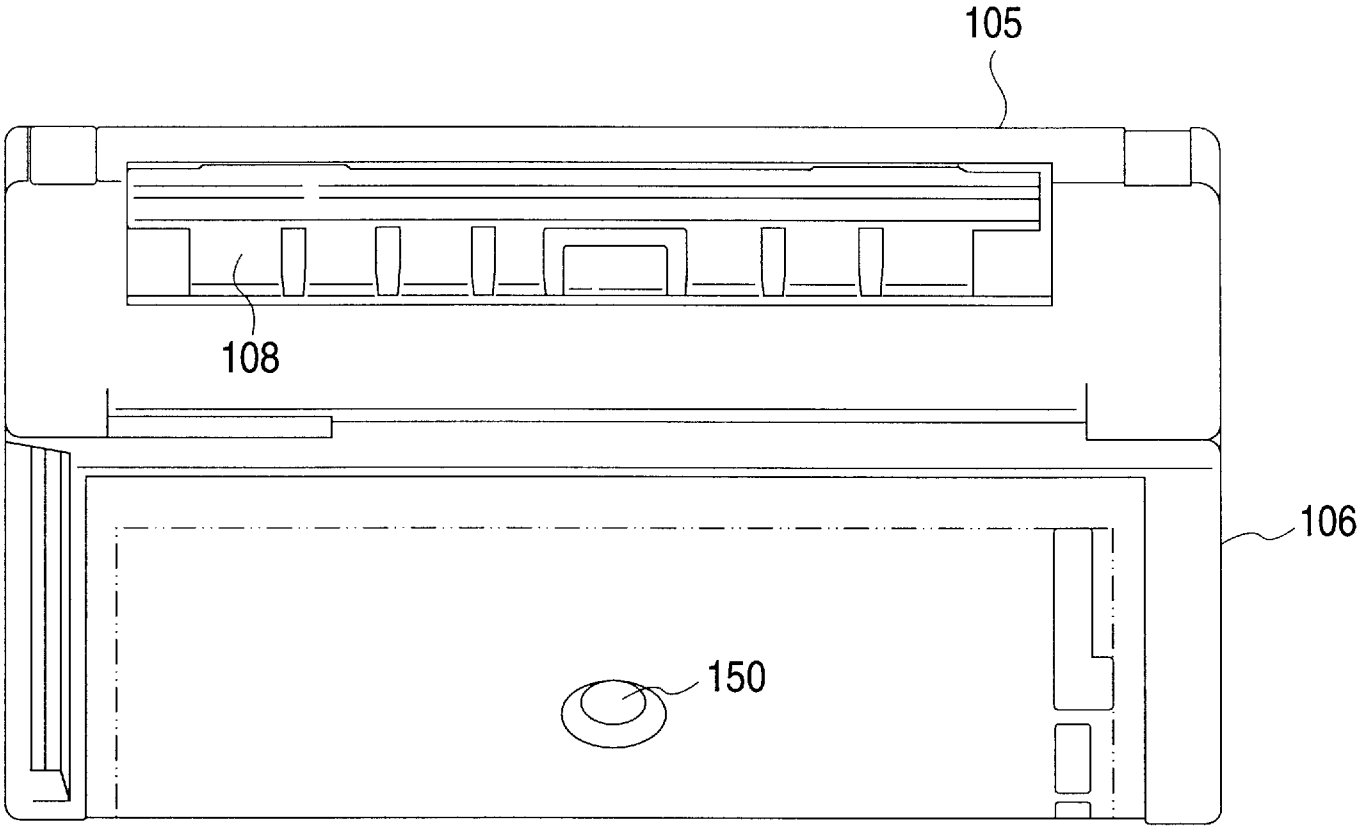
FIG. 2 is a view seen from the radius direction of the above-described package of a photographic light-sensitive material.
Figure 3:
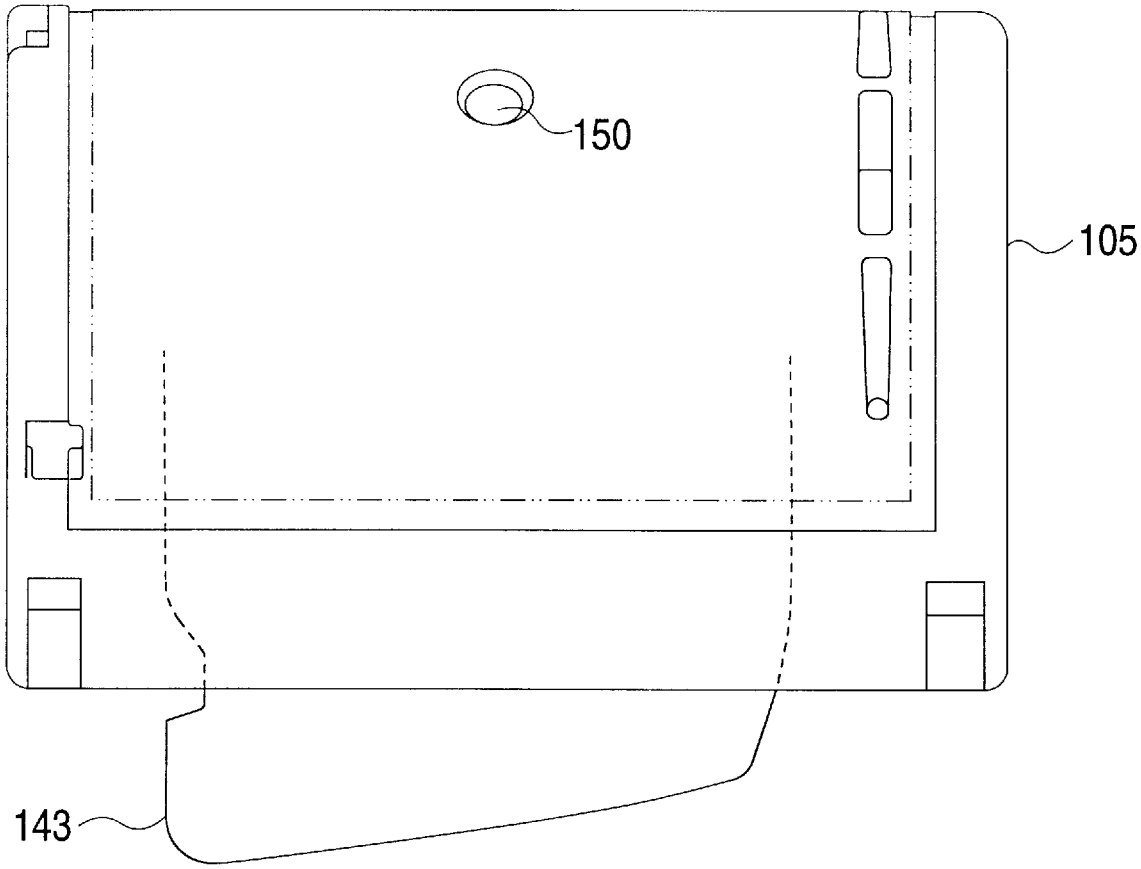
FIG. 3 is a view seen from the radius direction of the above-described package of a photographic light-sensitive material at the position different from that taken in FIG. 2.

A package 100 of the photographic light-sensitive material of the present invention (hereinafter sometimes referred to as a "photographic film patrone") is described below by referring to the attached drawings. FIG. 1 is an exploded perspective view of the photographic film patrone, FIG. 2 is a view seen from the radius direction of the photographic patrone, and FIG. 3 is a view seen from the radius direction at the position different from that taken in FIG. 2.

The photographic film patrone 100 comprises a patrone body 101 having rotatably housed in the inside thereof a spool 103 wound around with the photographic light-sensitive material (photographic film) 102 and a patrone label 104 is bonded to the outer periphery of the patrone body 101. The cartridge body (patrone body) 101 consists of two molded articles, namely, upper and lower cases 105 and 106.

Figure 5:
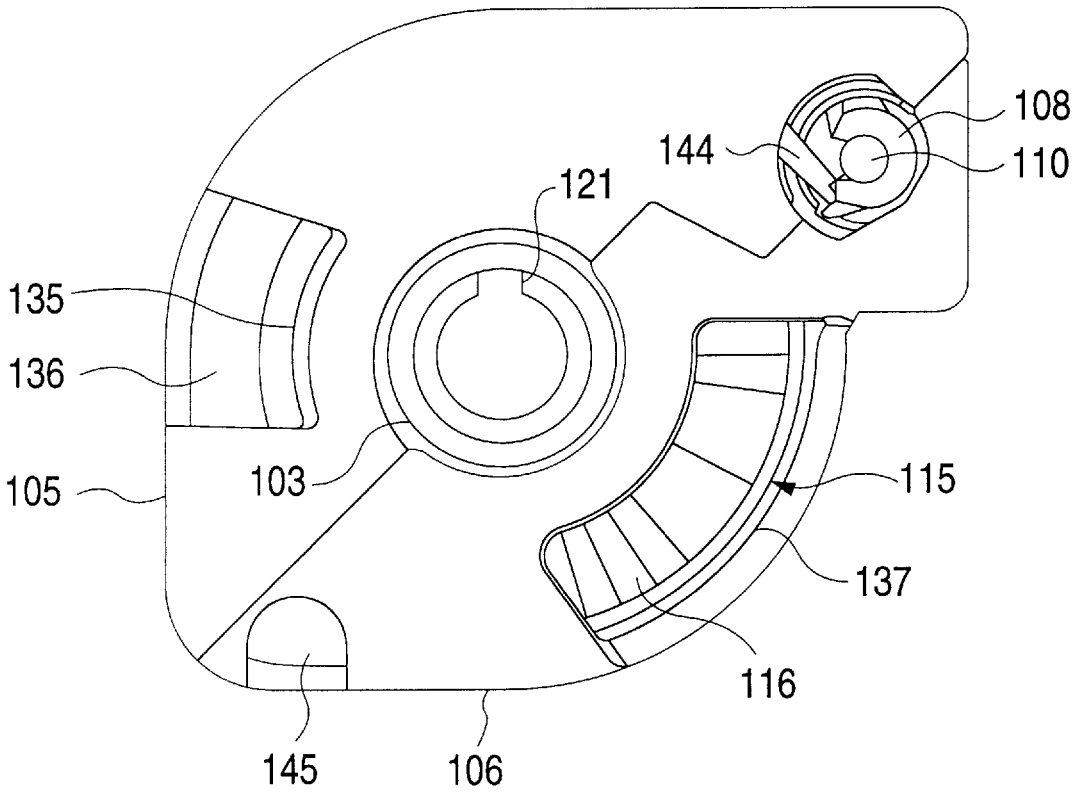
FIG. 5 is a view seen from another axial direction of the above-described package of a photographic light-sensitive material.

At the portion of connecting the upper case 105 having a gate 150 to the lower case 106 on the front surface side, a film delivery port 107 (passage) for delivering the photographic film 102 is formed. In the interior of the film delivery port, a lid member 108 for preventing enter of light from the port and a separation claw 109 for separating the leading end of the photographic film 102 disposed at the back of the lid member are provided. At both edges of the lid member 108, key grooves 110 and 111 are formed respectively and when the patrone is loaded in a camera, the lid member swingingly moves between the close position for shutting the film delivery port 107 and the open position for allowing the getting out of the photographic film in linking with rotational movement of the switch driving shaft on the camera side to be engaged with the key grooves 110 and 111. FIG. 5 shows a state where a lock pole 144 is engaged with the lid member 108 and the lid member is locked at the close position.

In the spool 103, a pair of flanges 113 and 114 with a lip are provided in the inside at both edge parts of the spool shaft 112 and a data disk is provided on the outer side of one flange 113. On the outer side of another flange 114, a use display member 123 is provided. A data label is attached to the data disk 115. A pair of flange fitting portions 117 and 118 for fitting in flanges 113 and 114, respectively, a slit 114 for anchoring the heel end of the photographic film and a supporting member 120 for supporting the use display member are integrally formed and when loaded in a camera, these rotatively move in linking with rotation of the driving shaft on the camera side engaged to the keyhole-shaped key grooves 121 and 122 provided at the both edge parts of the spool 103.

In the use display member 123, a bearing 124, two ratchet claws 125, a gear 126 and a use display board 127 are integrally formed and these rotate integrally with the spool shaft 112.

In the inside of the photographic film patrone 100, a spool lock 128 is housed so as to mesh with the gear 126. When the lid member 108 stays at the close position, the spool lock 128 is engaged with the gear 126 to lock rotation of the spool shaft 112 and thereby prevent careless delivery of the photographic 102. When the lid member 108 stays at the open position, the spool lock is released from engagement to the gear 126.

Figure 6:
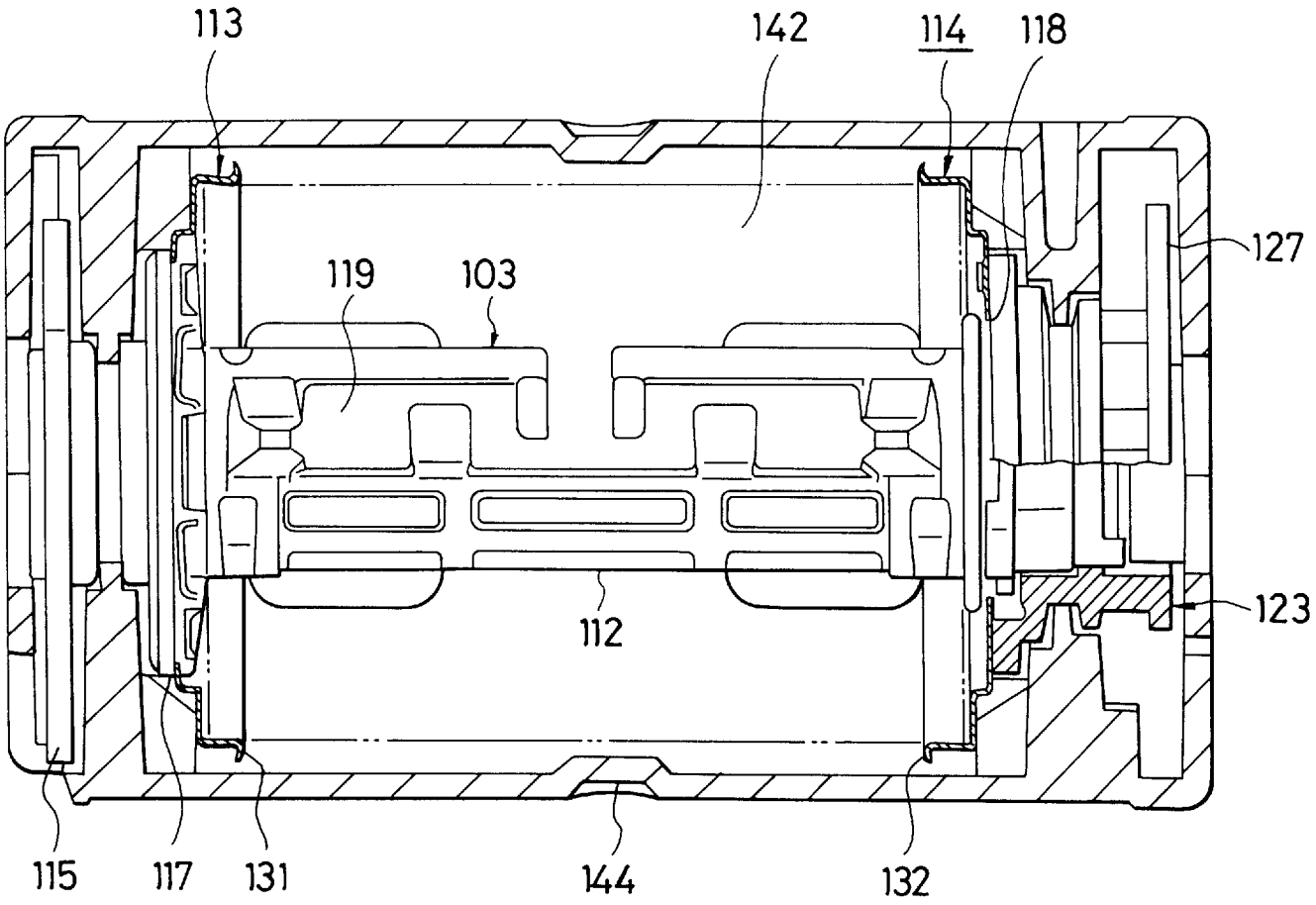
FIG. 6 is a cross section cut along the axial direction of the above-described package of a photographic light-sensitive material.

A pair of flanges 113 and 114 are formed of a plastic material and has a cross section in the thin-walled cup form. At the bottom portion of the cup, round holes 119 and 130 to be rotatably engaged with the flange fitting portions 117 and 118, respectively, are provided. The opening edge parts 131 and 132 of the cup are fixed to the spool shaft 112 to come to face with each other and both outermost peripheral edges of the photographic film 102 to be wound up are embraced therein (as shown in FIG. 6). Owing to these opening edge parts 131 and 132, rotation of the spool 103 can be transmitted to the outermost periphery of the photographic film 102 and also, loose winding of the film roll 142 is prevented.

In flange 114, four holes 133 are formed at a predetermined pitch to enclose the round hole 130. To these holes 133, ratchet claws 125 of the use display member 123 are engaged when the spool shaft 112 rotates toward the photographic film delivery direction. The ratchet claws 125 transmit rotation of the spool shaft 112 to the flange 114 when they are engaged to holes 133. When the spool shaft 112 rotates toward the photographic film take-up direction, the ratchet claws 125 of the use display member 123 get over the holes 133 and rotation of the spool shaft 112 is not transmitted to the flange 114.

In delivering the photographic film 102, the spool 103 is rotated toward the film delivery direction. When the spool 103 is rotated toward the film delivery direction, the leading end of the photographic film 102 is put into contact with the separation claw 109 and separated from the rolled part inside the photographic film leading end. Along subsequent rotation of the spool 103, a pair of flanges 113 and 114 small in the thickness each is shifted outward by the film leading end separated because they have elasticity. As a result, the leading end (143 in FIG. 3) of the photographic film is released from the embracement by a pair of flanges 113 and 114 and delivered outside the photographic film patrone 100 through the film delivery port. When the spool shaft 112 rotates toward the photographic film take-up direction (reverse direction to the photographic film delivery direction), flanges 113 and 114 do not rotate integrally with the spool shaft 112. Accordingly, when the photographic film 102 is wound up, the flanges 113 and 114 do not rotate and slide is generated between the opening edge parts 131, 132 and the photographic film 102. As a result, the photographic film 102 slides beneath the opening edge parts 131, 132 and the photographic film is wound up.

The data disk 115 comprises a large-diameter fan portion 134 and a notch portion 135. A bar code label 116 has a shape analogous to the data disk 115 and is attached to the data disk.

On the bar code label 116, a bar code is printed to give various information, for example, the kind of the photographic film 102 to be housed. Along rotation of the spool 103 toward the film delivery direction, the above-described information is read by a reading sensor provided on the camera side through the opening 136 formed on one side surface of the upper case 105 as shown in FIG. 5 and used for calculating the exposure value or counting the exposed frame number of the photographic film housed in the patrone.

The photographic film 102 including the leading end is wholly housed in the photographic film patrone 100 and therefore, it cannot be distinguished from the appearance whether the photographic film housed therein is unexposed or exposed. In order to prevent an accident such that the photographic film patrone 100 housing an exposed photographic film is again loaded in a camera and used for photographing, an opening 137 for preventing re-loading is formed on one side surface of the lower case 106. The patrone is inserted into the patrone chamber of a camera from this side surface and a lever to enter the opening 137 is provided in the patrone chamber.

In the photographic film patrone 100, the stop position of the large-diameter fan portion 134 is controlled by the driving shaft in the camera side such that when an exposed photographic film is housed, the large-diameter fan portion 134 appears in the opening 137 and when an unexposed photographic film is housed, the large-diameter fan portion 134 does not appear in the opening 137. Accordingly, in the camera side, whether the photographic film housed is exposed or unexposed can be distinguished by detecting the movement amount of the lever.

Figure 4:
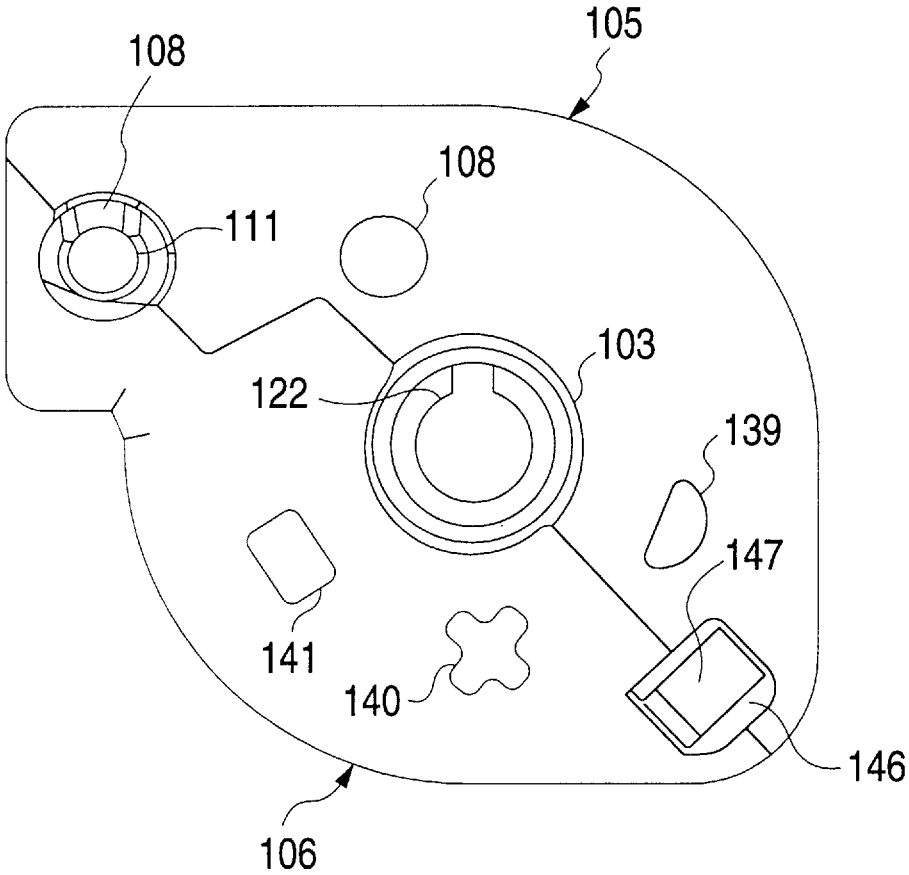
FIG. 4 is a view seen from one axial direction of the above-described package of a photographic light-sensitive material.

Further, in order to facilitate distinction from the appearance by users, in the photographic film patrone 100, as shown in FIG. 4, a use state display opening 138 for use in housing an unexposed photographic film, a use state display opening 139 for use in housing a partly photographed film, a use state display opening 140 for use in housing a entirely photographed and exposed photographic film, and a use state display opening 141 for use in housing a developed photographic film are formed on another side surface (the side surface opposite to the side surface where the openings 136 and 137) are provided. The use display board 127 positioned in the interior is forced to come appear in any one of the above-described four use state display openings 138 to 141 by controlling the stop position of the spool 103, thereby displaying the use state of the photographic film.

In the patrone 100 of the present invention, a sensitivity detecting notch 145 for detecting sensitivity of the photographic film 102 housed therein is provided. The notch detects sensitivity in a cheap camera having no bar code reader for reading the bar code written on the bar code label. When the sensitivity detecting notch 145 is provided as shown in FIG. 5, the photographic film housed has an ISO sensitivity of 400 or more, and when the notch is not provided, it reveals that the ISO sensitivity is 400 or less.

Further, in the patrone 100 of the present invention, a development ending display tab for indicating whether the photographic film 102 housed is developed or not is provided. As shown in FIG. 4, the tab 147 is provided within the opening 146 provided on one side surface of the patrone 100 and when the tab 147 is turned and removed, it reveals that the photographic film 102 housed is developed.

A representative example of the production method of the patrone 100 of the present invention is described more specifically below. The upper and lower cases 105 and 106, the spool 105 and the lid member 108 are formed by an injection molding method using a resin obtained by kneading into a high impact polystyrene resin (Denka Styrol HI—R—Q, produced by Denki Kagaku Kogyo K.K.) 1.0 wt % of carbon black (Mitsubishi Carbon Black #950, produced by Mitsubishi Chemical K.K.) for imparting a light-shielding property and 1.5 wt % of a silicone oil (Shin-Etsu Silicone KF96H, produced by Shin-Etsu Chemical K.K.; viscosity: 30,000 cs) for imparting lubricity.

The use display member 123 is formed by an injection molding method using a resin obtained by kneading into the above-described high impact polystyrene resin 0.01 wt % of the above-described carbon black and 3.5 wt % of titanium dioxide (CR60-2, produced by Ishihara Sangyo Kaisha, Ltd.).

The flanges 113 and 114 are molded by a vacuum/pressure formation method using a 150 μm-thick film formed from a polymer alloy (Zylon X9101, produced by Asahi Chemical Industry Co., Ltd.) of a polystyrene resin and a polyphenylene ether resin.

Figure 7:
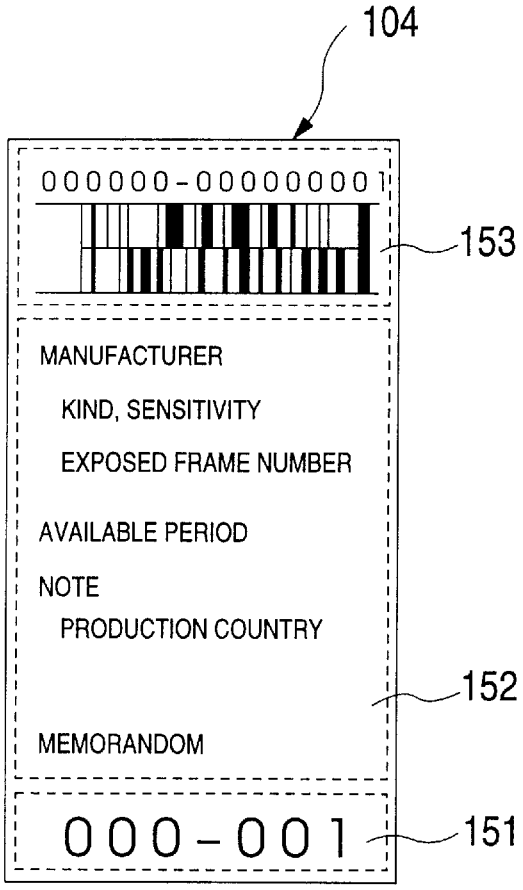
FIG. 7 is a view showing an adhesive label sheet with release paper.

The patrone label 104 is produced as follows. One surface of a 50 μm-thick white pigment-containing polystyrene film is subjected to coating for imparting printing adaptability. A pressure-sensitive adhesive is provided on the back surface of the film and a release paper was bonded thereto to prepare an adhesive label sheet with a release paper. The front surface of the sheet has, as shown in FIG. 7, a printing space 151 for printing the patrone ID number (identification number) written in numerals, a form printing space 152 for printing the kind, sensitivity and exposed frame number of the film, the instructions and the blank for notes to be taken by users, and a bar code printing space 153. A form printing space is first printed, a half-cut processing follows, and then the bar code and the patrone ID number are printed. The bar code includes the name of manufacturer, the production lot, the production date, the kind, sensitivity and exposure frame number of the photographic film housed, and the patrone ID number, which all are coded and printed. The cartridge ID number is a particular number each cartridge has.

The bar code label 116 is produced as follows. On one surface of a 50 μm-thick transparent polystyrene film, an aluminum-deposited layer having a thickness of about 400 Å is provided, a pressure-sensitive adhesive agent is applied thereon and a release paper is attached thereto to prepare an adhesive label with a release paper. A bar code is printed on the surface opposite to the aluminum-deposited layer, the outer peripheral portion is subjected to half-cut processing and the center part is punched.

The photographic light-sensitive material of the present invention is housed in the package as described above with respect to the structure and production method thereof. The object of the present invention can be achieved by the photographic light-sensitive material housed in such a package.

The light-sensitive material of the present invention may suffice if it has at least one light-sensitive silver halide emulsion layer (hereinafter sometimes referred to as a light-sensitive layer) on the support. A typical example thereof is a silver halide photographic light-sensitive material comprising a support having thereon at least one light-sensitive layer consisting of a plurality of silver halide emulsion layers having substantially the same spectral sensitivity but different in the light sensitivity. The light-sensitive layer is a unit light-sensitive layer having spectral sensitivity to any of blue light, green light and red light. In the case of a multi-layer silver halide color photographic light-sensitive material, the arrangement of unit light-sensitive layers are generally such that a red-sensitive layer, a green-sensitive layer and a blue-sensitive layer are provided in this order from the support side. However, depending upon the purpose, the above arrangement order may be reversed or a layer different in the light sensitivity may be superposed between layers having the same spectral sensitivity. A light-insensitive layer may be provided between the above-described silver halide light-sensitive layers, as an uppermost layer or as the lowermost layer. These layers may contain a coupler, a DIR compound or a color mixing inhibitor which will be described later. The silver halide emulsion layers in plurality constituting each unit light-sensitive layer are preferably arranged such that two layers of a high-sensitivity emulsion layer and a low-sensitivity emulsion layer are provided so that the light sensitivity can be lowered in sequence towards the support as described in German Patent 1,121,470 and British Patent 923,045. Further, it is also possible to provide a low-sensitivity emulsion layer farther from the support and a high-sensitivity emulsion layer nearer to the support as described in JP-A-57-112751, JP-A-62-200350, JP-A-62-206541 and JP-A-62-206543.

Specific examples of the layer arrangement include an order, from the farthest side to the support, of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH.

Also, as described in JP-B-55-34932, a blue-sensitive layer/GH/RH/GL/RL may be arranged in this order from the farthest side to the support. Further, as described in JP-A-56-25738 and JP-A-62-63936, a blue-sensitive layer/GL/RL/GH/RH may be arranged in this order from the farthest side to the support.

An arrangement consisting of three layers different in the light sensitivity may be used as described in JP-B-49-15495 where a silver halide emulsion layer having the highest light sensitivity is provided as an upper layer, a silver halide emulsion layer having a light sensitivity lower than that of the upper layer is provided as a medium layer and a silver halide emulsion layer having a light sensitivity lower than that of the medium layer is provided as a lower layer so that the light sensitivity can be lowered in sequence towards the support. Even in the case of arrangement constituted by these three layers different in the light sensitivity, as described in JP-A-59-202464, a medium-sensitivity emulsion layer/a high-sensitivity emulsion layer/a low-sensitivity emulsion layer may be provided in this order from the farthest side to the support in the layer having the same spectral sensitivity.

In addition, an order of a high-sensitivity emulsion layer/a low-sensitivity emulsion layer/a medium-sensitivity emulsion layer or an order of a low-sensitivity emulsion layer/a medium-sensitivity emulsion layer/a high-sensitivity emulsion layer may also be used. In the case of four or more layer structure, the layer arrangement may also be changed as described above.

In order to improve color reproducibility, a donor layer (CL) having a spectral sensitivity distribution different from that of main light-sensitive layers such as BL, GL and RL and capable of providing an interlayer effect, is preferably provided adjacent to or in the vicinity of a main light-sensitive layer as described in U.S. Pat. Nos. 4,663,271, 4,705,744 and 4,707,436, JP-A-62-160448 and JP-A-63-89850.

The silver halide for use in the present invention is preferably silver iodobromide, silver iodochloride or silver iodochlorobromide having a silver iodide content of about 30 mol % or less, more preferably silver iodobromide or silver iodochlorobromide having a silver iodide content of from about 2 to about 10 mol %.

The silver halide grain in the photographic emulsion may have a regular crystal form such as cubic, octahedral or tetradecahedral, an irregular crystal form such as spherical or platy, a crystal defect such as twin, or a composite form of these.

The silver halide may be a fine grain having a grain size of about 0.2 μm or less or a large-sized grain having a grain size in terms of a projected area diameter up to about 10 μm, and either a polydisperse emulsion or a monodisperse emulsion may be used.

The silver halide photographic emulsion which can be used in the present invention can be prepared according to the methods described, for example, in *Research Disclosure* (hereinafter referred to as "RD") No. 17643, pp. 22–23 "I. Emulsion Preparation and Types" (December, 1978), ibid., No. 18716, p. 648 (November, 1979), ibid., No. 307105, pp. 863–865 (November, 1989), P. Glafkides, *Chemie et Phisique Photographique*, Paul Montel (1967), G. F. Duffin, *Photographic Emulsion Chemistry*, the Focal Press (1966), and V. L. Zelikman et al., *Making and Coating Photographic Emulsion*, the Focal Press (1964).

The monodisperse emulsions described in U.S. Pat. Nos. 3,574,628 and 3,655,394 and British Patent 1,413,748 are also preferably used.

Furthermore, tabular grains having an aspect ratio of about 3 or more can be used in the present invention. The tabular grain can be easily prepared by the methods described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The crystal structure may be homogeneous, may comprise a halogen composition different between the interior and the exterior or may be stratified. A silver halide having a different composition may be conjugated by an epitaxial junction or the silver halide may be conjugated with a compound other than silver halide, such as silver rhodanate or lead oxide. Also, a mixture of grains having various crystal forms may be used.

The above-described emulsion may be a surface latent image-type emulsion forming a latent image mainly on the surface, an internal latent image-type emulsion forming a latent image inside the grain, or an emulsion of a type forming a latent image both on the surface of and inside the grain, however, the emulsion needs be a negative type emulsion. As one of internal latent image-type emulsions, a core/shell internal latent image-type emulsion described in JP-A-63-264740 may also be used and the preparation method of this emulsion is described in JP-A-59-133542. In this emulsion, the thickness of the shell varies depending upon the development process and the like, but it is preferably from 3 to 40 nm, more preferably from 5 to 20 nm.

The silver halide emulsion is usually subjected to physical ripening, chemical ripening and spectral sensitization before use. The additives used in these steps are described in RD No. 17643, RD No. 18716 and RD No. 307105 and the pertinent portions thereof are summarized in the table set forth later.

The light-sensitive material of the present invention may use a mixture of two or more kinds of emulsions different at least in one property of the light-sensitive silver halide emulsion, such as the grain size, the grain size distribution, the halogen composition, the grain shape or the sensitivity, in the same layer.

It is preferred to apply a silver halide grain of which surface is fogged described in U.S. Pat. No. 4,082,553, a silver halide grain of which inside is fogged described in U.S. Pat. No. 4,626,498 and JP-A-59-214852 or a colloidal silver to a light-sensitive silver halide emulsion layer and/or a substantially light-insensitive hydrophilic colloid layer. The term "silver halide grain of which inside or surface is fogged" as used herein means a silver halide grain which can achieve uniform (non-imagewise) development of a photographic material irrespective of an unexposed area or an exposed area. The preparation method of such a grain is described in U.S. Pat. No. 4,626,498 and JP-A-59-214852. The silver halide forming the inside nucleus of a core/shell type silver halide grain of which inside is fogged may have a different halogen composition. The silver halide for the grain of which inside or surface is fogged may be any of silver chloride, silver bromide, silver iodobromide and silver chloroiodobromide. The fogged silver halide grain has an average grain size of preferably from 0.01 to 0.75 μm, more preferably from 0.05 to 0.6 μm. The grain may have a regular form and a polydisperse emulsion may be used, but a monodisperse emulsion (an emulsion in which at least 95% by weight or by number of silver halide grains have a grain size within an average grain size ±40%) is preferred.

In the present invention, a light-insensitive fine grain silver halide is preferably used. The term "light-insensitive fine grain silver halide" as used herein means a silver halide fine grain which is not sensitive to light at the imagewise exposure for obtaining a dye image and substantially not developed at the development process. The light-insensitive fine grain silver halide is preferably not fogged previously. The fine grain silver halide has a silver bromide content of from 0 to 100 mol % and may contain, if desired, silver chloride and/or silver iodide. It preferably contains from 0.5 to 10 mol % of silver iodide. The fine grain silver halide has an average grain size (an average of circle-corresponding diameters of the projected area) of preferably from 0.01 to 0.5 μm, more preferably from 0.02 to 0.2 μm.

The fine grain silver halide can be prepared by the same method as that for the normal light-sensitive silver halide.

The surface of the silver halide grain needs not be optically sensitized or spectrally is preferred to add it is preferred to add a known stabilizer such as a triazole-base compound, an azaindene-base compound, a benzothiazolium-base compound, a mercapto-base compound or a zinc compound, to the fine grain silver halide in advance of the addition to a coating solution. A layer containing the fine grain silver halide grain may contain colloidal silver.

The photographic material of the present invention has a coated silver amount of preferably 6.0 g/m$^2$ or less, most preferably 4.5 g/m$^2$ or less.

The photographic additives which can be used in the present invention are also described in *RD* and the portions having pertinent description are shown in the table below.

| Kinds of Additives | RD17643 | RD18716 | RD307105 |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.-p. 649, right col. | pp. 866–868 |
| 4. Whitening agent | p. 24 | p. 647, right col. | p. 868 |
| 5. Light absorbent, filter dye, UV absorbent | pp. 25–26 | p. 649, right col.-p. 650, left col. | p. 873 |
| 6. Binder | p. 26 | p. 651, left col. | pp. 873–874 |
| 7. Plasticizer, lubricant | p. 27 | p. 650, right col. | p. 876 |
| 8. Coating aid, surface active agent | pp. 26–27 | p. 650, right col. | pp. 875–876 |
| 9. Antistatic agent | p. 27 | p. 650, right col. | pp. 876-877 |
| 10. Matting agent | | | pp. 878–879 |

Various dye-forming couplers can be used in the light-sensitive material of the present invention and the following couplers are particularly preferred.

Yellow Coupler

Couplers represented by formulae (I) and (II) of EPA 502424A; couplers represented by formulae (1) and (2) (particularly, Y-28 at page 18) of EP 513496A; couplers represented by formula (I) in claim 1 of EP 568037A; couplers represented by formula (I) in column 1, lines 45 to 55 of U.S. Pat. No. 5,066,576; couplers represented by formula (I) in paragraph 0008 of JP-A-4-274425; couplers (particularly, D-35 at page 18) described in claim 1 at page 40 of EP 498381A1; couplers represented by formula (Y) at page 4 (particularly, Y-1 (page 17) and Y-54 (page 41)) of EP 447969A1; couplers represented by formulae (II) to (IV) in column 7, lines 36 to 58 (particularly, II-17, II-19 (column 17) and II-24 (column 19)) of U.S. Pat. No. 4,476,219.

Cyan Coupler

CX-1, CX-3, CX-4, CX-5, CX-11, CX-12, CX-14 and CX-15 (pages 14 to 16) of JP-A-4-204843; C-7, C-10 (page 35), C-34, C-35 (page 37), (I-1) and (I-17) (pages 42 and 43) of JP-A-4-43345; couplers represented by formulae (Ia) and (Ib) in claim 1 of JP-A-6-67385.

Polymer Coupler

P-1 and P-5 (page 11) of JP-A-2-44345.

As the coupler which provides a colored dye having an appropriate diffusibility, those described in U.S. Pat. No. 4,366,237, British Patent 2,125,570, EP 96873B and German Patent 3,234,533 are preferred.

As the coupler for correcting unnecessary absorption of a colored dye, yellow colored cyan couplers represented by formula (CI), (CII), (CIII) or (CIV) described at page 5 of EP 456257A1 (particularly, YC-86 at page 84); Yellow Colored Magenta Couplers ExM-7 (page 202), EX-1(page 249) and EX-7 (page 251) described in EP 456257A1; Magenta Colored Cyan Couplers CC-9 (column 8) and CC-13 (column 10) described in U.S. Pat. No. 4,833,069; and colorless masking couplers represented by formula (2) (column 8) of U.S. Pat. No. 4,837,136 and formula (A) in claim 1 of WO92/11575 (particularly, compounds described in pages 36 to 45) are preferred.

Compounds (including couplers) which release a photographically useful compound residue upon reaction with an oxidation product of a developing agent are described below.

Development Inhibitor-Releasing Compound

Compounds represented by formulae (I), (II), (III) and (IV) described at page 11 of EP 378236A1 (particularly, T-101 (page 30), T-104 (page 31), T-113 (page 36 ), T-131 (page 45), T-144 (page 51) and T-158 (page 58)); compounds represented by formula (I) described at page 7 of EP 436938A2 (particularly, D-49 (page 51)); compounds represented by formula (1) of EP 568037A (particularly, (23) (page 11); and compounds represented by formulae (I), (II) and (III) described at pages 5 and 6 of EP 440195A2 (particularly, I-(1) at page 29);

Bleaching Accelerator-Releasing Compound

Compounds represented by formulae (I) and (I') at page 5 of EP 310125A2 (particularly (60) and (61) at page 61); and compounds represented by formula (I) in claim 1 of JP-A-6-59411 (particularly, (7) (page 7);

Ligand-Releasing Compound

Compounds represented by LIG-X described in claim 1 of U.S. Pat. No. 4,555,478 (particularly, compounds in column 12, lines 21 to 41);

Leuco Dye-Releasing Compound

Compounds 1 to 6 in columns 3 to 8 of U.S. Pat. No. 4,749,641;

Fluorescent Dye-Releasing Compound

Compounds represented by COUP-DYE in claim 1 of U.S. Pat. No. 4,774,181 (particularly, compounds 1 to 11 in columns 7 to 10);

Development Accelerator- or Fogging Agent-Releasing Compound

Compounds represented by formulae (1), (2) and (3) in column 3 of U.S. Pat. No. 4,656,123 (particularly (I-22) in column 25) and ExZK-2 at page 75, lines 36 to 38 of EP 450637A2;

Compound Which Releases Group Capable of Becoming Dye When Released

Compounds represented by formula (I) in claim 1 of U.S. Pat. No. 4,857,447 (particularly, Y-1 to Y-19 in columns 25 to 36).

Preferred additives other than couplers are described below.

Dispersion Medium of Oil-Soluble Organic Compound

P-3, P-5, P-16, P-19, P-25, P-30, P-42, P-49, P-54, P-55, P-66, P-81, P-85, P-86 and P-93 of JP-A-62-215272 (pages 140 to 144);

Latex for Impregnation of Oil-Soluble Organic Compound

Latexes described in U.S. Pat. No. 4,199,363;

Developing Agent Oxidation Product Scavenger

Compounds represented by formula (I) in column 2, lines 54 to 62 of U.S. Pat. No. 4,978,606 (particularly, I-(1), I-(2), I-(6) and I-(12) (columns 4 to 5)) and compounds represented by the formulae in column 2, lines 5 to 10 of U.S. Pat. No. 4,923,787 (particularly, Compound 1 (column 3));

Stain Inhibitor

Compounds represented by formulae (I) to (III) at page 4, lines 30 to 33 of EP 298321A1 (particularly, I-47, I-72, III-1 and III-27 (pages 24 to 48));

Discoloration Inhibitor

A-6, A-7, A-20, A-21, A-23, A-24, A-25, A-26, A-30, A-37, A-40, A-42, A-48, A-63, A-90, A-92, A-94 and A-164 (pages 69 to 118) of EP 298321A, II-1to III-23 in columns 25 to 38 of U.S. Pat. No. 5,122,444 (particularly, III-10), I-1 to III-4 at pages 8 to 12 of EP 471347A (particularly, II-2) and A-1 to A-48 in columns 32 to 40 of U.S. Pat. No. 5,139,931 (particularly, A-39 and A-42);

Material Which Reduces Use Amount of Coloration Reinforcing Agent or Color Mixing Inhibitor I-1 to II-15 at pages 5 to 24 of EP 411324A (particularly, I-46);

Formalin Scavenger

SCV-1 to SCV-28 at pages 24 to 29 of EP 477932A (particularly SCV-8);

Hardening Agent

H-1, H-4, H-6, H-8 and H-14 at page 17 of JP-A-1-214845, compounds (H-1to H-54) represented by formulae (VII) to (XII) in columns 13 to 23 of U.S. Pat. No. 4,618,573, Compounds (H-1 to H-76) represented by formula (6) at page 8, right lower column of JP-A-2-214852 (particularly, H-14) and compounds described in claim 1 of U.S. Pat. No. 3,325,287;

Development Inhibitor Precursor

P-24, P-37 and P-39 of JP-A-62-168139 (pages 6 to 7) and compounds described in claim 1 of U.S. Pat. No. 5,019,492 (particularly, 28 and 29 in column 7);

Antiseptic and Antimold

I-1 to III-43 in columns 3 to 15 of U.S. Pat. No. 4,923,790 (particularly, II-1, II-9, II-10, II-18 and III-25);

Stabilizer and Antifoggant

I-1 to I-(14) in columns 6 to 16 of U.S. Pat. No. 4,923,793 (particularly, I-1, I-60, I-(2) and I-(13)) and compounds 1 to 65 in columns 25 to 32 of U.S. Pat. No. 4,952,483 (particularly, 36);

Chemical Sensitizer triphenylphosphine, selenide and compound 50 of JP-A-5-40324;

Dye a-1 to b-20 at pages 15 to 18 (particularly, a-1, a-12, a-18, a-27, a-35, a-36 and b-5) and V-1 to V-23 at pages 27 to 29 (particularly, V-1) of JP-A-3-156450, F-I-1 to F-II-43 at pages 33 to 55 of EP 445627A (particularly, F-I-11 and F-II-8), III-1 to III-36 at pages 17 to 28 (particularly, III-1 and III-3) of EP 457153A, fine crystal dispersion products of Dye-1 to Dye-124 at pages 8 to 26 of W088/04794, compounds 1 to 22 at pages 6 to 11 of EP 319999A (particularly, Compound 1), compounds D-1 to D-87 (pages 3 to 28) represented by formulae (1) to (3) of EP 519306A, compounds 1 to 22 (columns 3 to 10) represented by formula (I) of U.S. Pat. No. 4,268,622 and compounds (1) to (31) (columns 2 to 9) represented by formula (I) of U.S. Pat. No. 4,923,788;

UV Absorbent

Compounds (18b) to (18r) represented by formula (1) and 101 to 427 (pages 6 to 9) of JP-A-46-3335, compounds (3) to (66) (pages 10 to 44) represented by formula (I) and compounds HBT-1 to HBT-10 (page 14) represented by formula (III) of EP 520938A, and compounds (1) to (31) (columns 2 to 9) represented by formula (1) of EP 521823A.

The present invention can be applied to various color light-sensitive materials such as color negative film for general use or for movie, color reversal film for slide or for television, color paper, color positive film and color reversal paper. Further, the present invention is suitably used for a film unit with a lens described in JP-B-2-32615 and JP-U-B-3-39784 (the term "JP-U-B" as used herein means an "examined Japanese utility model publication).

The support which can be suitably used in the present invention is described, for example, in *RD* No. 17643, page 28, ibid., No. 18716, from page 647, right column to page 648, left column and ibid., No. 307105, page 879.

In the light-sensitive material of the present invention, the total thickness of all hydrophilic colloid layers on the side having emulsion layers is preferably 28 μm or less, more preferably 23 μm or less, still more preferably 18 μm or less and most preferably 16 μm or less. The film swelling speed $T_{1/2}$ is preferably 30 seconds or less, more preferably 20 seconds or less. $T_{1/2}$ is defined as the time required for the film thickness to reach a half (½) of a saturation film thickness which corresponds to 90% of the maximum swollen thickness achieved at the processing with a color developer at 30° C. for 3 minutes and 15 seconds. The film thickness means a film thickness determined at 25° C. and 55% RH (relative humidity) under humidity conditioning for 2 days. $T_{1/2}$ can be measured by means of a swellometer described in A. Green et al, *Photogr. Sci. Eng.*, Vol. 19, 2, pp. 124–129. The $T_{1/2}$ can be adjusted by adding a hardening agent to gelatin as a binder or changing the aging conditions after coating. The swelling rate is preferably from 150 to 400%. The swelling rate can be obtained from the maximum swollen film thickness under the above-described conditions according to the formula: (maximum swollen film thickness—film thickness)/film thickness.

In the light-sensitive material of the present invention, on the side opposite to the side having emulsion layers, hydrophilic colloid layers (called back layer) having a total dry thickness of from 2 to 20 μm are preferably provided. This back layer preferably contains a light absorbent, a filter dye, an ultraviolet absorbent, an antistatic agent, a hardening agent, a binder, a plasticizer, a lubricant, a coating agent or a surface active agent, which are described above. The back layer has a swelling rate of preferably from 150 to 500%.

The light-sensitive material of the present invention can be developed according to usual methods described in *RD* No. 17643, pp. 28–29, ibid., No. 18716, p. 651, from left to right columns and ibid., No. 307105, pp. 880–881.

The processing solution for a color negative film for use in the present invention is described below.

The color developer for use in the present invention may use the compounds described in JP-A-4-121739, from page 9, right upper column, line 1 to page 11, left lower column, line 4. In conducting rapid processing, the color developing agent is preferably 2-methyl-4-[N-ethyl-N-(2-hydroxyethyl) amino]aniline, 2-methyl-4-[N-ethyl-N-(3-hydroxypropyl) amino]aniline or 2-methyl-4-[N-ethyl-N-(4-hydroxybutyl) amino]aniline.

The color developing agent is used at a concentration of preferably from 0.01 to 0.08 mol, more preferably from 0.015 to 0.06, still more preferably from 0.02 to 0.05 mol, per l of the color developer. The replenisher for the color developer preferably contains the color developing agent in an amount of from 1.1 to 3 times, preferably from 1.3 to 2.5 times, the above-described concentration.

As the preservative for the color developer, hydroxylamine can be widely used, but in the case where higher preservability is required, a hydroxylamine derivative having a substituent such as an alkyl group, a hydroxylalkyl group, a sulfoalkyl group or a carboxylalkyl group is preferred and preferred specific examples thereof include N,N-di(sulfoethyl)hydroxylamine, monomethylhydroxylamine, dimethylhydroxylamine, monoethylhydroxylamine, diethylhydroxylamine and N,N-di(carboxyethyl)hydroxyl amine. Among these, N,N-di(sulfoethyl)hydroxylamine is preferred. These compounds each may be used in combination with hydroxylamine but it is preferred to use one or more of these compounds in place of hydroxylamine.

The preservative is used in a concentration of preferably from 0.02 to 0.2 mol/l, more preferably from 0.03 to 0.15 mol/l, still more preferably from 0.04 to 0.1 mol/l. In the replenisher, the same as in the case of a color developing agent, the preservative is contained at a concentration of preferably from 1.1 to 3 times the concentration of the mother solution (processing tank solution).

As the agent for preventing formation of a tar derived from an oxidation product of the color developing agent, the color developer may contain a sulfite. The sulfite is used in a concentration of from 0.01 to 0.05 mol/l, preferably from 0.02 to 0.04 mol/l. In the replenisher, it is used at a concentration of from 1.1 to 3 times the concentration of the mother solution.

The color developer has a pH of preferably from 9.8 to 11.0, more preferably from 10.0 to 10.5. In the replenisher, the pH is preferably set from 0.1 to 1.0 higher than the above-described range. In order to stably maintain the pH in the above-described range, a known buffer such as carbonate, phosphate, sulfosalicylate or borate may be used.

The replenishing amount of the color developer is preferably from 80 to 1,300 ml per $m^2$ of the light-sensitive material, but in view of reduction in the environmental pollution load, it is preferably lower, specifically, from 80 to 600 ml, more preferably from 80 to 400 ml, per $m^2$ of the light-sensitive material.

The bromide ion concentration in the color developer is usually from 0.01 to 0.06 mol/l, but for the purpose of improving discrimination by suppressing fogging while keeping sensitivity and at the same time for improving the granularity, it is preferably set to from 0.015 to 0.03 mol/l. The bromide ion concentration may be adjusted to the above-described range by incorporating bromide ions into the replenisher in such an amount as calculated according to the following formula, however, when C becomes a negative value, it is preferred to incorporate no bromide ion into the replenisher.

$$C=A-W/V$$

C: bromide ion concentration (mol/l) in the replenisher for the color developer

A: bromide ion concentration (mol/l) in the objective color developer

W: amount (mol) of bromide ions eluted from the light-sensitive material into the color developer when 1 $m^2$ of the light-sensitive material is color developed V: replenishing amount (l) of the replenisher for the color developer per 1 $m^2$ of the light-sensitive material Also, when the replenishing amount is reduced or when the bromide ion concentration is set higher, a development accelerator is preferably used in order to increase the sensitivity and examples of the development accelerator include pyrazolidones such as 1-phenyl-3-pyrazolidone and 1-phenyl-2-methyl-2-hydroxymethyl-3-pyrazolidone, and thioether compounds such as 3,6-dithia-1,8-octanediol.

To the processing solution having bleaching ability in the present invention, the compounds and the processing conditions described in JP-A-4-125558, from page 4, left lower column, line 16 to page 7, left lower column, line 6 may be applied.

The bleaching agent preferably has an oxidation-reduction potential of 150 mV or more and preferred specific examples thereof include those described in JP-A-5-72694 and JP-A-5-173312. In particular, 1,3-diaminopropanetetraacetic acid and a ferric complex salt of Compound 1 as a specific example described at page 7 of JP-A-5-173312 are preferred.

Further, in order to improve biodegradability of the bleaching agent, a ferric complex salt of the compounds described in JP-A-4-251845, JP-A-4-268552, European Patents 588289 and 591934, and JP-A-6-208213 is preferably used as the bleaching agent. The concentration of the bleaching agent is preferably from 0.05 to 0.3 mol per l of the solution having bleaching ability and in particular, for the purpose of reducing the discharge to the environment, the concentration is preferably set to from 0.1 to 0.15 mol per l of the solution having bleaching ability. Further, when the solution having bleaching ability is a bleaching solution, bromide is preferably incorporated thereinto in an amount of from 0.2 to 1 mol/l, more preferably from 0.3 to 0.8 mol/l.

The replenisher for the solution having bleaching ability basically contains respective components each at a concentration calculated according to the following formula, whereby the concentrations in the mother solution can be maintained constant.

$$C_R=C_T\times(V_1+V_2)/V_1+C_P$$

$C_R$: concentration of the component in the replenisher $C_T$: concentration of the component in the mother solution (processing tank solution)

$C_P$: concentration of the component consumed during the processing $V_1$: replenishing amount (ml) of the replenisher having bleaching ability per 1 $m^2$ of the light-sensitive material $V_2$ amount (ml) carried over from the previous bath by 1 $m^2$ of the light-sensitive material In addition, the bleaching solution preferably contains a pH buffer, particularly preferably a dicarboxylic acid having a low odor such as succinic acid, a maleic acid, a malonic acid, a glutaric acid or an adipic acid. Also, a known bleaching accelerator described in JP-A-53-95630, *RD* No. 17129 and U.S. Pat. No. 3,893,858 is preferably used.

The bleaching solution is preferably replenished by the bleaching replenisher in an amount of from 50 to 1,000 ml, preferably from 80 to 500 ml, more preferably from 100 to 300 ml, per $m^2$ of the light-sensitive material. Further, the bleaching solution is preferably subjected to aeration.

To the processing solution having fixing ability, the compounds and the processing conditions described in JP-A-4-125558, from page 7, left lower column, line 10 to page 8, right lower column, line 19 may be applied.

In particular, in order to improve the fixing rate and the preservability, the compounds represented by formulae (I) and (II) of JP-A-6-301169 are preferably incorporated individually or in combination into the processing solution having fixing ability. Further, it is also preferred, in view of improvement in the preservability, to use a sulfinic acid described in JP-A-1-224762 including p-toluene sulfinate.

The solution having bleaching ability or the solution having fixing ability preferably uses an ammonium as a cation for the purpose of improving desilvering property, however, in view of reduction in the environmental pollution, it is preferred to reduce the use amount of ammonium or to use no ammonium.

In the bleaching, bleach-fixing and fixing steps, jet stirring described in JP-A-1-309059 is particularly preferably conducted.

The replenishing amount of the replenisher in the bleach-fixing or fixing step is from 100 to 1,000 ml, preferably from 150 to 700 ml, more preferably from 200 to 600 ml, per $m^2$ of the light-sensitive material.

In the bleach-fixing or fixing step, a silver recovery device of various types is preferably provided as an in-line or off-line system to recover silver. By providing the device as an in-line system, the silver concentration in the solution can be reduced during the processing and the replenishing amount can be reduced. It is also preferred to recover the silver in an off-line system and re-use the residual solution as the replenisher.

The bleach-fixing step or the fixing step may be constituted by a plurality of processing tanks and respective tanks are preferably piped in a cascade manner to provide a multi-stage countercurrent system. In view of balance with the size of the developing machine, two-tank cascade constitution is generally efficient and the ratio of the processing time in the pre-stage tank to the processing time in the post-stage tank is preferably from 0.5/1 to 1/0.5, more preferably from 0.8/1 to 1/0.8.

The bleach-fixing solution or the fixing solution preferably contains a free chelating agent not converted into a metal complex for the purpose of improving the preservability, and the chelating agent used to this effect is preferably a biodegradable chelating agent described with respect to the bleaching solution.

To the water washing and stabilization steps, the contents described in JP-A-4-125558, from page 12, right lower column, line 6 to page 13, right lower column, line 16 can be preferably applied. In particular, it is preferred in view of conservation of the work environment to use an azolylmethylamine described in European Patents 504609 and 519190 or an N-methylolazole described in JP-A-4-362943 in place of formaldehyde or to use a two-equivalent magenta coupler to thereby allow the use of a surface active agent solution containing no image stabilizer such as formaldehyde.

Further, in order to reduce the dusts attached to the magnetic recording layer coated on a light-sensitive material, a stabilizing solution described in JP-A-6-289559 is preferably used.

The replenishing amount for the washing water or stabilizing solution is, for the purpose of ensuring the water washing or stabilizing function and at the same time, reducing the waste in view of environmental coacervation, preferably from 80 to 1,000 ml, more preferably from 100 to 500 ml, still more preferably from 150 to 300 ml. In the processing using the above-described replenishing amount, in order to prevent proliferation of bacteria or mold, a known antimold such as thiabendazole, 1,2-benzoisothiazolin-3-one and 5-chloro-2-methylisothiazolin-3-one, an antibiotic such as gentamicin, or water deionized by an ion exchange resin is preferably used. It is more effective to use deionized water in combination with a microbicide or an antibiotic.

The replenishing amount for the solution in the washing water or stabilizing solution tank is preferably reduced by subjecting the solution to reverse osmosis membrane treatment described in JP-A-3-46652, JP-A-3-53246, JP-A-3-55542, JP-A-3-121448 and JP-A-3-126030 and the reverse osmosis membrane used here is preferably a low pressure reverse osmosis membrane.

In the processing of the present invention, compensation for evaporation of the processing solutions disclosed in *JIII Journal of Technical Disclosure,* No. 94-4992 is preferably conducted. In particular, according to (formula-1) at page 2 of the publication, the compensation is preferably conducted using the temperature and humidity information in the environment where the automatic developing machine is installed. The water for use in the compensation for evaporation is preferably supplied from the replenishing tank of water washing and in this case, deionized water is preferably used as the water washing replenishing water.

As the processing agent for use in the present invention, those described in *JIII Journal of Technical Disclosure* (cited above), from page 3, right column, line 15 to page 4, left column, line 32 are preferred. Further, as the developing machine used therefor, a film processor described in ibid., page 3, right column, lines 22 to 28 is preferred.

Specific examples of the processing agent, the automatic developing machine and the evaporation compensation method which are preferably used in the present invention are described in *JIII Journal of Technical Disclosure* (cited above), from page 5, right column, line 11 to page 7, right column, the last line.

The processing agent for use in the present invention may be supplied in any form such as a liquid agent in a concentration of the solution in the use state or in the condensed form, a granulated powder, a powder, a tablet, a paste or an emulsion. Examples of the processing agent include a liquid agent housed in a container having a low oxygen permeability described in JP-A-63-17453, vacuum-packaged powder or granulated powder described in JP-A-4-19655 and JP-A-4-230748, granulated powder having incorporated therein a water-soluble polymer described in JP-A-4-221951, a tablet described in JP-A-51-61837 and JP-A-6-102628, and a paste processing agent described in JP-A-57-500485, which all are preferably used, however, in view of convenience on use, a liquid previously prepared to have a concentration in the use state is preferred.

For the container for housing the processing agent, polyethylene, polypropylene, polyvinyl chloride, polyethylene terephthalate and nylon are used individually or as a composite material. These materials are selected according to the level of the oxygen permeability required. For the solution susceptible to oxidation such as color developer, materials having a low oxygen permeability are preferred and more specifically, a composite material of polyethylene terephthalate or polyethylene and nylon is preferred. The material is used for the container to have a thickness of from 500 to 1,500 $\mu$m and an oxygen permeability of preferably 20 ml/m$^2$.24 hrs.atm or less.

The processing solution for a color reversal film for use in the present invention is described below. The processing of a color reversal film is described in detail in *Kochi Gijutsu* (Known Technique), No. 6, from page 1, line 5 to page 10, line 5, and from page 15, line 8 to page 24, line 2, issued by Aztec Limited (Apr. 1, 1991), and the contents in the publication all may be preferably used.

In the processing of a color reversal film, the image stabilizer is incorporated into a controlling bath or a final bath. The image stabilizer includes formalin, sodium formaldehyde bisulfite and N-methylolazoles, however, in view of the work environment, sodium formaldehyde bisulfite and N-methylolazoles are preferred and as the N-methylolazoles, N-methyloltriazole is particularly preferred. The description of the color developer, the bleaching solution, the fixing solution and the washing water given with respect to the processing of a color negative film may also be preferably applied to the processing of a color reversal film.

Preferred examples of the processing agent for a color reversal film covering the above-described description include Processing Agent E-6 produced by Eastman Kodak Company and Processing Agent CR-56 produced by Fuji Photo Film Co., Ltd.

The polyester support for use in the present invention is described below. Other than those described above, the details thereon including the light-sensitive material, the processing, the cartridge and the experimental examples are described in *JIII Journal of Technical Disclosure* No. 94-6023 (Mar. 15, 1994). The polyester for use in the present invention is formed using diol and an aromatic dicarboxylic acid as essential components. Examples of the aromatic dicarboxylic acid include 2,6-naphthalene dicarboxylic acid, 1,5-naphthalene dicarboxylic acid, 1,4-naphthalene dicarboxylic acid, 2,7-naphthalene dicarboxylic acid, a terephthalic acid, an isophthalic acid and a phthalic acid, and examples of the diol include diethylene glycol, triethylene glycol, cyclohexanedimethanol, bisphenol A and biphenol. The polymer includes a homopolymer such as polyethylene terephthalate, polyethylene naphthalate and polycyclohexanedimethanol terephthalate. Among these, preferred is a polyester containing from 50 to 100 mol % of 2,6-naphthalenedicarboxylic acid. Particularly preferred is polyethylene 2,6-naphthalate. The average molecular weight is approximately from 5,000 to 200,000. The polyester of the present invention has a Tg of 50° C. or higher, more preferably 90° C. or higher.

The polyester support is subjected to heat treatment to have an aversion to curling habit at a heat treatment temperature of from 40° C. to less than Tg, more preferably from (Tg −20° C.) to less than Tg. The heat treatment may be conducted either at a constant temperature within the above-described range or while cooling. The heat treatment time is from 0.1 to 1,500 hours, more preferably from 0.5 to 200 hours. The support may be subjected to heat treatment either in a state of roll or as a web on the way of conveyance. The surface may be made uneven (for example, by coating electrically conductive inorganic fine particles such as $SnO_2$ or $Sb_2O_5$)) to improve the surface state. Also, it is preferred to make some designs such that the edge is knurled to slightly increase the height only of the edge, thereby preventing the cut copy at the core portion. The heat treatment may be conducted at any stage, such as after formation of support film, after surface treatment, after coating of a back layer (e.g., antistatic agent, lubricating agent), or after coating of an undercoat layer. The preferred stage is after coating of an antistatic agent.

Into the polyester, an ultraviolet absorbent may be kneaded in. For preventing light piping, a commercially available dye or pigment for polyester, such as Diaresin produced by Mitsubishi Chemical Corp. or Kayaset produced by Nippon Kayaku K.K., may be mixed so as to attain the object.

In the present invention, the surface treatment is preferably performed so that the support can be bonded to the light-sensitive constituent layer. Examples of the surface activation treatment include chemical treatment, mechanical treatment, corona discharge treatment, flame treatment, ultraviolet light treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment.

The undercoating method is described below. The undercoating may be single layer coating or two or more layer coating. The binder for the undercoat layer includes a copolymer starting from a monomer selected from vinyl chloride, vinylidene chloride, butadiene, methacrylic acid, acrylic acid, itaconic acid and maleic anhydride, and in addition, polyethyleneimine, epoxy resin, grafted gelatin, nitrocellulose and gelatin. The compound which expands the support include resorcinol and p-chlorophenol. The undercoat layer may contain a gelatin hardening agent and examples thereof include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resins and active vinyl sulfone compounds. Further, the undercoat layer may contain an inorganic fine particle such as $SiO_2$ and $TiO_2$ or a polymethyl methacrylate copolymer fine particle (0.01 to 10 $\mu$m) as a matting agent.

In the present invention, an antistatic agent is preferably used. Examples of the antistatic agent include a high polymer containing a carboxylic acid, a carboxylate or a sulfonate, a cationic high polymer and an ionic surface active agent compound.

Most preferred antistatic agents are a fine particle of at least one crystalline metal oxide having a volume resistivity of $10^7$ Ω-cm or less, more preferably $10^5$ Ω-cm or less and a particle size of from 0.001 to 1.0 $\mu$m, selected from ZnO, $TiO_2$, $SnO_2$, $Al_2O_3$, $In_2O_3$, $SiO_2$, MgO, BaO, $MoO_3$ and $V_2O_5$ or of a composite oxide of these (e.g., Sb, P, B, In, S, Si, C) and a fine particle of a sol-like metal oxide or of a composite oxide of these. The content of the antistatic agent in the light-sensitive material is preferably from 5 to 500 mg/m$^2$, more preferably from 10 to 350 mg/m$^2$. The ratio of the electrically conductive crystalline oxide or a composite oxide thereof to the binder is preferably from 1/300 to 100/1, more preferably from 1/100 to 100/5.

The light-sensitive material of the present invention preferably has a lubricating property. The lubricating agent-containing layer is preferably present on both the light-sensitive layer surface and the back surface. The preferred lubricating property is in terms of a coefficient of dynamic friction, from 0.01 to 0.25. The value is determined using a stainless steel ball having a diameter of 5 mm by transporting the light-sensitive material at a speed of 60 cm/min (25° C., 60% RH). In this evaluation, even when the other party is changed to the light-sensitive layer surface, the value almost on the same level is obtained.

The lubricating agent which can be used in the present invention includes polyorganosiloxane, a higher fatty acid amide, a higher fatty acid metal salt and an ester of a higher fatty acid with a higher alcohol. Examples of the polyoxysiloxane include polydimethylsiloxane, polydiethylsiloxane, polystyrylmethylsiloxane and polymethylphenylsiloxane. The layer to be added is preferably an outermost layer of the emulsion layers or a back layer. In particular, polydimethylsiloxane and an ester having a long chain alkyl group are preferred.

The light-sensitive material of the present invention preferably contains a matting agent. The matting agent may be used either on the emulsion surface or back surface, but it is particularly preferred to add to the outermost layer on the emulsion layer side. The matting agent may be either soluble in the processing solution or insoluble in the processing solution, and both are preferably used in combination. For example, polymethyl methacrylate, poly(methyl methacrylate/methacrylic acid=9/1 or 5/5 (by mol)) and polystyrene particles are preferred. The particle size is preferably from 0.8 to 10 $\mu$m, the particle size distribution is preferably narrower, and 90% by number or more of all particles have a size between 0.9 and 1.1 times the average particle size. In order to increase the matting property, fine particles of 0.8 $\mu$m or less are preferably added at the same time and examples thereof include polymethyl methacrylate (0.2 $\mu$m), poly(methyl methacrylate/methacrylic acid=9/1 (by mol), 0.3 $\mu$m), polystyrene particles (0.25 $\mu$m) and colloidal silica (0.03 $\mu$m).

The film patrone for use in the present invention is described below. The patrone for use in the present invention may be made of a metal or a synthetic plastic as a main material.

Preferred plastic materials are polystyrene, polyethylene, polypropylene and polyphenyl ether. The patrone of the present invention may further contain various antistatic agents and preferred examples thereof include carbon black, a metal oxide particle, a nonionic, anionic, cationic or betaine surface active agent and a polymer. The patrone imparted with the antistatic property using these is described in JP-A-1-312537 and JP-A-1-312538. In particular, the resistance at 25° C. and 25% RH is preferably $10^{12}$ Ω or less. Usually, the plastic patrone is produced using a plastic having kneaded therein carbon black or a pigment so as to give light-shielding property. The patrone may have a currently used 135 size but it is also effective for achieving miniaturization of a camera to reduce the cartridge size from 25 mm in the current 135 size to 22 mm or less. The volume of the patrone case is preferably 30 $cm^3$ or less, more preferably 25 $cm^3$ or less. The weight of plastics used in the patrone and the patrone case is preferably from 5 to 15 g.

The patrone for use in the present invention may be a patrone which sends forth the film by rotation of a spool. Also, the patrone may have such a structure that a film leading end is housed in the patrone body and the film leading end is sent forth from the port part of the patrone towards the outside by rotating the spool shaft in the film delivery direction. These are disclosed in U.S. Pat. Nos. 4,834,306 and 5,226,613. The photographic film for use in the present invention may be a so-called green film before development or a developed photographic film. Also, a green film and a developed photographic film may be housed in the same new patrone or in different patrones.

The present invention will be described in greater detail below with reference to Examples but the present invention should not be construed as being limited to these Examples.

EXAMPLE 1

The following Comparative coupler (A) was used as a magenta coupler, tricresyl phosphate, ethyl acetate and sodium dodecylbenzenesulfonate were added to the coupler, the mixture was finely emulsion dispersed in an aqueous gelatin solution to obtain a coupler dispersion, the coupler dispersion was added to a silver iodobromide emulsion (AgI content: 4 mol %, average grain size: 0.4 μm, cubic, multiple structure grain), and poly(vinylbenzene sulfonate) as a thickener, vinylsulfone-base compound as a hardening agent and a tetrazaindene-base compound as a stabilizer were added thereto to prepare an emulsion coating solution. Subsequently, the coating solution was uniformly coated on a 205 μm-thick cellulose triacetate film support having an undercoat layer and thereon a surface protective layer mainly comprising an aqueous gelatin solution was coated to prepare a sample. This sample was designated as Sample 101.

The coated silver amount was 1.5 $g/m^2$, the coupler coated amount was 1.0 $g/m^2$ and the gelatin coated amount in the protective layer was 2.0 $g/m^2$.

Sample 102 was prepared in the same manner as Sample 101 except for adding Compound (A-18) of the present invention to Sample 101. In this case, Compound (A-18) was added to the coupler and the mixture was emulsion dispersed. The coated amount of Compound (A-18) was 10 $mg/m^2$. The coated silver amount and the coated coupler amount were the same as those of Sample 101.

Samples 103 and 104 were prepared in the same manner as Sample 101 except for replacing Comparative Coupler (A) used in Samples 101 and 102 by an equimolar amount of Coupler (m-1) of the present invention. In this case, the weight ratio of tricresyl phosphate/coupler was made constant (0.5).

Samples 105 to 107 were prepared by replacing Coupler (m-1) of Sample 104 by an equimolar amount of the coupler of the present invention as shown in Table 1 and also in this case, the weight ratio to tricresyl phosphate was made constant. Sample 108 was prepared in the same manner as above except for adding Comparative Compound (1) in place of Compound (A-18) of Sample 104.

Samples 109 to 136 were prepared in the same manner as above except for changing the presence or the absence of the comparative coupler shown below, the coupler of the present invention and the compounds represented by formulae (A-I) to (A-III) as shown in Tables 1 and 2. In each sample, the coupler to replace was used in an equimolar amount and the weight ratio to tricresyl phosphate was made constant. Polymer couplers to replace each was used in an equimolar amount calculated in terms of the pyrazolone mother nucleus as a constituent unit from the weight ratio.

Comparative Coupler (A) in Samples 103 to 108, Comparative Coupler (B) in Samples 111 to 115, Comparative Coupler (C) in Samples 118 to 120 and Comparative Coupler (D) in Samples 123 to 127 have the same pyrazolone mother nucleus and each comparative coupler is a so-called four-equivalent coupler with the coupling active site being not substituted.

Comparative Couple (A)

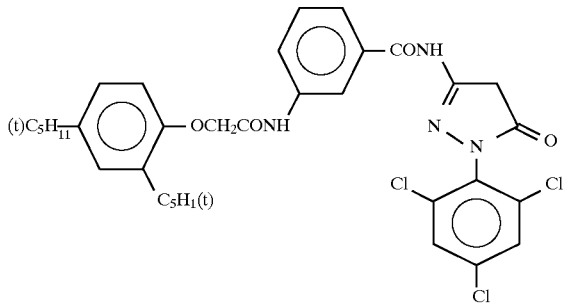

-continued

Comparative Coupler (B)

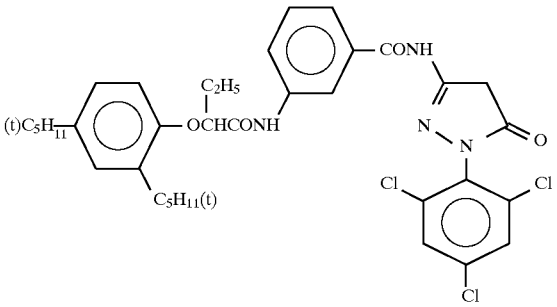

Comparative Coupler (C)

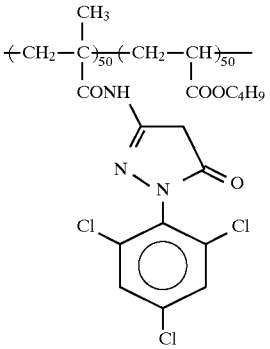

(by weight)

Comparative Coupler (D)

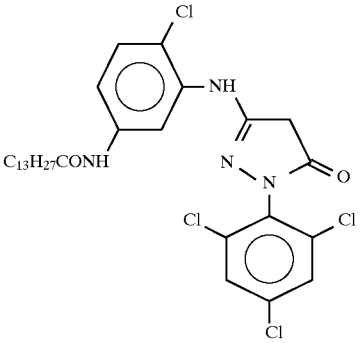

Comparative Compound (1)
(Compound (d) decribed in JP-A-59-97134)

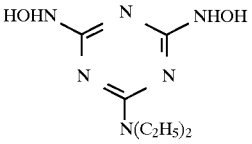

The thus-prepared samples each was cut and processed into a size of 35 mm (width)×160 cm (length), wound around a spool of a 135 patrone currently available, and housed in the patrone. The core diameter was 11 mm and the number of turns was 31.

Using these light-sensitive materials housed in the patrone, evaluation of capability was performed as follows.

(1) Color density

Light-sensitive materials in one group were stored at 40° C. and 60% RH (relative humidity) for 60 days and those in another group were stored at 5° C. and 35% RH (relative humidity) for the same period. The outside part of each of the wound-up light-sensitive materials in these two groups was taken out, exposed to white light through a wedge for sensitometry and then color developed as described below.

Developed samples were measured on the G density and characteristic curves thereof were obtained. From these characteristic curves, the maximum density (Dmax) was read and within a coupler group having the same mother nucleus, the ratio of each maximum density value at 40° C .or 5° C. of samples containing or not containing the compound represented by formula (A-I), (A-II) or (A-III) of the present invention was obtained taking the value of a sample containing none of the compound of the present invention as a standard. The coupler group having the same mother nucleus includes a group of Samples 101 to 108, a group of Samples 109 to 115, a group of Samples 116 to 120, a group of Samples 121 to 127, a group of Samples 128 to 138 and a group of Samples 131 to 136. With respect to the standard, for example, in the group of Samples 101 to 108, the maximum density after storage at 5° C. of Sample 101 was taken as a standard (100). In the group of Samples 128 to 138, Sample 101 was taken as a standard and in the group of Samples 131 to 136, Sample 121 was taken as a standard.

(2) Pressure fogging (ΔD)

Light-sensitive materials in one group were stored at 45° C. and 75% RH (relative humidity) for 30 days. Thereafter, a film sample was taken out from each patrone and then without exposing it, subjected to the following processing from which the first development was omitted, through the first water washing as a second step and the following. Samples colored to magenta each was measured on the G density from the leading end to the heel end of the sample. In the case of samples where there was difference in the density between the leading end part and the heel end part, difference ($\Delta D=D_H-D_L$) between the highest density value ($G_H$) and the lowest density value ($D_L$) was obtained from the results of measurement and the degree of pressure fogging caused upon storage at high temperature of a light-sensitive material lengthily wound up was examined. In samples having difference in the density, the portion near to the spool gave a high density value.

The color development processing procedure and the composition of each processing solution used in this Example are shown below.

| Processing Step | Time (min) | Temperature (°C.) | Tank Volume (l) | Replenishing Amount (ml/m$^2$) |
|---|---|---|---|---|
| First development | 4 | 38 | 12 | 2,200 |
| First water washing | 2 | 38 | 4 | 7,500 |
| Reversal | 2 | 38 | 4 | 1,100 |
| Color developnent | 6 | 38 | 12 | 2,200 |
| Pre-bleaching | 2 | 38 | 4 | 1,100 |
| Bleaching | 6 | 38 | 12 | 220 |
| Fixing | 4 | 38 | 8 | 1,100 |
| Second water washing | 4 | 38 | 8 | 7,500 |
| Final rinsing | 1 | 25 | 2 | 1,100 |

Each processing solution had the following composition.

First Developer:

| | Tank Solution (g) | Replenisher (g) |
|---|---|---|
| Pentasodium nitrilo-N,N,N-trimethylenephosphonate | 1.5 | 1.5 |
| Pentasodium diethylenetriaminepentaacetate | 2.0 | 2.0 |
| Sodium sulfite | 30 | 30 |
| Potassium hydroquinone. monophosphonate | 20 | 20 |
| Potassium carbonate | 15 | 20 |
| Potassium bicarbonate | 12 | 15 |
| 1-Phenyl-4-methyl-4-hydroxymethyl-3-pyrazolidone | 1.5 | 2.0 |
| Potassium bromide | 2.5 | 1.4 |
| Potassium thiocyanate | 1.2 | 1.2 |
| Potassium iodide | 2.0 mg | — |
| Diethylene glycol | 13 | 15 |
| Water to make | 1,000 ml | 1,000 ml |
| pH | 9.60 | 9.60 |

The pH was adjusted by sulfuric acid or potassium hydroxide.

Reversal Solution:

| | Tank Solution (g) | Replenisher (g) |
|---|---|---|
| Pentasodium nitrilo-N,N,N-trimethylenephosphonate | 3.0 | same as tank solution |
| Stannous chloride dihydrate | 1.0 | |
| p-Aminophenol | 0.1 | |
| Sodium hydroxide | 8 | |
| Glacial acetic acid | 15 ml | |
| Water to make | 1,000 ml | |
| pH | 6.00 | |

The pH was adjusted by acetic acid or sodium hydroxide.

Color Developer

| | Tank Solution (g) | Replenisher (g) |
|---|---|---|
| Pentasodium nitrilo-N,N,N-trimethylenephosphonate | 2.0 | 2.0 |
| Sodium sulfite | 7.0 | 7.0 |
| Trisodium phosphate dodecahydrate | 36 | 36 |
| Potassium bromide | 1.0 | — |
| Potassium iodide | 90 mg | — |
| Sodium hydroxide | 3.0 | 3.0 |
| Citrazinic acid | 1.5 | 1.5 |
| N-Ethyl-N-(β-methanesulfonamidoethyl)-3-methyl-4-aminoaniline.3/2 sulfuric acid monohydrate | 11 | 11 |
| 3,6-Dithiaoctane-1,8-diol | 1.0 | 1.0 |
| Water to make | 1,000 ml | 1,000 ml |
| pH | 11.80 | 12.00 |

The pH was adjusted by sulfuric acid or potassium hydroxide.

Pre-Bleaching Solution:

| | Tank Solution (g) | Replenisher (g) |
|---|---|---|
| Disodium ethylenediaminetetraacetate dihydrate | 8.0 | 8.0 |
| Sodium sulfite | 6.0 | 8.0 |
| 1-Thioglycerol | 0.4 | 0.4 |
| Formaldehyde sodium bisulfite adduct | 30 | 35 |
| Water to make | 1,000 ml | 1,000 ml |
| pH | 6.30 | 6.10 |

The pH was adjusted by acetic acid or sodium hydroxide.

Bleaching Solution:

| | Tank Solution (g) | Replenisher (g) |
|---|---|---|
| Disodium ethylenediaminetetraacetate dihydrate | 2.0 | 4.0 |
| Ammonium ethylenediaminetetraacetate.Fe(III) dihydrate | 120 | 240 |
| Potassium bromide | 100 | 200 |
| Ammonium nitrate | 10 | 20 |
| Water to make | 1,000 ml | 1,000 ml |
| pH | 5.70 | 5.50 |

The pH was adjusted by nitric acid or sodium hydroxide.

Fixing Solution:

| | Tank Solution (g) | Replenisher (g) |
|---|---|---|
| Ammonium thiosulfate | 80 | same as tank solution |
| Sodium sulfite | 5.0 | |
| Sodium bisulfite | 5.0 | |
| Water to make | 1,000 ml | |
| pH | 6.60 | |

The pH was adjusted by acetic acid or aqueous ammonia.

Stabilizing Solution:

| | Tank Solution (g) | Replenisher (g) |
|---|---|---|
| 1,2-Benzoisothiazolin-3-one | 0.02 | 0.03 |
| Polyoxyethylene-p-monononylphenyl ether (average polymerization degree: 10) | 0.3 | 0.3 |
| Polymaleic acid (average molecular weight: 2,000) | 0.1 | 0.15 |
| Water to make | 1,000 ml | 1,000 ml |
| pH | 7.0 | 7.0 |

The results of evaluations (1) and (2) are shown in Tables 1 and 2.

TABLE 1

| Sample | Magenta Coupler | Compound of (A-I), (A-II) or (A-III) (mg/m²) | | Color Density 5° C. | Color Density 40° C. | Pressure Fogging (ΔD) |
|---|---|---|---|---|---|---|
| 101 (Comparison) | Comparative Coupler (A) | — | | 100 (standard) | 72 | 0.15 |
| 102 (Comparison) | Comparative Coupler (A) | (A-18) | 10 | 83 | 41 | 0.12 |
| 103 (Comparison) | (m-1) | — | | 188 | 184 | 0.18 |
| 104 (Invention) | " | (A-18) | 10 | 202 | 202 | 0.02 |
| 105 (Invention) | (m-15) | " | " | 200 | 198 | 0.02 |
| 106 (Invention) | (m-16) | " | " | 197 | 195 | 0.03 |
| 107 (Invention) | (m-29) | " | " | 202 | 202 | 0.02 |
| 108 (Comparison) | (m-1) | Comparative Compound (1) | 10 | 189 | 185 | 0.15 |
| 109 (Comparison) | Comparative Coupler (B) | — | | 100 (Standard) | 73 | 0.15 |
| 110 (Comparison) | Comparative Coupler (B) | (A-18) | 10 | 84 | 43 | 0.12 |
| 111 (Comparison) | (m-2) | — | | 190 | 186 | 0.18 |
| 112 (Invention) | " | (A-18) | 10 | 205 | 205 | 0.02 |
| 113 (Invention) | (m-14) | " | " | 205 | 205 | 0.02 |
| 114 (Invention) | (m-31) | " | " | 205 | 204 | 0.02 |
| 115 (Invention) | (m-39) | " | " | 205 | 205 | 0.02 |
| 116 (Comparison) | Comparative Coupler (C) | — | | 100 (standard) | 75 | 0.15 |
| 117 (Comparison) | Comparative Coupler (C) | (A-18) | 10 | 86 | 46 | 0.12 |
| 118 (Comparison) | (m-19) | — | | 193 | 189 | 0.18 |
| 119 (Invention) | " | (A-18) | 10 | 207 | 207 | 0.02 |
| 120 (Invention) | (m-28) | " | " | 207 | 207 | 0.02 |
| 121 (Comparison) | Comparative Coupler (D) | — | | 100 (standard) | 70 | 0.16 |
| 122 (Comparison) | Comparative Coupler (D) | (A-18) | 10 | 81 | 39 | 0.12 |
| 123 (Comparison) | (m-7) | — | | 181 | 174 | 0.20 |
| 124 (Invention) | " | (A-18) | 10 | 200 | 200 | 0.03 |
| 125 (Invention) | (m-21) | " | " | 200 | 200 | 0.03 |
| 126 (Invention) | (m-26) | " | " | 200 | 200 | 0.03 |
| 127 (Invention) | (m-33) | " | " | 200 | 200 | 0.03 |

TABLE 2

| Sample | Magenta Coupler | Compound of (A-I), (A-II) or (A-III) (mg/m²) | | Color Density 5° C. | Color Density 40° C. | Pressure Fogging (ΔD) |
|---|---|---|---|---|---|---|
| 128 (Invention) | (m-5) | (A-14) | 18 | 204 | 204 | 0.02 |
| 129 (Invention) | (m-17) | (A-2) | 8 | 202 | 202 | 0.03 |
| 130 (Invention) | (m-18) | (A-16) | 8 | 203 | 203 | 0.02 |
| 131 (Invention) | (m-8) | (A-17) | 10 | 200 | 200 | 0.03 |
| 132 (Invention) | (m-9) | (A-15) | 10 | 200 | 200 | 0.03 |

TABLE 2-continued

| Sample | Magenta Coupler | Compound of (A-I), (A-II) or (A-III) (mg/m²) | | Color Density 5° C. | Color Density 40° C. | Pressure Fogging (ΔD) |
|---|---|---|---|---|---|---|
| 133 (Invention) | (m-10) | (A-20) | 10 | 196 | 195 | 0.04 |
| 134 (Invention) | (m-23) | (A-32) | 10 | 197 | 196 | 0.04 |
| 135 (Invention) | (m-34) | (A-13)/(A-42) = 1/1 (by mol) | 10 | 199 | 199 | 0.03 |
| 136 (Invention) | (m-40) | (A-4)/(A-49) = 1/1 (by mol) | 12 | 198 | 198 | 0.03 |

It is seen from Tables 1 and 2 upon comparison with comparative samples that even when lengthily wound up and stored at high temperature, samples using the compound represented by formula (A-I), (A-II) or (A-III) of the present invention in combination with the coupler represented formula (m) of the present invention underwent no or almost no reduction in the color density and suppressed in increase in the pressure fogging to scarcely have increase in the fogging.

The pressure fogging was higher in the density on the side of the spool core than on the outer side and a density gradient was present.

With respect to change in the color density (Dmax), so-called four-equivalent couplers (comparative couplers) with the coupling active site being not substituted are inherently low in the formation of color dyes upon color development due to formation of by-products and evidently differ in the color density from two-equivalent couplers of the present invention. Difference in the color density resulting from addition of the compound represented by formula (A-I), (A-II) or (A-III) of the present invention is assumed to occur, in the case of four-equivalent couplers, because the coupler in the developer reacts with the ═N—OH group of the compound of the present invention upon addition of the oil-soluble non-diffusible compound of the present invention to inactivate the coupler. The cause is left to clarify in the future. However, it is surprising that the reduction in Dmax is outstandingly improved by using the compound represented by formula (A-I), (A-II) or (A-III) in combination with the coupler represented by formula (m) of the present invention.

EXAMPLE 2

The same sample as Sample 101 described in the Example of JP-A-6-138574 was prepared according to the description of the publication. This was designated as Sample 201.

Further, Sample 202 was prepared by replacing Magenta Coupler C-4, Magenta Coupler C-7, Magenta Coupler C-8 or Magenta Coupler C-12 used in the ninth to eleventh layers by an equimolar amount of Coupler (m-6), Coupler (m-1), Coupler (m-2) or Coupler (m-19) of the present invention, respectively.

Sample 203 was prepared by adding Compound (A-18) of the present invention in an amount of 5 mg/M² to the ninth layer, 3 mg/m² to the tenth layer and 4 mg/M² to the eleventh layer, of Sample 201.

Sample 204 was prepared by adding Compound (A-18) to the ninth to eleventh layers of Sample 202 in the same amount as in Sample 203.

The thus-prepared samples each was cut and processed into a size of 35 mm (width)×160 cm (length) in the same manner as in Example 1, wound around a spool and housed in a 135 patrone.

Each patrone was stored according to the method described in Evaluations (1) and (2) in Example 1 and then each sample was color developed. In Evaluation (1), the G filter was placed in front of the wedge for sensitometry upon exposure and in the color development, the processing time of the first development was 6 minutes.

The developed samples were measured on the G density in the same manner as in Example 1 and the change in the color density and the pressure fogging were also examined in the same manner as in Example 1.

The results obtained are shown in Table 3 below.

TABLE 3

| | Color Density | | Pressure |
|---|---|---|---|
| Sample | 5° C. | 40° C. | Fogging (ΔD) |
| 201 (Comparison) | 100 (standard) | 65 | 0.15 |
| 202 (Comparison) | 191 | 188 | 0.18 |
| 203 (Comparison) | 65 | 45 | 0.12 |
| 204 (Invention) | 206 | 206 | 0.01 |

It is clear from Table 3 that in Sample 204 of the present invention, difference in the color density due to change in the temperature and increase (ΔD) in the pressure fogging were outstandingly improved.

EXAMPLE 3

1)Support

The support used in this Example was prepared according to the following method.

A polyethylene-2,6-naphthalate polymer (100 parts by weight) and 2 parts by weight of Tinuvin P.326 (produced by Ciba-Geigy AG) as an ultraviolet absorbent were dried, melted at 300° C., extruded from a T-die, longitudinally stretched at 140° C. to 3.3 times, then transversely stretched at 130° C. to 3.3 times and further heat set at 250° C. for 6 seconds to obtain a PEN film having a thickness of 90 μm. To the resulting PEN film, a blue dye, a magenta dye and a yellow dye Compounds I-1, I-4, I-6, I-24, I-26, I-27 and II-5 described in *JIII Journal of Technical Disclosure*, No. 94-6023) were added in an appropriate amount. Further, the film was wound around a stainless steel core having a diameter of 20 cm and imparted with heat history at 110° C. for 48 hours, thereby obtaining a support difficult to have curling habit.

2) Coating of undercoat layer

Both surfaces of the support obtained above were subjected to corona discharge treatment, UV discharge treatment and further glow discharge treatment, and on each surface, an undercoating solution containing 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of a polyamide-epichlorohydrin polycondensate was coated (10 ml/m$^2$, by a bar coater) to provide an undercoat layer on the higher temperature side at the time of stretching. The drying was conducted at 115° C. for 6 minutes (the rollers and the conveyance device in the drying zone all were heated to 115° C.).

3) Coating of back layer

On one surface of the undercoated support, an antistatic layer, a magnetic recording layer and a lubricating layer each having the following composition were coated as a back layer.

3-1) Coating of antistatic layer 0.2 g/m$^2$ of a dispersion (secondary coagulated particle size: about 0.08 μm) of fine particle powder having a resistivity of 5 Ω.cm of a tin oxide-antimony oxide composite having an average particle diameter of 0.005 μm was coated together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree: 10) and 100 mg/m$^2$ of resorcinol.

3-2) Coating of magnetic recording layer

Co-γ-iron oxide (specific surface area: 43 m$^2$/g; major axis: 0.14 μm; minor axis: 0.0382; saturated magnetization: 89 emu/g; $Fe^{+2}/Fe^{+3}$=6/94; the surface being treated with aluminum oxide and silicon oxide each in an amount of 2 wt % based on iron oxide) (0.06 g/m$^2$) subjected to covering treatment with 3-polyoxyethylene-propyloxytrimethoxysilane (polymerization degree: 15) (15 wt %) and dispersed in 1.2 g/m$^2$ of diacetyl cellulose (the iron oxide being dispersed by an open kneader and sand mill) and 0.3 g/m$^2$ of $C_2H_5C(CH_2OCONH{-}C_6H_3(CH_3)NCO)_3$ as a hardening agent using acetone, methyl ethyl ketone and cyclohexanone as solvents was coated by means of a bar coater to obtain a magnetic recording layer having a thickness of 1.2 μm. Thereto were added 50 g/m$^2$ of $C_6H_{13}CH(OH)CH_{10}H_{20}COOC_{40}H_{81}$ as a lubricating agent and silica particles (1.0 μm) as a matting agent and an aluminum oxide (0.20 μm and 1.0 μm) covered with 3-polyoxyethylene-propyloxytrimethoxysilane (polymerization degree: 15) (15 wt %) as an abrasive in an amount to give a coverage of 50 mg/m$^2$ and 10 mg/m$^2$, respectively. The drying was conducted at 115° C. for 6 minutes (the rollers and the conveyance device in the drying zone all were heated to 115° C.). Increase in the color density of $D^B$ of the magnetic recording layer with X-light (blue filter) was about 0.1, the saturated magnetization moment of the magnetic recording layer was 4.2 emu/m$^2$, the coercive force was $7.3\times10^4$ A/m and the angular ratio was 65%.

3-3) Preparation of lubricating layer

Diacetyl cellulose (25 mg/m$^2$), $C_6H_{13}CH(OH)C_{10}H_{20}COOC_{40}H_{81}$ (6 mg/m$^2$) and poly(dimethylsiloxane) (B-3) (1.5 mg/m$^2$) were coated. The mixture was prepared by melting these compounds in xylene/propylene monomethyl ether (1/1) at 105° C. and pouring and dispersing the melt in propylene monomethyl ether (10-folded amount) at room temperature, and added after formulating it into a dispersion (average particle size: 0.01 μm) in acetone. The drying was conducted at 115° C. for 6 minutes (the rollers and the conveyance device in the drying zone all were heated to 115° C.). The thus-provided lubricating layer had excellent properties such that the coefficient of dynamic friction was 0.10 (stainless steel ball (diameter: 5 mm); load: 100 g; speed: 6 cm/min), the coefficient of static friction was 0.08 (by clip method) and the coefficient of dynamic friction between the lubricating layer and the emulsion surface which will be described later was 0.15.

4) Coating of light-sensitive layer

The layers each having the following composition were coated to overlay one on another on the side opposite to the back layer provided above to prepare a color negative film. This film was designated as Sample 301.

(Composition of light-sensitive layer)

The main materials used in each layer are classified as follows.

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective components show coating amounts expressed by the unit g/m$^2$, and in case of silver halide, they show coating amounts in terms of silver. With respect to sensitizing dyes, the coating amount is shown by the unit mol per mol of silver halide in the same layer.

| First Layer (antihalation layer) | | |
|---|---|---|
| Black colloidal silver | as silver | 0.09 |
| Gelatin | | 1.60 |
| ExM-1 | | 0.12 |
| ExF-1 | | $2.0 \times 10^{-3}$ |
| Solid Disperse Dye ExF-2 | | 0.030 |
| Solid Disperse Dye ExF-3 | | 0.040 |
| HBS-1 | | 0.15 |
| HBS-2 | | 0.02 |
| **Second Layer (interlayer)** | | |
| Silver Iodobromide Emulsion M | as silver | 0.065 |
| ExC-2 | | 0.04 |
| Polyethylacrylate latex | | 0.20 |
| Gelatin | | 1.04 |
| **Third Layer (low-sensitivity red-sensitive emulsion layer)** | | |
| Silver Iodobromide Emulsion A | as silver | 0.25 |
| Silver Iodobromide Emulsion B | as silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-6 | | 0.010 |
| Cpd-2 | | 0.025 |
| HBS-1 | | 0.10 |
| Gelatin | | 0.87 |
| **Fourth Layer (medium-sensitivity red-sensitive emulsion layer)** | | |
| Silver Iodobromide Emulsion C | as silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |
| ExC-5 | | 0.015 |

-continued

| | | |
|---|---|---|
| ExC-6 | | 0.0070 |
| Cpd-2 | | 0.023 |
| HBS-1 | | 0.10 |
| Gelatin | | 0.75 |
| **Fifth Layer (high-sensitivity red-sensitive emulsion layer)** | | |
| Silver Iodobromide Emulsion D | as silver | 1.40 |
| ExS-l | | $2.4 \times 10^{-4}$ |
| ExS-2 | | $1.0 \times 10^{-4}$ |
| ExS-3 | | $3.4 \times 10^{-4}$ |
| ExC-1 | | 0.10 |
| ExC-3 | | 0.045 |
| ExC-6 | | 0.020 |
| ExC-7 | | 0.010 |
| Cpd-2 | | 0.050 |
| HBS-1 | | 0.22 |
| HBS-2 | | 0.050 |
| Gelatin | | 1.10 |
| **Sixth Layer (interlayer)** | | |
| Cpd-1 | | 0.090 |
| Solid Disperse Dye ExF-4 | | 0.030 |
| HBS-1 | | 0.050 |
| Polyethylacrylate latex | | 0.15 |
| Gelatin | | 1.10 |
| **Seventh Layer (low-sensitivity green-sensitive emulsion layer)** | | |
| Silver Iodobromide Emulsion E | as silver | 0.23 |
| Silver Iodobromide Emulsion F | as silver | 0.15 |
| Silver Iodobromide Emulsion G | as silver | 0.15 |
| ExS-4 | | $3.0 \times 10^{-5}$ |
| ExS-5 | | $2.1 \times 10^{-4}$ |
| ExS-6 | | $8.0 \times 10^{-4}$ |
| ExM-2 | | 0.30 |
| ExM-3 | | 0.086 |
| ExY-1 | | 0.015 |
| HBS-1 | | 0.30 |
| HBS-3 | | 0.010 |
| Gelatin | | 0.73 |
| **Eighth Layer (medium-sensitivity green-sensitive emulsion layer)** | | |
| Silver Iodobromide Emulsion H | as silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExC-8 | | 0.010 |
| ExM-2 | | 0.10 |
| ExM-3 | | 0.025 |
| ExY-1 | | 0.018 |
| ExY-4 | | 0.010 |
| ExY-5 | | 0.040 |
| HBS-1 | | 0.13 |
| HBS-3 | | $4.0 \times 10^{-3}$ |
| Gelatin | | 0.80 |
| **Ninth Layer (high-sensitivity green-sensitive emulsion layer)** | | |
| Silver Iodobromide Emulsion I | as silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.010 |
| ExM-1 | | 0.020 |
| ExM-4 | | 0.025 |
| ExM-5 | | 0.040 |
| Cpd-3 | | 0.040 |
| HBS-1 | | 0.25 |
| Polyethylacrylate latex | | 0.15 |
| Gelatin | | 1.33 |
| **Tenth Layer (yellow filter layer)** | | |
| Yellow colloidal silver | as silver | 0.015 |
| Cpd-1 | | 0.16 |
| Solid Disperse Dye ExF-5 | | 0.060 |
| Solid Disperse Dye ExF-6 | | 0.060 |
| Oil-Soluble Dye ExF-7 | | 0.010 |
| HBS-1 | | 0.60 |
| Gelatin | | 0.60 |

-continued

| Eleventh Layer (low-sensitivity blue-sensitive emulsion layer) | | |
|---|---|---|
| Silver Iodobromide Emulsion J | as silver | 0.09 |
| Silver Iodobromide Emulsion K | as silver | 0.09 |
| ExS-7 | | $8.6 \times 10^{-4}$ |
| ExC-8 | | $7.0 \times 10^{-3}$ |
| ExY-1 | | 0.050 |
| ExY-2 | | 0.22 |
| ExY-3 | | 0.50 |
| ExY-4 | | 0.020 |
| Cpd-2 | | 0.10 |
| Cpd-3 | | $4.0 \times 10^{-3}$ |
| HBS-1 | | 0.28 |
| Gelatin | | 1.20 |
| **Twelfth Layer (high-sensitivity blue-sensitive emulsion layer)** | | |
| Silver Iodobromide Emulsion L | as silver | 1.00 |
| ExS-7 | | $4.0 \times 10^{-4}$ |
| ExY-2 | | 0.10 |
| ExY-3 | | 0.10 |
| ExY-4 | | 0.010 |
| Cpd-2 | | 0.10 |
| Cpd-3 | | $1.0 \times 10^{-3}$ |
| HBS-1 | | 0.070 |
| Gelatin | | 0.70 |
| **Thirteenth Layer (first protective layer)** | | |
| UV-1 | | 0.19 |
| UV-2 | | 0.075 |
| UV-3 | | 0.065 |
| HBS-1 | | $5.0 \times 10^{-2}$ |
| HBS-4 | | $5.0 \times 10^{-2}$ |
| Gelatin | | 1.8 |
| **Fourteenth Layer (second protective layer)** | | |
| Silver Iodobromide Emulsion M | as silver | 0.10 |
| H-1 | | 0.40 |
| B-1 (diameter: 1.7 μm) | | $5.0 \times 10^{-2}$ |
| B-2 (diameter: 1.7 μm) | | 0.15 |
| B-3 | | 0.13 |
| S-1 | | 0.20 |
| Gelatin | | 0.70 |

Further, in order to provide good preservability, processability, pressure durability, antimold/bactericidal property, antistatic property and coatability, W-1, W-2, W-3, B-4, B-5, B-6, F-1, F-2, F-3, F-4, F-5, F-6, F-7, F-8, F-9, F-10, F-11, F-12, F-13, F-14, F-15, F-16, F-17, iron salt, lead salt, gold salt, platinum salt, palladium salt, iridium salt or rhodium salt was appropriately added to each layer.

In Table 4:

(1) Emulsions G to L were subjected to reduction sensitization at the grain preparation using thiourea dioxide and thiosulfonic acid according to the Example of JP-A-2-191938;

(2) Emulsions A to L were subjected to gold sensitization, sulfur sensitization and selenium sensitization in the presence of the spectral sensitizing dyes described in each light-sensitive layer and sodium thiocyanate according to the Example of JP-A-3-237450;

(3) in the preparation of tabular grains, low molecular weight gelatin was used according to the Example of JP-A-1-158426; and (4) in tabular grains, dislocation lines were observed through a high-pressure electron microscope as described in JP-A-3-237450.

Preparation of Dispersion of Organic Solid Disperse Dye

ExF-3 shown below was dispersed in the following manner. To 1,430 g of a dye wet cake containing 30% of methanol, water and 200 g of Pluronic F88 (an ethylene oxide-propylene oxide blocaddedolymer, produced by BASF AG) were added an stirred to provide a slurry having a dye concentration of 6%. Then, 1,700 ml of zirconia beads having an average particle size of 0.5 mm were filled in an ultravisco mill (UVM-2) manufactured by Imex K.K. and the slurry obtained above was crushed by passing therethrough at a peripheral speed of about 10 m/sec and a discharge of 0.5 l/min for 8 hours. The beads were removed by filtration, water was added to dilute to a dye concentration of 3% and the dilution was heated for stabilization at 90° C. for 10 hours. The resulting fine dye particles had an average particle size of 0.60 μm and the particle size distribution had a breadth (standard deviation of particle size×100/average particle size) of 18%.

In the same manner, solid dispersions of ExF-4, ExF-5 and ExF-6 were obtained. The fine dye particles had an average particle diameter of 0.45 μm, 0.54 μm and 0.52 μm, respectively. ExF-2 was dispersed by the microprecipitation dispersion method using a pH shift described in the Example of JP-A-3-182743 and the average particle diameter of the dye fine particles was 0.05 μm.

TABLE 4

| | Average AgI Content (%) | Coefficient of Variation in AgI Content among Grains (%) | Average Grain Size, Sphere-Corresponding Diameter (μm) | Coefficient of Variation in Grain Size (%) | Projected Area Size, Circle-Corresponding Diameter (μm) | Diameter/ Thickness Ratio |
|---|---|---|---|---|---|---|
| Emulsion A | 1.7 | 10 | 0.46 | 15 | 0.56 | 5.5 |
| Emulsion B | 3.5 | 15 | 0.57 | 20 | 0.78 | 4.0 |
| Emulsion C | 8.9 | 25 | 0.66 | 25 | 0.87 | 5.8 |
| Emulsion D | 8.9 | 18 | 0.84 | 26 | 1.03 | 3.7 |
| Emulsion E | 1.7 | 10 | 0.46 | 15 | 0.56 | 5.5 |
| Emulsion F | 3.5 | 15 | 0.57 | 20 | 0.78 | 4.0 |
| Emulsion G | 8.8 | 25 | 0.61 | 23 | 0.77 | 4.4 |
| Emulsion H | 8.8 | 25 | 0.61 | 23 | 0.77 | 4.4 |
| Emulsion I | 8.9 | 18 | 0.84 | 26 | 1.03 | 3.7 |
| Emulsion J | 1.7 | 10 | 0.46 | 15 | 0.50 | 4.2 |
| Emulsion K | 8.8 | 18 | 0.64 | 23 | 0.85 | 5.2 |
| Emulsion L | 8.8 | 17 | 0.90 | 20 | 1.20 | 7.0 |
| Emulsion M | 1.0 | — | 0.07 | 15 | — | 1 |

ExC-1
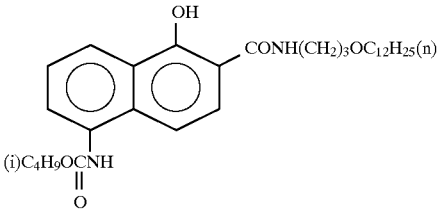
ExC-2
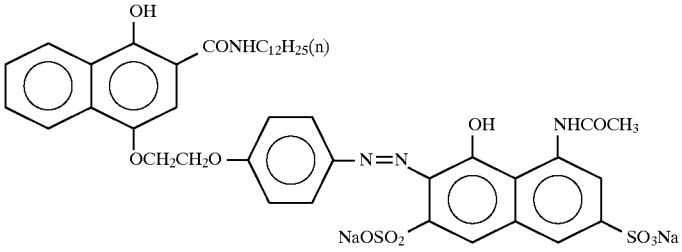
ExC-3
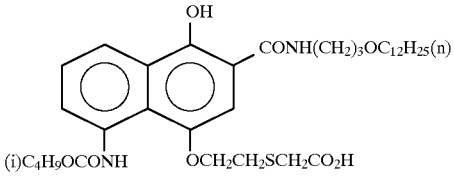
ExC-4
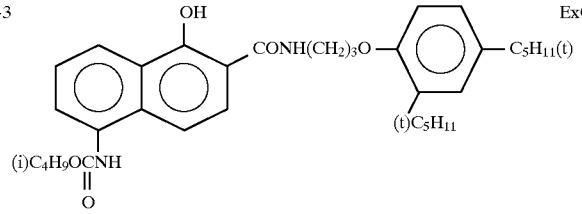
ExC-5
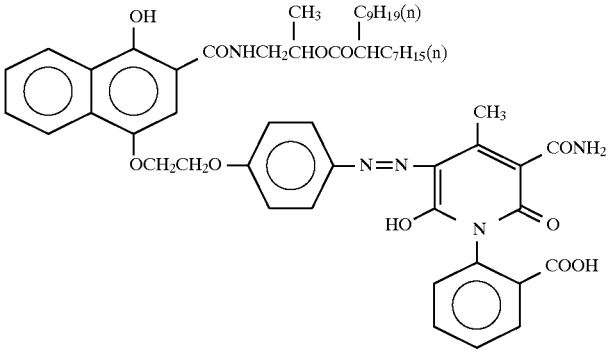
ExC-6
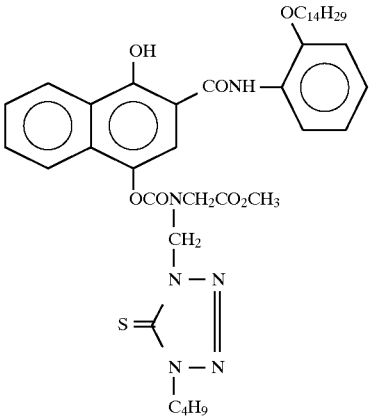
ExC-7
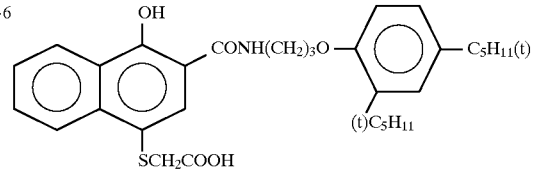

-continued
ExC-8
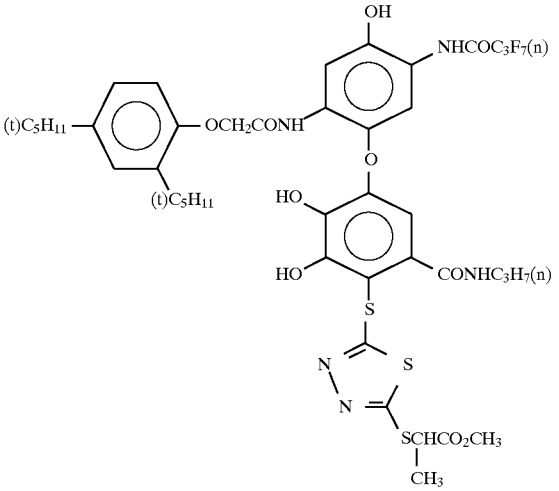
ExM-1
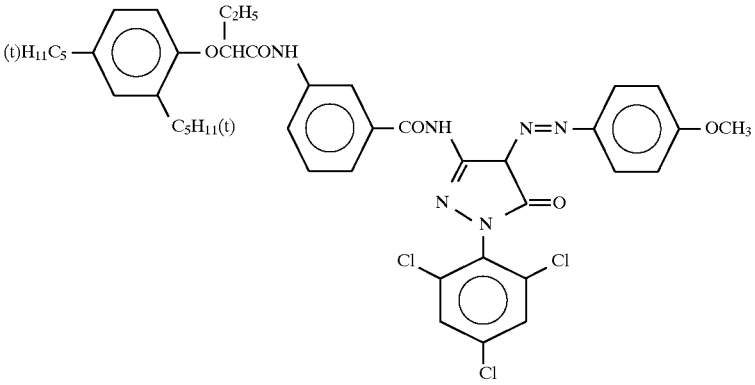
ExM-2
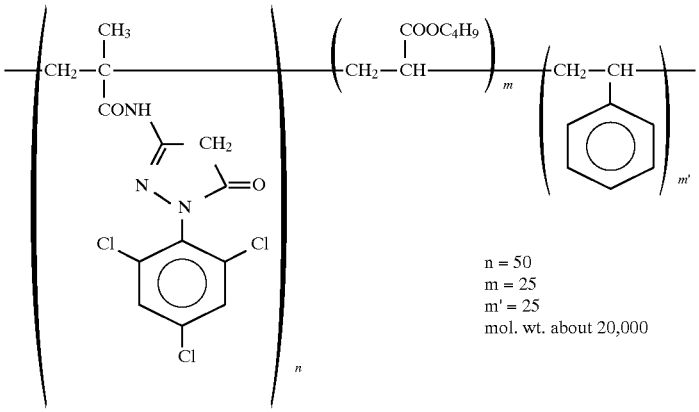
ExM-3
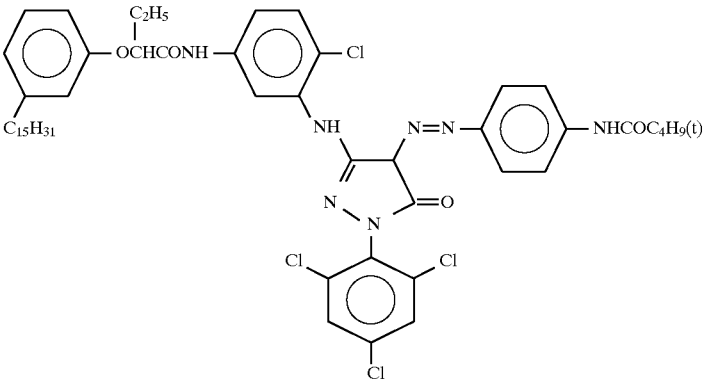

-continued
ExM-4
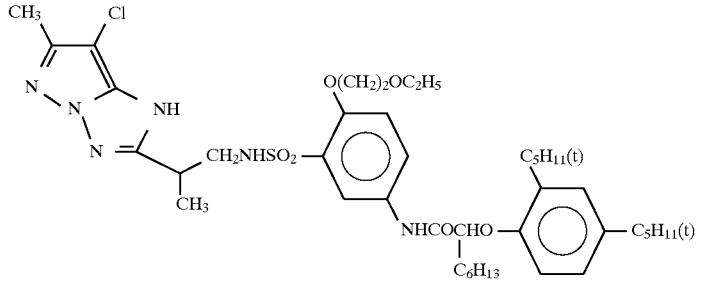
ExM-5
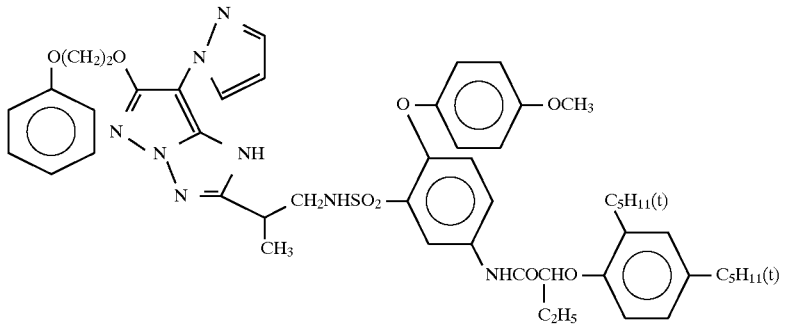
ExY-1
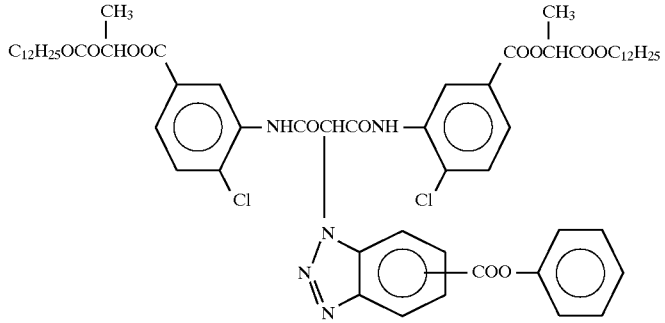
ExY-2
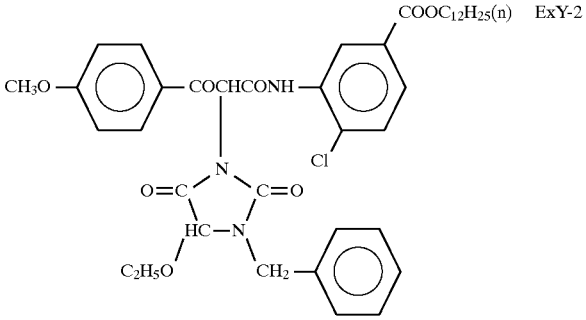
ExY-3
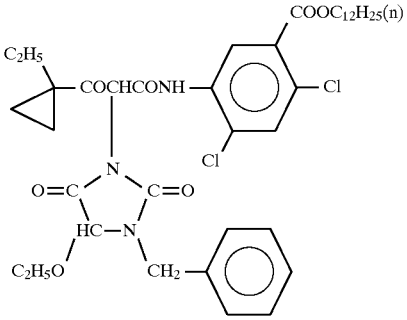
ExY-4
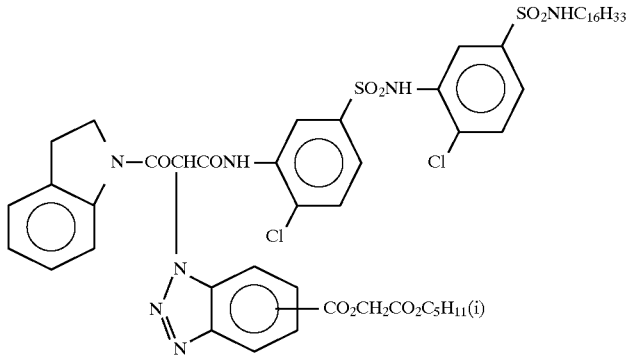

-continued
ExY-5
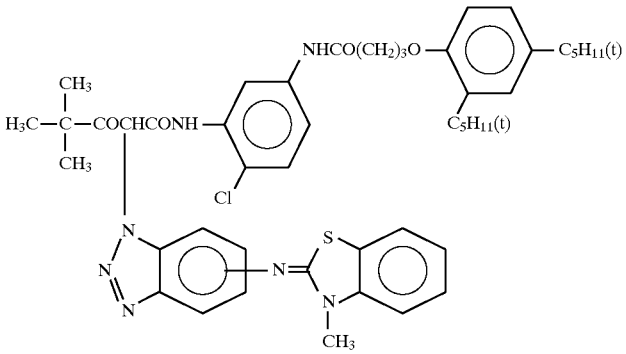
ExF-1
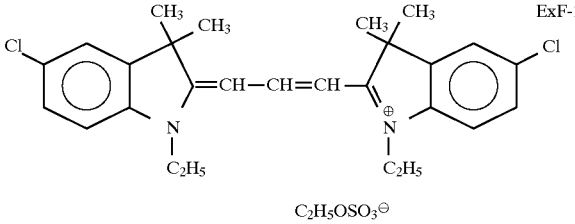
ExF-2
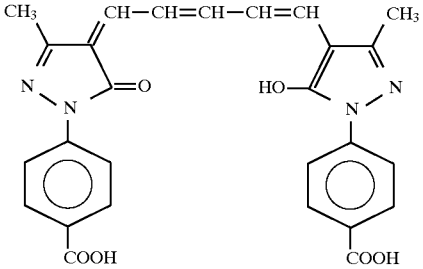
ExF-3
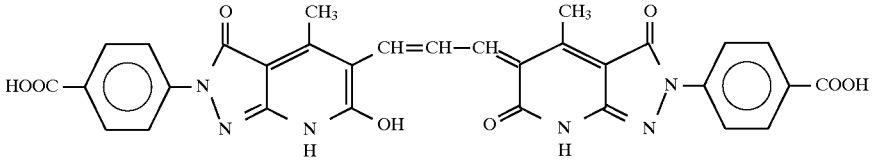
ExF-4
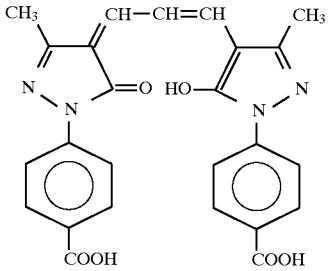
ExF-5
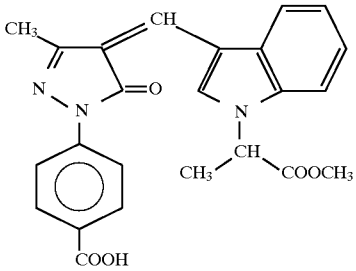
ExF-6
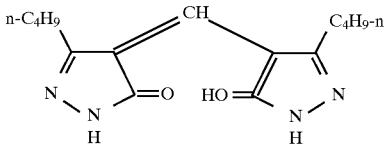
ExF-7
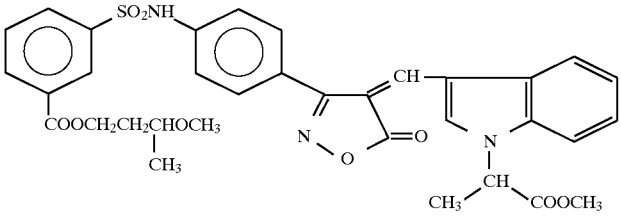

-continued
Cpd-1
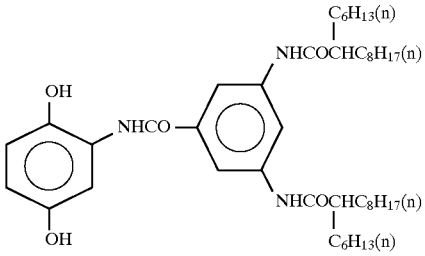
Cpd-2
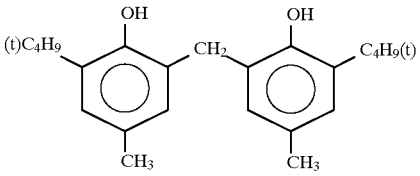
Cpd-3
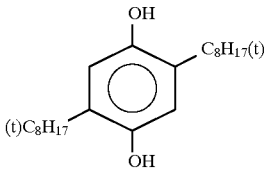
UV-1
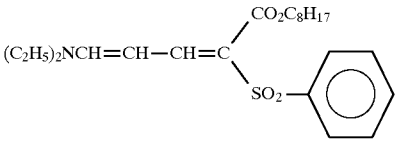
UV-2
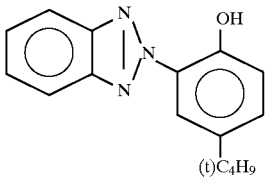
UV-3
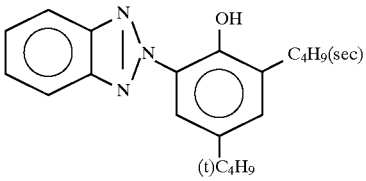
Tricresyl phosphate HBS-1
Di-n-butyl phthalate HBS-2
HBS-3
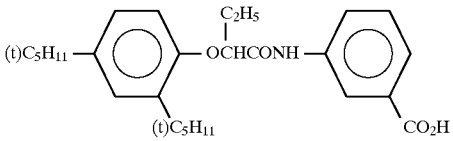
Tri(2-ethylhexyl) phosphate HBS-4
ExS-1
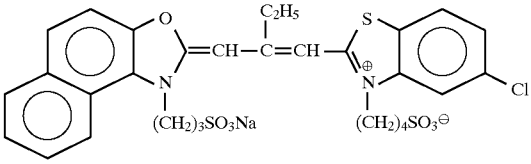
ExS-2
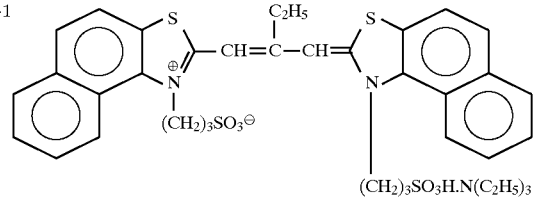
ExS-3
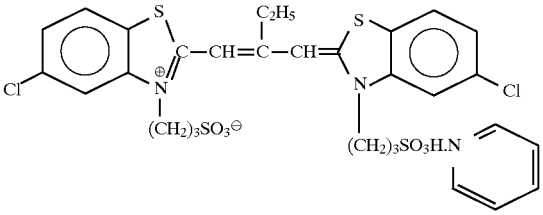
ExS-4
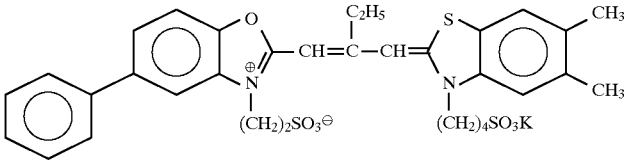
ExS-5
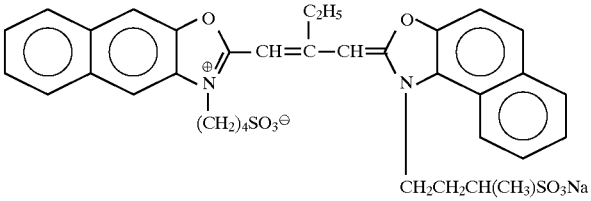

-continued
ExS-6
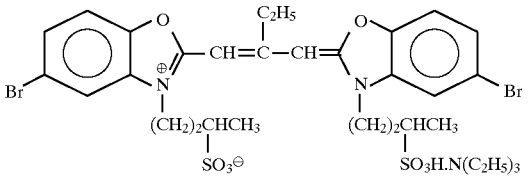
ExS-7
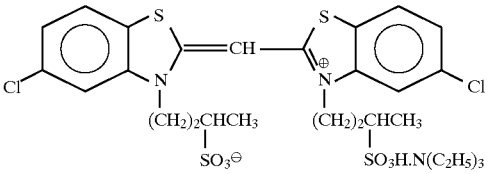
S-1
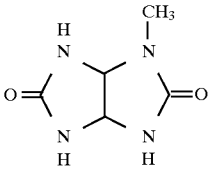
H-1
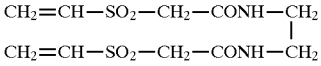
B-1
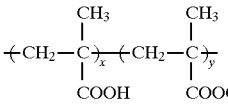
x/y = 10/90 (by weight)
Average molecular weight: about 35,000
B-2
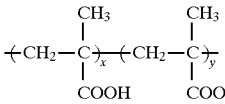
x/y = 40/60 (by weight)
Average molecular weight: about 20,000
B-3
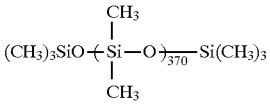
B-4
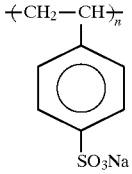
Average molecular weight: about 750,000
B-5
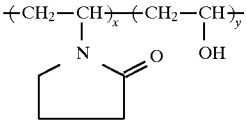
x/y = 70/30 (by weight)
Average molecular weight: about 17,000
B-6
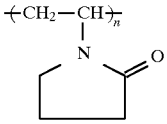
Average molecular weight: about 10,000
W-1
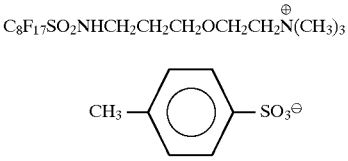
W-2
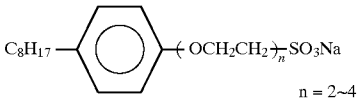
n = 2~4
W-3
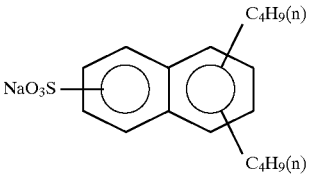
F-1
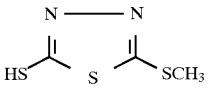
F-2
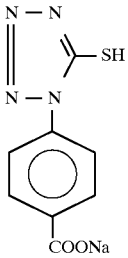
F-3
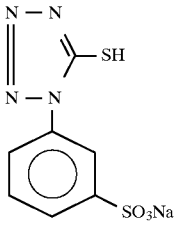
F-4
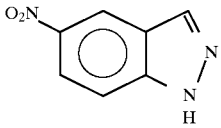
F-5
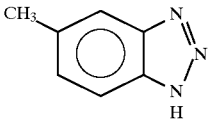

-continued

F-6

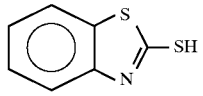

F-7

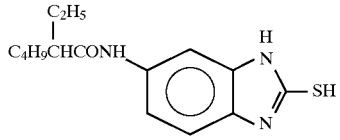

F-8

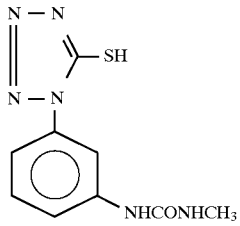

F-9

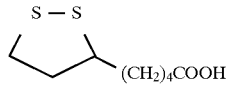

F-10

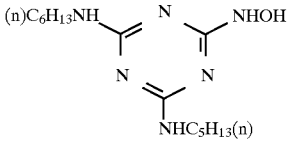

F-11

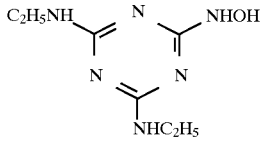

F-12

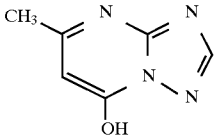

F-13

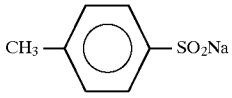

F-14

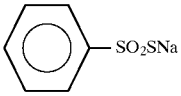

F-15

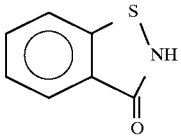

F-16

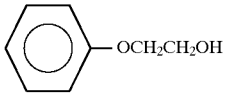

F-17

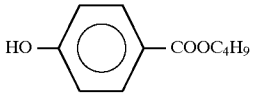

Sample 302 was prepared in the same manner as Sample 301 except for adding Compound (A-18) of the present invention to green-sensitive layers as the seventh layer and the eighth layer of Sample 301 to give a coated amount of 6 mg/m$^2$ and 10 mg/m$^2$, respectively.

Samples 303 and 304 were prepared in the same manner as samples 301 and 302, respectively, except for replacing Magenta Coupler ExM-2 used in green-sensitive layers as the seventh layer and the eighth layer of each of Samples 301 and 302 by an equimolar amount of Coupler (m-20) of the present invention.

Samples 305 to 312 were prepared in the same manner as Sample 301 except for replacing the above-described magenta coupler and the compound of the present invention as shown in Table 5. Polymer couplers to replace each was used in an equimolar amount calculated in terms of the pyrazolone mother nucleus as a constituent unit from the weight ratio.

TABLE 5

| | Seventh Layer | | | Eighth Layer | | | | | Pressure |
|---|---|---|---|---|---|---|---|---|---|
| | Magenta | Compound of (A-I), (A-II) or (A-III) | | Magenta | Compound of (A-I), (A-II) or (A-III) | | Color Density | | Fogging |
| Sample | Coupler | (mg/m$^2$) | | Coupler | (mg/m$^2$) | | 5° C. | 40° C. | (ΔD) |
| 301 (Comparison) | ExM-2 | — | | ExM-2 | — | | 100 (standard) | 76 | 0.14 |
| 302 (Comparison) | | (A-18) | 6 | | (A-18) | 10 | 87 | 48 | 0.13 |
| 303 (Comparison) | (m-20) | — | | (m-20) | — | | 195 | 192 | 0.18 |
| 304 (Invention) | | (A-18) | 6 | | (A-18) | 10 | 208 | 208 | 0.02 |

TABLE 5-continued

| Sample | Seventh Layer Magenta Coupler | Seventh Layer Compound of (A-I), (A-II) or (A-III) (mg/m²) | | Eighth Layer Magenta Coupler | Eighth Layer Compound of (A-I), (A-II) or (A-III) (mg/m²) | | Color Density 5° C. | Color Density 40° C. | Pressure Fogging (ΔD) |
|---|---|---|---|---|---|---|---|---|---|
| 305 (Invention) | (m-20) | | | (m-20) | | | 208 | 208 | 0.02 |
| 306 (Invention) | (m-1) | (A-15) | 6 | (m-1) | (A-15) | 10 | 202 | 202 | 0.02 |
| 307 (Invention) | (m-14) | | | (m-14) | | | 205 | 205 | 0.02 |
| 308 (Invention) | (m-5) | (A-17) | 6 | (m-5) | (A-17) | 10 | 204 | 204 | 0.02 |
| 309 (Invention) | (m-29) | (A-8) | 8 | (m-29) | (A-10) | 8 | 202 | 202 | 0.02 |
| 310 (Invention) | (m-19) | (A-16) | 5 | (m-2) | (A-19) | 20 | 206 | 206 | 0.02 |
| 311 (Invention) | (m-31) | (A-50) | 6 | (m-18) | (A-20) | 10 | 204 | 203 | 0.03 |
| 312 (Invention) | (m-14)/(m-33) = 3/1 (by mol) | (m-13)/(m-18) = 1/1 (by mol) | 6 | (m-21)/(m-39) = 3/1 (by mol) | (m-5)/(m-14) = 1/1 (by mol) | 10 | 203 | 203 | 0.02 |

The thus-prepared light-sensitive materials each was cut into a size of 24 mm (width)×160 cm (length) and two perforations each in a size of 2 mm×2 mm were provided on the portion of 0.7 mm inside from one side widthwise direction in the length direction of the light-sensitive material at an interval of 5.8 mm. Sample each having this pair of perforations at an interval of 32 mm was prepared. Each sample was housed in a plastic-made film patrone shown in FIG. 1. The core diameter was 7 mm and the number of turns was 32.

FM signals were recorded on the sample from the surface having coated thereon a magnetic recording layer between the above-described perforations of each light-sensitive material at a feeding speed of 1,000/s using a head capable of input/output having a head gap of 5 μm and a turn number of 2,000.

The light-sensitive materials housed in respective cartridges were examined on the following capabilities.

(1) Change in color density

Light-sensitive materials in one group were stored at 50° C. and 70% RH (relative humidity) and those in another group were stored at 5° C. and 35% RH (relative humidity) both groups for 7 days. The outermost part of each of the light-sensitive materials wound up and housed in a cartridge was taken out, exposed through a G filter placed in front of a wedge for sensitometry and then color developed as described below.

Developed light-sensitive materials were measured on the G density and the density at the point giving an exposure amount of logE=2.0 to the high exposure side was read from the point of an exposure amount giving a density of the minimum density+0.2 on the characteristic curve. The value ($D_{2.0}$) obtained by subtracting the minimum density value from this density value was obtained on respective light-sensitive materials and change in the color density was examined according to the method in Example 1. The density value of Sample 301 stored at 5° C. was taken as a standard of 100.

(2) Pressure fogging (ΔD)

Light-sensitive materials were stored at 45° C. and 75% RH (relative humidity) for 15 days. Thereafter, each sample was taken out from the cartridge and then without exposing it, subjected to the following color development processing.

Samples after development were measured on the G density from the leading end to the heel end and difference (ΔD) between the maximum value and the minimum value of the G density was obtained. With respect to this difference in the G density, when housed in a cartridge, the G density was high in the inner side of the roll and low in the outer side. The smaller the value is, the smaller the pressure fogging is.

The results obtained are shown together in Table 5.

The color development processing procedure and the composition of each processing solution used are shown below.

Fuji Color Negative Super G Ace 400 (manufactured by Fuji Photo Film Co., Ltd.) photographed in a camera was processed as follows every one m² per day over 15 days (running processing).

Each processing was conducted in the following manner using an automatic developing machine FP-360B manufactured by Fuji Photo Film Co., Ltd. The developing machine was modified so that the overflow solution of the bleaching bath was not flown into the subsequent bath but all were discharged to the waste tank. Into the developing machine FP-360B, an evaporation compensation means described in *JIII Journal of Technical Disclosure*, No. 94-4992 was mounted.

The processing procedure and the composition of each processing solution are shown below.

(Processing Procedure)

| Step | Processing Time | Processing Temperature (°C.) | Replenishing Amount* (ml) | Tank Volume (l) |
|---|---|---|---|---|
| Color development | 3 min 5 sec | 38.0 | 20 | 17 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Water washing | 30 sec | 38.0 | 17 | 3.5 |
| Stabilization (1) | 20 sec | 38.0 | — | 3 |
| Stabilization (2) | 20 sec | 38.0 | 15 | 3 |
| Drying | 1 min 30 sec | 60 | | |

*The replenishing amount was per 1.1 m of the light-sensitive material in a width of 35 mm (corresponding to 1 roll of 24 Ex.)

The stabilizing solution was flown from (2) to (1) in a countercurrent system and the overflow solution of washing water was all introduced into fixing (2). Also, the fixing solution was flown from (2) to (1) connected by piping in a countercurrent system. The carried-over amounts of developer into the bleaching step, of bleaching solution into the fixing step, and of fixing solution into the water washing step were 2.5 ml, 2.0 ml, and 2.0 ml, respectively, per 1.1 m of the light-sensitive material in a width of 35 mm. The cross-over time was 6 seconds in each interval and this time was included in the processing time of the previous step.

The open area of the above-described processor was 100 cm² for the color developer, 120 cm² for the bleaching solution and about 100 cm² for other processing solutions.

The composition of each processing solution is shown below.

| | Tank Solution (g) | Replenisher (g) |
|---|---|---|
| (Color Developer) | | |
| Diethylenetriaminepentaacetic acid | 2.0 | 2.0 |
| 1-Hydroxyethylidene-1,1-diphosphonic acid | 2.0 | 2.0 |
| Sodium sulfite | 3.9 | 5.3 |
| Potassium carbonate | 37.5 | 39.0 |
| Potassium bromide | 1.4 | 0.4 |
| Potassium iodide | 1.3 mg | — |
| Disodium N,N-bis(sulfonato-ethyl)hydroxylamine | 2.0 | 2.0 |
| Hydroxylamine sulfate | 2.4 | 3.3 |
| 2-Methyl-4-[N-ethyl-N-(β-hydroxyethyl)amino]aniline sulfate | 4.5 | 6.4 |
| Water to make | 1.0 l | 1.0 l |
| pH (adjusted by potassium hydroxide and sulfuric acid) | 10.05 | 10.18 |
| (Bleaching Solution) | | |
| Ammonium 1,3-diaminopropane-tetraacetato ferrate monohydrate | 118 | 180 |
| Ammonium bromide | 80 | 115 |
| Ammonium nitrate | 14 | 21 |
| Succinic acid | 40 | 60 |
| Maleic acid | 33 | 50 |
| Water to make | 1.0 l | 1.0 l |
| pH (adjusted by aqueous ammonia) | 4.4 | 4.0 |
| (Fixing Solution) | | |
| Ammonium methanesulfinate | 10 | 30 |
| Ammonium methanethiosulfonate | 4 | 12 |
| Aqueous solution of ammonium thiosulfate (700 g/l) | 280 ml | 840 ml |
| Imidazole | 7 | 20 |
| Ethylenediaminetetraacetic acid | 15 | 45 |
| Water to make | 1.0 l | 1.0 l |
| pH (adjusted by aqueous ammonia and acetic acid) | 7.4 | 7.45 |

(Washing Water)

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/l or less and then thereto 20 mg/l of sodium isocyanurate dichloride and 150 mg/l of sodium sulfate were added. The resulting solution had a pH of from 6.5 to 7.5.

(Stabilizing Solution)
The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| 1,2-Benzoisothiazolin-3-one | 0.10 |
| Water to make | 1.0 l |
| pH | 8.5 |

It is seen from Table 5 that in light-sensitive materials Samples 304 to 312 of the present invention, the color density was not reduced or if reduced, it was very small and therefore, even when the light-sensitive material was lengthily wound up and stored at high temperature, good coloring property could be exhibited. Further, with respect to the pressure fogging, in the light-sensitive materials of the present invention, the fog was scarcely increased and even when the light-sensitive material was lengthily wound up and stored at high temperature, good results could be likewise obtained.

EXAMPLE 4

Each sample prepared in Example 3 was cut into a size of 36 mm (width)×160 cm (length), provided with the same perforations as in the 135 type currently available, then in the same manner as in Example 1, wound around a spool having a diameter of 11 mm and housed in a patrone. The number of turns was 31. These samples were designated as Samples 401 to 412. Sample 401 corresponds to Sample 301, Sample 402 corresponds to Sample 302 and the same goes for other samples.

Using these light-sensitive materials housed in a patrone were evaluated on the capability in the same manner according to the method described in Example 3. The results are shown in Table 6.

TABLE 6

| | Seventh Layer | | | Eighth Layer | | | | | Pressure |
|---|---|---|---|---|---|---|---|---|---|
| | Magenta | Compound of (A-I), (A-II) or (A-III) | | Magenta | Compound of (A-I), (A-II) or (A-III) | | Color Density | | Fogging |
| Sample | Coupler | (mg/m$^2$) | | Coupler | (mg/m$^2$) | | 5° C. | 40° C. | (ΔD) |
| 401 (Comparison) | ExM-2 | — | | ExM-2 | — | | 100 (standard) | 77 | 0.13 |
| 402 (Comparison) | | (A-18) | 6 | | (A-18) | 10 | 87 | 50 | 0.12 |
| 403 (Comparison) | (m-20) | — | | (m-20) | — | | 195 | 193 | 0.17 |
| 404 (Invention) | | (A-18) | 6 | | (A-18) | 10 | 208 | 210 | 0.00 |
| 405 (Invention) | (m-20) | | | (m-20) | | | 208 | 210 | 0.00 |
| 406 (Invention) | (m-1) | (A-15) | 6 | (m-1) | (A-15) | 10 | 202 | 203 | 0.00 |
| 407 (Invention) | (m-14) | | | (m-14) | | | 205 | 207 | 0.00 |
| 408 (Invention) | (m-5) | (A-17) | 6 | (m-5) | (A-17) | 10 | 204 | 206 | 0.00 |
| 409 (Invention) | (m-29) | (A-8) | 8 | (m-29) | (A-10) | 8 | 202 | 204 | 0.00 |
| 410 (Invention) | (m-19) | (A-16) | 5 | (m-2) | (A-19) | 20 | 206 | 208 | 0.00 |

TABLE 6-continued

| | Seventh Layer | | | Eighth Layer | | | | | Pressure |
|---|---|---|---|---|---|---|---|---|---|
| | Magenta | Compound of (A-I), (A-II) or (A-III) | | Magenta | Compound of (A-I), (A-II) or (A-III) | | Color Density | | Fogging |
| Sample | Coupler | (mg/m$^2$) | | Coupler | (mg/m$^2$) | | 5° C. | 40° C. | (ΔD) |
| 411 (Invention) | (m-31) | (A-50) | 6 | (m-18) | (A-20) | 10 | 204 | 204 | 0.01 |
| 412 (Invention) | (m-14)/(m-33) = 3/1 (by mol) | (m-13)/(m-18) = 1/1 (by mol) | 6 | (m-21)/(m-39) = 3/1 (by mol) | (m-5)/(m-14) = 1/1 (by mol) | 10 | 203 | 205 | 0.00 |

It is seen from the results in Table 6 that in light-sensitive materials Samples 404 to 412 of the present invention, similar to Samples 304 to 312 in Example 3, the color density was not reduced or if reduced, it was very small and therefore, even when the light-sensitive material was lengthily wound up and stored at high temperature, good coloring property could be exhibited. Further, with respect to the pressure fogging, in the light-sensitive materials of the present invention, the fog was scarcely increased and even when the light-sensitive material was lengthily wound up and stored at high temperature, good results could be likewise obtained.

Upon comparison between results in this Example and in Example 3, in this Example, the same light-sensitive was wound around a spool having a diameter of 11 mm in a turn number of 31 and housed in the current patrone. Therefore, the pressure close to the core is considered to be slightly small than that in Example 3 and the difference in the pressure fogging to comparative samples was somewhat small. In this way, from comparison with Example 3, it is understood that the pressure fog is large when the light-sensitive material is wound around a spool having a small core diameter.

EXAMPLE 5

The same procedures as in Example 3 were repeated except that the back layer was changed according to the following, and the similar results as in Example 3 were obtained.

1) Antistatic layer

Resorcinol was not added.

2) Magnetic recording layer

The silica particles used as a matting agent was not employed. The amounts of the aluminum oxide (0.20 μm and 1.0 μm) were changed from 50 mg/m$^2$ and 10 mg/M$^2$, respectively, to 15 mg/M$^2$ and 5 mg/m$^2$, respectively. The drying was conducted at 95° C. for 6 minutes (the rollers and the conveyance device in the drying zone all were heated to 95° C.).

3) Lubricating layer

The 25 mg/m$^2$ of diacetyl cellulose was changed to 2 mg/m$^2$ of hydroxypropyl cellulose. The amount of $C_6H_{13}CH(OH)C_{10}H_{20}COOC_{40}H_{81}$ was changed from 6 mg/m$^2$ to 9 mg/M$^2$. As a result, the coefficient of dynamic friction (stainless steel ball (diameter: 5 mm); load: 100 g; speed: 6 cm/min) was reduced from 0.10 to 0.08, to exhibit further superior results.

According to the present invention, a silver halide color photographic material prevented from reduction in the color density and increase in the pressure fogging to be caused when the light-sensitive material is lengthily wound up and stored at high temperature and a package of the light-sensitive material can be provided.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having on one surface thereof at least one light-sensitive silver halide emulsion layer and at least one light-insensitive layer, wherein said silver halide color photographic light-sensitive material contains at least one compound selected from the group consisting of compounds represented by formulae (A-I), (A-II) and (A-III) and a coupler represented by formula (m):

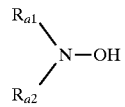
(A-I)

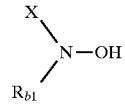
(A-II)

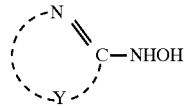
(A-III)

wherein in formula (A-I), $R_{a1}$ represents an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, $R_{a2}$ represents a hydrogen atom, an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, provided that when $R_{a1}$ is an alkyl group, an alkenyl group or an aryl group, $R_{a2}$ is an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, and $R_{a1}$ and $R_{a2}$ may be combined with each other to form a 5-, 6- or 7-membered ring, provided that an S-triazine ring is not formed;

in formula (A-II), X represents a heterocyclic group exclusive of an S-triazine ring, $R_{b1}$ represents an alkyl group, an alkenyl group or an aryl group and X and $R_{b1}$ may be combined with each other to form a 5-, 6- or 7-membered ring, provided that an S-triazine ring is not formed; and in formula (A-III), Y represents a nonmetallic atom group necessary for forming a 5-membered ring together with an —N=C— group or Y represents a nonmetallic atom group necessary for forming a 6-membered ring together with an —N=C— group with the terminal of Y to be bonded to the carbon atom of the —N=C— group being a group selected from —N($R_{c1}$)—, —C($R_{c2}$) ($R_{c3}$)—, —C($R_{c4}$)=, —O— and —S— (the carbon atom of —N=C— is bonded to the left site of each group), provided that an S-triazine ring is not formed, and $R_{c1}$, $R_{c2}$, $R_{c3}$ and $R_{c4}$ each represents a hydrogen atom or a substituent;

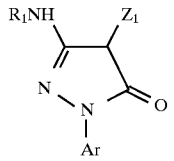

(m)

wherein $R_1$ represents an alkyl group, an aryl group, an acyl group or a carbamoyl group, Ar represents a phenyl group or a phenyl group substituted by one or more of a halogen atom, an alkyl group, a cyano group, an alkoxy group, an alkoxycarbonyl group, an acylamino group, a sulfonamido group, a sulfonyl group and a sulfamoyl group, and $Z_1$ represents a group capable of releasing off upon reaction with an oxidation product of an aromatic primary amine developing agent, wherein silver halide color photographic light-sensitive material contains at least one compound selected from the group consisting of compounds represented by formulae (A-I), (A-II) and (A-III) and a coupler represented by formula (m) in the same layer.

2. A silver halide color photographic light-sensitive material as claimed in claim 1, wherein a magnetic recording layer containing magnetic particles is provided on the side opposite to the side having said emulsion layer through the support.

3. A silver halide color photographic light-sensitive material as claimed in claim 1, wherein silver halide color photographic light-sensitive material contains at least one compound selected from the group consisting of compounds represented by formulae (A-I) and (A-II).

4. A silver halide color photographic light-sensitive material as claimed in claim 3, wherein silver halide color photographic light-sensitive material contains at least one compound selected from the group consisting of compounds represented by formula (A-I).

5. A silver halide color photographic light-sensitive material as claimed in claim 1, wherein silver halide color photographic light-sensitive material contains at least one compound selected from the group consisting of compounds represented by formulae (A-I), (A-II) and (A-III) in an amount of from 0.01 to 100 mg/$m^2$, per one silver halide light-sensitive layer, and a coupler represented by formula (m) in an amount of from $3\times10^{-5}$ to $3\times10^{-3}$ mol/$m^2$.

6. A silver halide color photographic light-sensitive material as claimed in claim 1, wherein in formula (m), $Z_1$ represents an alkylthio group, an arylthio group or a heterocyclic thio group.

7. A silver halide color photographic light-sensitive material as claimed in claim 1, wherein in formula (m), $Z_1$ represents a 5- or 6-membered nitrogen-containing heterocyclic group bonded to the coupling active site through the nitrogen atom.

8. A package of a photographic light-sensitive material comprising a cartridge body having rotatably housed in the inside thereof a spool wound around with a photographic light-sensitive material comprising a support having provided thereon an emulsion layer, a leading end of said photographic light-sensitive material capable of being fed outside said cartridge body along the rotation of said spool, said cartridge body having a passage having a light-shielding mechanism for feeding out said photographic light-sensitive material, a spool shaft of said spool having a pair of flanges with a lip in the inside at both edges thereof, and said photographic light-sensitive material comprising a support having on one surface thereof at least one light-sensitive silver halide emulsion layer and at least one light-insensitive layer, wherein said silver halide color photographic light-sensitive material contains at least one compound selected from the group consisting of compounds represented by formulae (A-I), (A-II) and (A-III) and a coupler represented by formula (m):

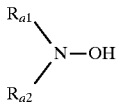

(A-I)

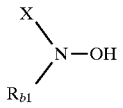

(A-II)

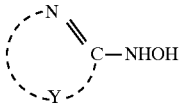

(A-III)

wherein in formula (A-I), $R_{a1}$ represents an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, $R_{a2}$ represents a hydrogen atom, an alkyl group, an alkenyl group, an aryl group, an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, provided that when $R_{a1}$ is an alkyl group, an alkenyl group or an aryl group, $R_{a2}$ is an acyl group, an alkylsulfonyl group, an arylsulfonyl group, an alkylsulfinyl group, an arylsulfinyl group, a carbamoyl group, a sulfamoyl group, an alkoxycarbonyl group or an aryloxycarbonyl group, and $R_{a1}$ and $R_{a2}$ may be combined with each other to form a 5-, 6- or 7-membered ring, provided that an S-triazine ring is not formed;

in formula (A-II), X represents a heterocyclic group exclusive of an S-triazine ring, $R_{b1}$ represents an alkyl group, an alkenyl group or an aryl group and X and $R_{b1}$ may be combined with each other to form a 5-, 6- or 7-membered ring, provided that an S-triazine ring is not formed; and in formula (A-III), Y represents a nonmetallic atom group necessary for forming a 5-membered ring together with an —N=C— group or Y represents a nonmetallic atom group necessary for forming a 6-membered ring together with an —N=C— group with the terminal of Y to be bonded to the carbon atom of the —N=C— group being a group selected from —N($R_{c1}$)—, —C($R_{c2}$)($R_{c3}$)—, —C($R_{c4}$)=, —O— and —S— (the carbon atom of —N=C— is bonded to the left site of each group), provided that an S-triazine ring is not formed, and $R_{c1}$, $R_{c2}$, $R_{c3}$ and $R_{c4}$ each represents a hydrogen atom or a substituent;

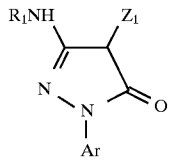

(m)

wherein $R_1$ represents an alkyl group, an aryl group, an acyl group or a carbamoyl group, Ar represents a phenyl group or a phenyl group substituted by one or more of a halogen atom, an alkyl group, a cyano group, an alkoxy group, an alkoxycarbonyl group, an acylamino group, a sulfonamido group, a sulfonyl group and a sulfamoyl group, and $Z_1$ represents a group capable of releasing off upon reaction with an oxidation product of an aromatic primary amine developing agents, wherein silver halide color photographic light-sensitive material contains at least one compound selected from the group consisting of compounds represented by formulae (A-I), (A-II) and (A-III) and a coupler represented by formula (m) in the same layer.

9. A package of a photographic light-sensitive material as claimed in claim 8, wherein a magnetic recording layer containing magnetic particles is provided on the side opposite to the side having said emulsion layer through the support.

* * * * *